US011760952B2

(12) United States Patent
Granger

(10) Patent No.: US 11,760,952 B2
(45) Date of Patent: Sep. 19, 2023

(54) LUBRICANT THICKENER SYSTEMS FROM MODIFIED TALL OIL FATTY ACIDS, LUBRICATING COMPOSITIONS, AND ASSOCIATED METHODS

(71) Applicant: INGEVITY SOUTH CAROLINA, LLC, North Charleston, SC (US)

(72) Inventor: Devin Granger, Goose Creek, SC (US)

(73) Assignee: INGEVITY SOUTH CAROLINA, LLC, North Charleston, SC (US)

( * ) Notice: Subject to any disclaimer, the term of this patent is extended or adjusted under 35 U.S.C. 154(b) by 0 days.

(21) Appl. No.: 17/571,479

(22) Filed: Jan. 8, 2022

(65) Prior Publication Data

US 2022/0220408 A1 Jul. 14, 2022

Related U.S. Application Data

(60) Provisional application No. 63/136,518, filed on Jan. 12, 2021.

(51) Int. Cl.

| | |
|---|---|
| ***C10M 117/04*** | (2006.01) |
| ***C10M 169/02*** | (2006.01) |
| ***C10M 177/00*** | (2006.01) |
| ***C10M 117/06*** | (2006.01) |
| ***C10N 70/00*** | (2006.01) |
| ***C10N 10/02*** | (2006.01) |
| ***C10N 40/02*** | (2006.01) |
| ***C10N 40/04*** | (2006.01) |
| ***C10N 40/32*** | (2006.01) |
| ***C10N 40/00*** | (2006.01) |
| ***C10N 50/10*** | (2006.01) |

(52) U.S. Cl.

CPC ..... *C10M 117/04* (2013.01); *C10M 117/06* (2013.01); *C10M 169/02* (2013.01); *C10M 177/00* (2013.01); *C10M 2201/0626* (2013.01); *C10M 2207/106* (2013.01); *C10M 2207/1206* (2013.01); *C10M 2207/1265* (2013.01); *C10M 2207/1276* (2013.01); *C10M 2207/186* (2013.01); *C10N 2010/02* (2013.01); *C10N 2040/02* (2013.01); *C10N 2040/04* (2013.01); *C10N 2040/32* (2013.01); *C10N 2040/38* (2020.05); *C10N 2050/10* (2013.01); *C10N 2070/00* (2013.01)

(58) Field of Classification Search

CPC ..... C10M 117/04; C10M 169/02; C10M 177/00; C10M 2201/0626; C10M 2207/106; C10M 2207/1206; C10M 2207/1265; C10M 2207/1276; C10M 2207/186; C10N 2010/02; C10N 2040/02; C10N 2040/04; C10N 2040/32; C10N 2040/38; C10N 2050/10; C10N 2070/00

See application file for complete search history.

(56) References Cited

U.S. PATENT DOCUMENTS

| | | | |
|---|---|---|---|
| 1,815,022 | A | 7/1931 | Davis |
| 2,015,748 | A | 10/1935 | Frolich |
| 2,100,993 | A | 11/1937 | Bruson |
| 2,191,498 | A | 2/1940 | Reiff |
| 2,380,960 | A | 8/1945 | Fraser |
| 2,387,501 | A | 10/1945 | Dietrich |
| 2,501,731 | A | 3/1950 | Mertes |
| 2,576,031 | A | 11/1951 | Morway et al. |
| 2,580,570 | A | 1/1952 | McCarthy |
| 2,616,911 | A | 11/1952 | Asseff et al. |
| 2,655,479 | A | 10/1953 | Munday et al. |
| 2,666,746 | A | 1/1954 | Munday et al. |
| 2,721,877 | A | 10/1955 | Popkin et al. |
| 2,721,878 | A | 10/1955 | Popkin et al. |
| 2,777,874 | A | 1/1957 | Asseff et al. |
| 2,817,693 | A | 12/1957 | Jacob et al. |
| 3,036,003 | A | 5/1962 | Verdol |
| 3,087,936 | A | 4/1963 | Le Suer |
| 3,098,823 | A | 7/1963 | Morway |
| 3,172,892 | A | 3/1965 | Le Suer et al. |
| 3,200,107 | A | 8/1965 | Le Suer et al. |
| 3,215,707 | A | 11/1965 | Rense |
| 3,219,666 | A | 11/1965 | Norman et al. |
| 3,250,715 | A | 5/1966 | Wyman |
| 3,254,025 | A | 5/1966 | Le Suer et al. |
| 3,272,746 | A | 9/1966 | Le Suer et al. |
| 3,275,554 | A | 9/1966 | Hendrik |
| 3,316,177 | A | 4/1967 | Dorer |
| 3,320,162 | A | 5/1967 | Axe et al. |
| 3,322,670 | A | 5/1967 | Burt et al. |
| 3,329,658 | A | 7/1967 | Fields |

(Continued)

FOREIGN PATENT DOCUMENTS

| | | |
|---|---|---|
| CA | 1094044 | 1/1981 |
| CA | 1188704 | 6/1985 |
| EP | 0 464 546 | 1/1992 |
| EP | 0 464 547 | 1/1992 |
| EP | 0 471 071 | 2/1992 |
| EP | 1 040 115 | 10/2000 |
| GB | 1350257 | 6/1971 |
| GB | 1390359 | 4/1975 |
| GB | 1429494 | 3/1976 |
| GB | 1440230 | 6/1976 |
| WO | WO 1988/003144 | 5/1988 |
| WO | WO 1999/031113 | 6/1999 |

*Primary Examiner* — James C Goloboy
(74) *Attorney, Agent, or Firm* — Bryan D. Zerhusen; Nicholas R. Herrel; CANTOR COLBURN LLP

(57) ABSTRACT

The present disclosure provides a soap thickener and methods of making the same. The soap thickener includes a metal soap of a carboxylic acid composition in a base oil, wherein the carboxylic acid composition includes a modified fatty acid composition prepared by performing a pericyclic reaction between an unsaturated small molecule and a fatty acid mixture. The present disclosure further provides lubricating compositions that include the soap thickener of the present disclosure and methods of preparing the same.

24 Claims, No Drawings

(56) References Cited

U.S. PATENT DOCUMENTS 3,341,542 A 9/1967 Le Suer et al.
3,384,585 A 5/1968 Gragson et al.
3,413,347 A 11/1968 Worrel
3,438,757 A 4/1969 Honnen et al.
3,444,170 A 5/1969 Norman et al.
3,449,250 A 6/1969 Fields
3,454,555 A 7/1969 Van Der Voot et al.
3,454,607 A 7/1969 Le Suer et al.
3,488,284 A 1/1970 Le Suer et al.
3,519,565 A 7/1970 Coleman
3,541,012 A 11/1970 Stuebe
3,565,804 A 2/1971 Honnen et al.
3,576,923 A 4/1971 Randell et al.
3,629,109 A 12/1971 Gergel et al.
3,630,904 A 12/1971 Musser et al.
3,632,511 A 1/1972 Liao
3,652,616 A 3/1972 Watson et al.
3,666,730 A 5/1972 Coleman
3,687,849 A 8/1972 Abbott
3,697,574 A 10/1972 Piasek et al.
3,702,300 A 11/1972 Coleman
3,703,536 A 11/1972 Piasek et al.
3,704,308 A 11/1972 Piasek et al.
3,725,277 A 4/1973 Worrel
3,725,480 A 4/1973 Traise et al.
3,726,882 A 4/1973 Traise et al.
3,742,082 A 6/1973 Brennen
3,751,365 A 8/1973 Piasek et al.
3,755,433 A 8/1973 Miller et al.
3,756,953 A 9/1973 Piasek et al.
3,769,363 A 10/1973 Brennen
3,787,374 A 1/1974 Adams
3,791,973 A 2/1974 Gilani et al.
3,798,165 A 3/1974 Piasek et al.
3,803,039 A 4/1974 Piasek et al.
3,822,209 A 7/1974 Knapp et al.
3,876,720 A 4/1975 Heilman et al.
3,948,800 A 4/1976 Meinhardt et al.
4,100,082 A 7/1978 Clason et al.
4,234,435 A 11/1980 Meinhardt et al.
4,239,930 A 12/1980 Allphin et al.
4,263,150 A 4/1981 Clason et al.
4,289,635 A 9/1981 Schroeck et al.
4,298,486 A 11/1981 Horodysky et al.
4,308,154 A 12/1981 Clason et al.
4,328,113 A 5/1982 Horodysky et al.
4,367,352 A 1/1983 Watts et al.
4,370,248 A 1/1983 Horodysky et al.
4,374,032 A 2/1983 Gemmill et al.
4,376,712 A 3/1983 Horodysky et al.
4,382,006 A 5/1983 Horodysky et al.
4,389,322 A 6/1983 Horodysky et al.
4,406,802 A 9/1983 Horodysky et al.
4,413,156 A 11/1983 Watts et al.
4,417,990 A 11/1983 Lasson et al.
4,434,408 A 2/1984 Baba et al.
4,454,059 A 6/1984 Pindar et al.
4,472,289 A 6/1984 Pindar et al.
4,426,305 A 10/1984 Malec
4,478,732 A 10/1984 Horodysky et al.
4,522,734 A 6/1985 Horodysky et al.
4,537,692 A 8/1985 Horodysky et al.
4,541,941 A 9/1985 Horodysky et al.
4,568,472 A 2/1986 Horodysky et al.
4,594,171 A 6/1986 Horodysky et al.
4,594,172 A 6/1986 Sie
4,622,158 A 11/1986 Walsh
4,652,416 A 3/1987 Millot
4,692,257 A 9/1987 Horodysky et al.
4,741,848 A 5/1988 Koch et al.
4,744,920 A 5/1988 Fischer et al.
4,752,416 A 6/1988 Scharf et al.
4,767,551 A 8/1988 Hunt et al.
4,784,795 A 11/1988 Fahl
4,792,410 A 12/1988 Schwind et al.
4,798,684 A 1/1989 Salomon
4,827,064 A 5/1989 Wu
4,827,073 A 5/1989 Wu
4,889,647 A 12/1989 Rowan et al.
4,897,178 A 1/1990 Best et al.
4,910,355 A 3/1990 Shubkin
4,921,594 A 5/1990 Miller
4,943,672 A 7/1990 Hammer et al.
4,952,739 A 8/1990 Chen
4,956,122 A 9/1990 Watts et al.
4,957,651 A 9/1990 Schwind
4,959,168 A 9/1990 Schroeck
4,975,177 A 12/1990 Garwood et al.
4,978,464 A 12/1990 Coyle
5,068,487 A 11/1991 Theriot
5,084,197 A 1/1992 Galic et al.
5,110,488 A 5/1992 Tipton et al.
5,275,749 A 1/1994 Kugel et al.
5,354,485 A 10/1994 Tipton et al.
5,430,105 A 7/1995 Redpath et al.
5,705,458 A 1/1998 Roby et al.
6,080,301 A 6/2000 Berlowitz et al.
6,090,989 A 7/2000 Trewella et al.
6,165,949 A 12/2000 Berlowitz et al.
6,300,288 B1 10/2001 Scharf et al.
6,323,164 B1 11/2001 Liesen et al.
6,448,366 B1 9/2002 Santhanam et al.
6,583,092 B1 6/2003 Carrick et al.
8,048,833 B2 11/2011 Habeeb et al.
8,563,488 B2 10/2013 Sivik et al.
8,969,266 B2 3/2015 Crawley et al.
9,376,647 B2 * 6/2016 Tanner ..... C09D 7/43
2003/0119682 A1 6/2003 Saini et al.
2005/0209114 A1 9/2005 Sivik et al.
2008/0020950 A1 1/2008 Gray et al.
2008/0261838 A1 10/2008 Karol et al.
2012/0055852 A1 * 3/2012 Soane ..... E21B 21/068
502/402
2013/0130953 A1 5/2013 Spagnoli et al.
2015/0344805 A1 2/2015 Dance et al.
2015/0315509 A1 * 11/2015 Watanabe ..... C10M 123/02
508/525
2015/0322367 A1 11/2015 Patel et al.
2017/0211007 A1 7/2017 Deckman et al.
2017/0335221 A1 * 11/2017 Waynick ..... C10M 159/24
2018/0070584 A1 * 3/2018 Meredith ..... A01N 37/40

* cited by examiner

LUBRICANT THICKENER SYSTEMS FROM MODIFIED TALL OIL FATTY ACIDS, LUBRICATING COMPOSITIONS, AND ASSOCIATED METHODS

CROSS-REFERENCE TO RELATED APPLICATIONS

The present application claims priority to U.S. Provisional Patent Application No. 63/136,518, filed 12 Jan. 2021, titled: LUBRICANT THICKENER SYSTEMS FROM MODIFIED TALL OIL FATTY ACIDS, LUBRICATING COMPOSITIONS, AND ASSOCIATED METHODS, which is incorporated herein by reference in its entirety for all purposes.

FIELD

The present disclosure relates to a soap thickener or a complex soap thickener, lubricating compositions containing the same, and associated methods, such as methods of synthesizing the soap thickener or complex soap thickener and lubricating compositions.

BACKGROUND

Lubricating formulations and greases with a wide assortment of different materials are known. For example, lithium complex greases are well known and can be made from any of a wide variety of base stocks of lubricating oil viscosity, as well as mixtures of base stocks. For example, complex greases (such as lithium complex greases) that comprise a complex thickener (such as lithium complex thickener) and a lubricating base oil are well known. Greases have varied levels of desirable grease characteristics, such as dropping point, penetration, mechanical stability, shear stability, oxidation resistance, high temperature resistance, etc. These characteristics are used to describe the lubricating life of the particular grease. Additives may be introduced during formulation of lubricating compositions, such as greases, to impart properties that are lacking in the base oil or the thickener.

Soap thickeners form the structural framework of lubricating greases, allowing for retention of the lubricant for continued use in the application. The thickener acts as a sponge for the lubricating oil and prevent the flow of greases while at rest. Soap thickeners can be formed from fatty acids reacted with alkali bases (or similarly reactive metal salts) in a quantity of oil. The materials described in U.S. Pat. Nos. 2,380,960, 2,576,031, 2,580,570, and 3,098,823 as potentially useful for grease formulation as soaps with various metal counterions include reaction products of tall oil fatty acids (TOFA), distilled tall oil (DTO) and/or tall oil rosin (TOR) with alkali and alkaline earth bases to form soaps in lubricating greases, purported as providing a possible alternative to 12-hydroxystearic acid, which has shown some supply chain instability issues. As described in greater detail below, TOFA are natural products of pine trees that is isolated from crude tall oil (CTO), which is recovered from the Kraft paper process. TOFA and TOR are separated from CTO by distillation to produce a variety of grades of acids including low rosin TOFA (<10% rosin acids), DTO (10%-70% rosin acids), and TOR (>70% rosin acids).

Currently, lithium soap-based greases represent approximately 80% of the lubricating grease market and generally provide acceptable lubricating performance. However, lithium soap-based greases are limited by their high-temperature resistance. For example, lithium soap-based grease in polyalphaolefin (PAO) based fluid maxes out at 140° C. Increasing the dropping point of a grease effectively increases the useful temperature range of the grease by equivalent degrees. Currently available high-temperature lithium greases are either composed of solid particles, such as polytetrafluoroethylene (PTFE), which induce wear and tear on the lubricated surface(s) (such as bearings, gears, slide plates, etc.), or polyester (POE) base oils, which are costly, are limited in certain properties and impractical for manufacture. By way of further example, the addition of dibasic acids to the soap thickener alters the physical structure of the thickener phase and consequently tends to increase the dropping point of the grease by up to 100° C. These mixed soap thickeners are referred to as complex soaps and are typically formed by combining the metal salts of fatty acids, frequently 12-hydroxystearic acid, and dibasic acids, such as azelaic or sebacic acids.

Thus, a need exists for thickeners and lubricating compositions that have increased dropping point to provide increased temperature ranges and imparting other properties that are lacking in present thickeners (e.g., decrease metal staining, increased tackiness, and enhanced corrosion resistance), thereby decreasing the complexity of the formulations.

SUMMARY

The present disclosure provides a soap thickener or complex soap thickener, a method of making the same, a lubricating composition (such as a grease) comprising the soap thickener or complex soap thickener of the present disclosure, methods of making the same, and methods of using the compositions of the present disclosure. The soap thickener or complex soap thickener of the present disclosure can be used in a wide variety of lubricants (such as greases, gear oils, chain oils, and cable or wire drawing lubricants). Surprisingly and unexpectedly, the soap thickener or complex soap thickener of the present disclosure has increased soap concentrations and provides similar performance as other soap thickeners with similar thickener concentrations, while providing enhanced anti-corrosion activity, low metal staining, increased tackiness, increased dropping point, and extended high temperature resistance without the inclusion of additives, or with the inclusion at lower levels usually required, that are specifically added to impart these properties to a lubricant. As such, because soap thickeners or the complex soap thickeners of the present disclosure have the above enhanced activities relative to previously described thickener systems, the soap thickener or complex soap thickener of the present disclosure also provides the advantage of reducing the amount of or eliminating the need for additives added to the lubricating composition to achieve the advantageous properties discussed above. Thus, not only are the formulations less complex, but so too are the process of preparing lubricating composition, thereby decreasing preparation times and costs of lubricating composition utilizing the soap thickener or complex soap thickener of the present disclosure.

Thus, in an aspect, the present disclosure provides a soap thickener or complex soap thickener. The soap thickener or complex soap thickener comprising a metal soap of a carboxylic acid composition in a base oil, wherein the carboxylic acid composition comprises a modified fatty acid composition prepared by performing a pericyclic reaction between an unsaturated small molecule and a fatty acid mixture (e.g., a fatty acid mixture that can undergo pericyclic reaction).

In another aspect, the present disclosure provides a soap thickener or complex soap thickener produced by a method comprising preparing a soap or complex soap of a carboxylic acid composition in a base oil to produce the soap thickener or complex soap thickener, wherein the carboxylic acid composition comprises a modified fatty acid composition prepared by performing a pericyclic reaction between an unsaturated small molecule and a fatty acid mixture (e.g., a fatty acid mixture that can undergo pericyclic reaction).

In yet a further aspect, the present disclosure provides a method of preparing soap thickener or complex soap thickener. The method comprising preparing a soap or complex soap of a carboxylic acid composition in a base oil to produce the soap thickener or complex soap thickener, wherein the carboxylic acid composition comprises a modified fatty acid composition prepared by performing a pericyclic reaction between an unsaturated small molecule and a fatty acid mixture (e.g., a fatty acid mixture that can undergo pericyclic reaction).

In any aspect or embodiment described herein, the fatty acid mixture is a mixture of $C_{12-20}$ fatty acids (e.g., a mixture of $C_{12-20}$ fatty acids that can undergo pericyclic reaction).

In any aspect or embodiment described herein, the fatty acid mixture is a vegetable oil.

In any aspect or embodiment described herein, the the vegetable oil is selected from safflower oil, grapeseed oil, sunflower oil, walnut oil, soybean oil, cottonseed oil, coconut oil, corn oil, olive oil, palm oil, palm olein/kernel oil, peanut oil, rapeseed oil, canola oil, sesame oil, hazelnut oil, almond oil, beech nut oil, cashew oil, macadamia oil, mongongo nut oil, pecan oil, pine nut oil, pistachio oil, grapefruit seed oil, lemon oil, orange oil, watermelon seed oil, bitter gourd oil, buffalo gourd oil, butternut squash seed oil, egusi seed oil, pumpkin seed oil, borage seed oil, blackcurrant seed oil, evening primrose oil, acai oil, black seed oil, flaxseed oil, carob pod oil, amaranth oil, apricot oil, apple seed oil, argan oil, avocado oil, babassu oil, ben oil, borneo tallow nut oil, cape chestnut, algaroba oil, cocoa butter, cocklebur oil, poppyseed oil, cohune oil, coriander seed oil, date seed oil, dika oil, false flax oil, hemp oil, kapok seed oil, kenaf seed oil, lallemantia oil, mafura oil, manila oil, meadowfoam seed oil, mustard oil, okra seed oil, papaya seed oil, perilla seed oil, persimmon seed oil, pequi oil, pili nut oil, pomegranate seed oil, prune kernel oil, quinoa oil, ramtil oil, rice bran oil, royle oil, shea nut oil, sacha inchi oil, sapote oil, seje oil, taramira oil, tea seed oil, thistle oil, tigernut oil, tobacco seed oil, tomato seed oil, wheat germ oil, castor oil, colza oil, flax oil, radish oil, salicornia oil, tung oil, honge oil, jatropha oil, jojoba oil, nahor oil, paradise oil, petroleum nut oil, dammar oil, linseed oil, stillingia oil, vernonia oil, amur cork tree fruit oil, artichoke oil, balanos oil, bladderpod oil, brucea javanica oil, burdock oil, candlenut oil, carrot seed oil, chaulmoogra oil, crambe oil, croton oil, cuphea oil, honesty oil, mango oil, neem oil, oojon oil, rose hip seed oil, rubber seed oil, sea buckthorn oil, sea rocket seed oil, snowball seed oil, tall oil, tamanu oil, tonka bean oil, ucuhuba seed oil, or any mixture thereof.

In any aspect or embodiment described herein, the fatty acid mixture is tall oil fatty acids (TOFA).

In any aspect or embodiment described herein, preparing the soap or complex soap includes at least one of: (i) combining the base oil (e.g., about 70.0 wt. % to about 95.0 wt. % of the soap thickener or complex soap thickener) and the carboxylic acid composition (e.g., about 5.0 wt. % to about 25.0 wt. % of the soap thickener or complex soap thickener) to produce a base oil, carboxylic acid mixture composition in the base oil; (ii) dissolving the acid components of the carboxylic acid composition in the base oil; (iii) adding a slurry of excess metal base (e.g., about 2.5 wt. % to about 6.0 wt. % of the c soap thickener or complex soap thickener) in water to the base oil, carboxylic acid mixture to produce a slurry mixture; (iv) neutralizing the slurry mixture to form a soap solution; (v) dehydrating the soap solution to form the soap thickener or complex soap thickener; and (vi) a combination thereof.

In any aspect or embodiment described herein, at least one of: (i) dissolving the acid components in the base oil includes heating the base oil, carboxylic acid mixture (e.g., heating the base oil, carboxylic acid mixture to about 65.0° C. to about 95.0° C. and/or heating the base oil, carboxylic acid mixture for about 20 minutes to about 40 minutes); (ii) the excess metal base is a slurry of about 1.0% to about 10.0% excess metal base; (iii) prior to neutralizing the slurry mixture, the method further comprises heating the slurry mixture (e.g. heating the slurry mixture to about 80.0° C. to about 95.0° C. and/or heating the slurry mixture for at least 30 minutes, such as about 30 minutes to about 60 minutes); (iv) neutralizing the slurry mixture includes heating the slurry mixture to about 110.0° C. to about 130.0° C. (e.g., heating the slutty mixture to about 115.0° C. to about 125.0° C. and/or heating the slurry mixture for about 45 minutes to about 90 minutes, such as about 50 minutes to about 75 minutes); (v) dehydrating the soap solution to form the soap thickener or complex soap thickener includes heating the soap solution (e.g., heating the soap solution to about 190° C. to about 250° C. and/or heating the soap solution for about 20 minutes to about 60 minutes); and (vi) a combination thereof.

In any aspect or embodiment described herein, the metal base is selected from: lithium hydroxide, calcium hydroxide, aluminum hydroxide, sodium hydroxide, potassium hydroxide, or a combination thereof.

In any aspect or embodiment described herein, the modified fatty acid composition is blended with blending fatty acids (e.g., up to about 50.0 wt. % of the complex carboxylic acid composition or about 30.0 wt. % to about 40.0 wt.$ of the carboxylic acid composition) prior to preparing a soap or complex soap of the carboxylic composition.

In any aspect or embodiment described herein, the blending fatty acids are at least one of: one or more saturated fatty acid (e.g. palmitic acid, stearic acid, arachidic acid, and/or behenic acid), one or more hydroxy fatty acid (e.g. 9-hydroxystearic acid, 10-hydroxystearic acid, and/or 12-hydroxystearic acid), and one or more branched fatty acids (e.g. iso-palmitic acid, iso-stearic acid, iso-arachidic acid, iso-behenic acid, 10-methyl-iso-palmitic acid, and/or 14-methyl-hexadecanoic acid).

In any aspect or embodiment described herein, the ratio of the fatty acid mixture to the lending fatty acids is from about 95:5 to about 20:80 (e.g., about 85:15 to about 40:60 or about 75:25 to about 50:50).

In any aspect or embodiment described herein, the unsaturated small molecule is at least one of acrylic acid, fumaric acid, and maleic anhydride.

In any aspect or embodiment described herein, the pericyclic reaction is a Diels-Alder reaction.

In any aspect or embodiment described herein, the soap thickener or complex soap thickener comprises about 25.0% to about 75.0% polybasic acids (e.g., about 40.0% to about 60.0% polybasic acids.

In any aspect or embodiment described herein, the balance of the soap thickener or complex soap thickener comprises unreacted fatty acids and reaction byproducts other than polybasic acids.

In any aspect or embodiment described herein, water is present in an amount of less than or equal to about 10.0 wt. % of the soap thickener or complex soap thickener. (e.g., less than about 5.0 wt. % of the soap thickener or complex soap thickener).

In any aspect or embodiment described herein, the modified fatty acid composition is a modified TOFA composition.

In any aspect or embodiment described herein, the modified TOFA composition is selected from maleated TOFA, fumarated TOFA, acylated TOFA, DIACID® 1525 (CAS #53980-88-4), AltaVeg DIACID® 1525 (CAS #53980-88-4), DIACID® 1550 (CAS #53980-88-4), TENAX® 2010 (CAS #68139-89-9), TENAX® 2010 Feed (CAS #68139-89-9), and C21 diacid (CAS #53980-88-4).

In any aspect or embodiment described herein, the modified TOFA composition comprises DIACID® 1525 [5(or 6)-carboxy-4-hexylcyclohex-2-ene-1-octanoic acid].

In any aspect or embodiment described herein, the modified TOFA composition comprises DIACID® 1550 [5(or 6)-carboxy-4-hexylcyclohex-2-ene-1-octanoic acid].

In any aspect or embodiment described herein, the modified TOFA composition comprises TENAX® 2010 (maleated tall oil fatty acid composition).

In any aspect or embodiment described herein, the modified TOFA composition comprises TENAX® 2010 FEED (maleated tall oil fatty acid composition).

Another aspect of the present disclosure provides a soap thickener or complex soap thickener produced according to the method described in the present disclosure.

A further aspect of the present disclosure provides a lubricating composition comprising: the soap thickener or complex soap thickener of the present disclosure; and a base oil (e.g., base oil present in an amount of about 70.0 wt. % to about 95.0 wt. % of the lubricating composition).

An additional aspect of the present disclosure provides a lubricating composition comprising: a base oil (e.g., base oil present in an amount of about 70.0 wt. % to about 95.0 wt. % of the lubricating composition) thickened to a grease consistency with the soap thickener or complex soap thickener of the present disclosure.

In yet a further aspect, the present disclosure provides a lubricating composition comprising: a base oil (e.g., base oil present in an amount of about 70.0 wt. % to about 95.0 wt. % of the lubricating composition), and the soap thickener or complex soap thickener of the present disclosure in an amount sufficient to thicken the base oil to the consistency of a grease.

In any aspect or embodiment described herein, the soap thickener or complex soap thickener is present in an amount of about 5.0 wt. % to about 30.0 wt. % (e.g., about 10 wt. % to about 20 wt. %) of the lubricating composition.

In any aspect or embodiment described herein, the lubricating composition of the present disclosure further comprising at least one additive selected from the group consisting of: a friction modifier, an emulsifier, a surfactant, a co-thickener, a rheology modifier, a corrosion inhibitor, an antioxidant, a wear inhibitor, an extreme pressure agent, a tackiness agent, a viscosity modifier, a colorant, an odor control agent, a filler, and a combination thereof.

In any aspect or embodiment described herein, the lubricating composition is a grease, a gear oil, a chain oil, a track oil grease, a centralized greasing system grease, a cable drawing lubricant, or a wire drawing lubricant.

A further aspect of the present disclosure provides a method of preparing a lubricating composition. The method comprising: providing a soap thickener or complex soap thickener of the present disclosure; heating the soap thickener or complex soap thickener (e.g., about 160.0° C. to about 200.0° C.); cooling the soap thickener or complex soap thickener (e.g., cool to a temperature below the base oil flash point, e.g. to a temperature of about 160.0° C. to about 190.0° C.); diluting the cooled soap thickener or complex soap thickener with a base oil (e.g., adding base oil in an amount of up to 35.0 wt. % of the lubricating composition depending upon the desired National Lubricating Grease Institute (NLGI) grade); and milling the soap thickener or complex soap thickener (e.g., milling the soap thickener or complex soap thickener at a temperature of about 25.0° C. to about 80.0° C., such as at a temperature of about 45.0° C. to about 75.0° C.).

In any aspect or embodiment described herein, diluting the cooled soap thickener or complex soap thickener with a base oil includes adding a sufficient amount of base oil to obtain the desired NLG) grade of the lubricating composition.

In any aspect or embodiment described herein, at least one of: (i) measuring cone penetration of the lubricating composition (e.g., via ASTM D217) to determine the NLGI grade; (ii) mixing in base oil to the lubricating composition to increase the cone penetration of the complex thickener soap; and (iii) a combination thereof.

In any aspect or embodiment described herein, cooling the soap thickener or complex soap thickener includes at least one of: (i) cooling the soap thickener or complex soap thickener slowly to about 100.0° C. to about 120.0° C., (ii) heating the soap thickener or complex soap thickener to about 160.0° C. to about 200.0° C. (e.g., for about 20 minutes to 60 minutes); (iii) cooling the soap thickener or complex soap thickener to a temperature below the flash point of the base oil (e.g. to a temperature of about 160.0° C. to about 190.0° C.); and a combination thereof.

In any aspect or embodiment described herein, wherein the lubricating composition is a grease, a gear oil, a chain oil, a track oil grease, a centralized greasing system grease, a cable draing lubricant, or a wire drawing lubricant.

An aspect of the present disclosure provides a lubricating composition produced by the method described herein to prepare lubricating compositions.

A further aspect of the present disclosure provides a method of lubricating. The method comprising applying the lubricating composition of the present disclosure to a surface in the need thereof.

In any aspect or embodiment described herein, the surface includes a gear, a chain, a track (such as a railroad track), a cable, a wire, a roller bearing, a metal plate, a journal bearing, an open bear box, a pump, a piston, or a combination thereof.

Further aspects, features, and advantages of the present disclosure will be apparent to those of ordinary skill in the art upon examining and reading the following Detailed Description.

DETAILED DESCRIPTION

The following is a detailed description provided to aid those skilled in the art in practicing the present disclosure. Those of ordinary skill in the art may make modifications and variations in the embodiments described herein without departing from the spirit or scope of the present disclosure. All publications, patent applications, patents, figures and other references mentioned herein are expressly incorporated herein by reference in their entirety for all purposes.

The present disclosure provides improved composition and methods for producing lubricating compositions. As described herein, the compositions of the present disclosure provide economical and desirable properties that are surprising and unexpected. In particular, the present disclosure provides a soap thickener or complex soap thickener, a method of making the same, a lubricating composition (such as a grease) comprising the soap thickener or complex soap thickener of the present disclosure; methods of making the same, and methods of using the compositions of the present disclosure. Surprisingly and unexpectedly, the soap thickener or complex soap thickener of the present disclosure has similar performance characteristics as other soap thickeners and increase soap concentrations, and when incorporated in lubricating compositions, the lubricating composition have enhanced anti-corrosion activity, low levels of metal staining, increased tackiness, increased dropping point, and extended high temperature resistance without the inclusion, or reduced levels, of additives that are specifically added to impart these properties to a lubricant or lubricating composition. As such, because the soap thickener or complex soap thickeners of the present disclosure have the above enhanced activities relative to previously described thickener systems, the soap thickener or complex soap thickener of the present disclosure also provides the advantage of reducing the amount of or eliminating the need for additives added to the lubricating composition to achieve the advantageous properties discussed above, which decreases the complexity of lubricating compositions, as well as decreasing the complexity of the process of preparing lubricating composition, thereby decreasing preparation times and costs of lubricating composition utilizing the soap thickener or complex soap thickener of the present disclosure.

Unless otherwise defined, all technical and scientific terms used herein have the same meaning as commonly understood by one of ordinary skill in the art to which this disclosure belongs. The terminology used in the description is for describing particular embodiments only and is not intended to be limiting of the disclosure.

Where a range of values is provided, it is understood that each intervening value, to the tenth of the unit of the lower limit unless the context clearly dictates otherwise (such as in the case of a group containing a number of carbon atoms in which case each carbon atom number falling within the range is provided), between the upper and lower limit of that range and any other stated or intervening value in that stated range is encompassed within the disclosure. The upper and lower limits of these smaller ranges may independently be included in the smaller ranges is also encompassed within the disclosure, subject to any specifically excluded limit in the stated range. Where the stated range includes one or both of the limits, ranges excluding either both of those included limits are also included in the disclosure.

The following terms are used to describe the present disclosure. Unless otherwise defined, all technical and scientific terms used herein have the same meaning as commonly understood by one of ordinary skill in the art to which this disclosure belongs. The terminology used in the description is for describing particular embodiments only and is not intended to be limiting of the disclosure.

The articles "a" and "an" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

As used herein in the specification and in the claims, the phrase "at least one," in reference to a list of one or more elements, should be understood to mean at least one element selected from anyone or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, in certain methods described herein that include more than one step or act, the order of the steps or acts of the method is not necessarily limited to the order in which the steps or acts of the method are recited unless the context indicates otherwise.

The present disclosure provides a soap thickener or complex soap thickener, and lubricants utilizing the same, such as greases, which have surprising and unexpected improvements in anti-corrosive activity, low metal staining, increased tackiness, extended high-temperature resistance, and increased dropping point.

Soap Thickener or Complex Soap Thickener

The present disclosure provides a soap thickener or complex soap thickener comprising a metal soap of a carboxylic acid composition in a base oil, wherein the carboxylic acid composition comprises a modified fatty acid composition prepared by performing a pericyclic reaction between an unsaturated small molecule and a fatty acid mixture (e.g., a fatty acid mixture that can undergo pericyclic reaction). The present disclosure further provides a soap thickener or complex soap thickener produced by preparing a soap or complex soap of a carboxylic acid composition in a base oil, wherein the carboxylic acid composition comprises a modified fatty acid composition prepared by performing a pericyclic reaction between an unsaturated small molecule and a fatty acid mixture (e.g., a fatty acid mixture that can undergo pericyclic reaction). The present disclosure also provides a soap thickener or complex soap thickener produced according to the method described in the present disclosure.

In any aspect or embodiment described herein, the base oil is present in an amount of about 70.0 wt. % to about 95.0 wt. % of the soap thickener or complex soap thickener. For example, in any aspect or embodiment described herein, the base oil is present in an amount of about 70.0 wt. % to about 95.0 wt. %, about 70.0 wt. % to about 90.0 wt. %, about 70.0 wt. % to about 85.0 wt. %, about 70.0 wt. % to about 80.0 wt. %, about 70.0 wt. % to about 75.0 wt. %, about 75.0 wt. % to about 95.0 wt. %, about 75.0 wt. % to about 90.0 wt. %, about 75.0 wt. % to about 85.0 wt. %, about 75.0 wt. % to about 80.0 wt. %, about 80.0 wt. % to about 95.0 wt. %, about 80.0 wt. % to about 90.0 wt. %, about 80.0 wt. % to about 85.0 wt. %, about 85.0 wt. % to about 95.0 wt. %, about 85.0 wt. % to about 90.0 wt. %, or about 90.0 wt. % to about 95.0 wt. % of the soap thickener or complex soap thickener.

In any aspect or embodiment described herein, the carboxylic acid composition is present in an amount of about 5.0 wt. % to about 25.0 wt. % of the soap thickener or complex soap thickener. For example, in any aspect or embodiment described herein, the carboxylic acid composition is present in an amount of about 5.0 wt. % to about 25.0 wt. %, about 5.0 wt. % to about 20.0 wt. %, about 5.0 wt. % to about 15.0 wt. %, about 5.0 wt. % to about 10.0 wt. %, about 10.0 wt. % to about 25.0 wt. %, about 10.0 wt. % to about 20.0 wt. %, about 10.0 wt. % to about 15.0 wt. %, about 15.0 wt. % to about 25.0 wt. %, about 15.0 wt. % to about 20.0 wt. %, or about 20.0 wt. % to about 25.0 wt. % of the soap thickener or complex soap thickener.

The soap thickener or complex soap thickener of the present disclosure has a carbonaceous ring and aliphatic tail in the modified TOFA that is not present in the standard complexing acids, such as azelaic acid and/or sebacic acid. The modified fatty acid composition described herein, such as a modified TOFA composition, provides a combination of long chain fatty acids and shorter chain polyacids without the need for sourcing and mixing additional chemicals, and as described herein provide surprising and unexpected enhancements to the thickener relative to previous thickeners and lubrication compositions comprising the soap thickener or complex soap thickener of the present disclosure. Thus, the dibasic acids formed by the pericyclic reaction, such as Diels-Alder reaction, are present as a mixture with unreacted monobasic acids and can be used as is for the formation of soap thickener or complex soap thickeners or further blended prior to the formation of soap thickener or complex soap thickeners, as described herein.

In any aspect or embodiment described herein, wherein the unsaturated small molecule is at least one of acrylic acid, fumaric acid, and maleic anhydride. In any aspect or embodiment described herein, wherein the pericyclic reaction is a Diels-Alder reaction.

In any aspect or embodiment described herein, wherein the metal base is selected from: lithium hydroxide, calcium hydroxide, aluminum hydroxide, sodium hydroxide, potassium hydroxide, or a combination thereof.

In any aspect or embodiment described herein, wherein water is present in an amount less than or equal to about 10.0 wt. % of the soap thickener or complex soap thickener. For example, in any aspect or embodiment described herein, water is present in an amount of ≤about 10.0 wt. %, ≤about 9.0 wt. %, ≤about 8.0 wt. %, ≤about 7.0 wt. %, ≤about 6.0 wt. %, ≤about 5.0 wt. %, ≤about 4.0 wt. %, ≤about 3.0 wt. %, about 1.0 wt. % to about 10 wt. %, about 1.0 wt. % to about 9.0 wt. %, about 1.0 wt. % to about 8.0 wt. %, about 1.0 wt. % to about 7.0 wt. %, about 1.0 wt. % to about 6.0 wt. %, about 1.0 wt. % to about 5.0 wt. %, about 1.0 wt. % to about 4.0 wt. %, about 2.0 wt. % to about 10 wt. %, about 2.0 wt. % to about 9.0 wt. %, about 2.0 wt. % to about 8.0 wt. %, about 2.0 wt. % to about 7.0 wt. %, about 2.0 wt. % to about 6.0 wt. %, about 1.0 wt. % to about 5.0 wt. %, about 3.0 wt. % to about 10 wt. %, about 3.0 wt. % to about 9.0 wt. %, about 3.0 wt. % to about 8.0 wt. %, about 3.0 wt. % to about 7.0 wt. %, about 3.0 wt. % to about 6.0 wt. %, OR about 3.0 wt. % to about 5.0 wt. %.

In any aspect or embodiment described herein, the soap thickener or complex soap thickener of the present disclosure has increased soap concentrations relative to a thickener (e.g., similar formulations except for the use of a different thickener) comprising: (i) a simple thickener having a metal soap of fatty acids (such as TOFA, TOR, DTO, or 12-hydroxystearic acid), or (ii) a soap thickener or complex soap thickener having a metal soap of fatty acids (such as 12-hydroxystearic acid) complexed with dibasic acids (such as azelaic acid and/or sebacic acid).

In any aspect or embodiment described herein, wherein the base oil in the lubricating composition is a Group I base oil, a Group II base oil, a Group III base oil, a Group IV base oil, a Group V base oil, or a combination thereof.

Carboxylic Acid Composition

The kraft pulping process is utilized to convert wood into wood pulp, wherein crude tall oil (CTO) is produced as a byproduct. Crude tall oil can be upgraded through distillation to produce rosin-rich distilates and distilled tall oil. Distillation streams produce tall oil pitch (TOP), tall oil rosin (TOR), head streams (light ends), tall oil fatty acids (TOFA), and distilled tall oil (DTO). The principle composition and yields of tall oil fractions and some empirical volatility data is provided in Table 1, and exemplary data and composition of some tall oil fatty acids are provided in Table 2.

TABLE 1

Composition and Yields of Tall Oil Fractions and Empirical Volatility Data

| | Yield (%) | Acid Number | Composition (%) Rosin Acids | Fatty Acids | Neutrals |
|---|---|---|---|---|---|
| Head, light ends | 5-12 | 70-120 | <0.5 | 30-50 | 40-60 |
| Tall Oil Fatty Acids | 35-45 | 192-197 | <2 | 95-98 | 1-2 |
| Distilled Tall Oil | 5-15 | 180-190 | 20-30 | 65-70 | 4-7 |
| Tall Oil Rosin | 20-35 | 165-182 | 85-96 | 1-5 | 1-7 |
| Tall Oil Pitch | 20-40 | 20-50 | 5-13 | 5-10 | 40-60 |

TABLE 2

Exemplary Data and Composition of Tall Oil Fatty Acids

| | Scandinavia | United States |
|---|---|---|
| Acid Number | 195 | 197 |
| Rosin Acid (%) | 2 | 1 |
| Unsaponifiables (%) | 2 | 1.5 |
| Iodine Value | 150 | 130 |
| Color, Garner | 4 | 3 |
| Fatty Acids (%) | | |
| Saturated | 2 | 2 |
| Oleic (18:1) | 30 | 48 |
| Linoleic (18:2) | 44 | 37 |
| Linolenic (18:3) | 10 | 3 |
| Conjugated (18:2) | 6 | 6 |
| Other | 4 | 2.5 |

TOFA is further broken down into Type I (minimum of 98% fatty acids and a maximum of 1% rosin acids), Type II (minimum of 96% fatty acids and a maximum of 2% rosin acids), and Type III (minimum of 90% fatty acids and a maximum of 10% rosin acids), as shown in Table 3, depending upon acid value, rosin acids concentration, unsaponifiables concentration, fatty acids concentration, Gardner color, and iodine value.

TABLE 3

Tall Oil Fatty Acids Requirements

| | Method | Type I Min | Type I Max | Type II Min | Type II Max | Type III Min | Type III Max |
|---|---|---|---|---|---|---|---|
| Acid Value | ASTM D1980 | 197 | — | 192 | — | 190 | — |
| Rosin Acids (%) | ASTM D1240 | — | 1.0 | — | 2.0 | — | 10.0 |
| Unsaponifiables (%) | ASTM D1965 | — | 1.0 | — | 2.0 | — | 10.0 |
| Fatty Acids (%) | ASTM D1983 | 98 | — | 96 | — | 90 | — |
| Color, Gardner | ASTM D1544 | — | 4 | — | 5 | — | 10.0 |
| Iodine Value | ASTM D1959 | 125 | 135 | — | — | — | — |

The standard methods recited in Table 3 can be utilized to determine the acid number, rosin acid concentration (%), unsaponifiables concentration (%), fatty acids concentration (%), Gardner color, and iodine value of fatty acid compositions.

The fatty acid composition of sixteen exemplary vegetable oils, determined by gas chromatography, is show in table 4 below.

TABLE 4

Exemplary Data and Composition of Sixteen Exemplary Vegetable Oils[1]

| FAs [%] | SAF | GRP | SIL | HMP | SFL | WHG | PMS | SES | RB | ALM | RPS | PNT | OL | COC | TA | CO |
|---|---|---|---|---|---|---|---|---|---|---|---|---|---|---|---|---|
| C6:0 | ND | ND | ND | ND | ND | ND | ND | ND | ND | ND | ND | ND | ND | 0.52 | ND | ND |
| C8:0 | ND | 0.01 | ND | ND | ND | ND | ND | ND | ND | ND | ND | ND | ND | 7.6 | ND | ND |
| C10:0 | ND | ND | ND | ND | ND | ND | ND | ND | ND | ND | 0.01 | ND | ND | 5.5 | ND | ND |
| C12:0 | ND | 0.01 | 0.01 | ND | 0.02 | 0.07 | ND | ND | ND | 0.09 | ND | ND | ND | 47.7 | 0 | 0 |
| C14:0 | 0.10 | 0.05 | 0.09 | 0.07 | 0.09 | ND | 0.17 | ND | 0.39 | 0.07 | ND | 0.04 | ND | 19.9 | 4 | 1 |
| C15:0 | ND | 0.01 | 0.02 | ND | ND | 0.04 | ND | ND | ND | ND | 0.02 | ND | ND | ND | ND | ND |
| C16:0 | 6.7 | 6.6 | 7.9 | 6.4 | 6.2 | 17.4 | 13.1 | 9.7 | 20.0 | 6.8 | 4.6 | 7.5 | 16.5 | ND | 28 | 3 |
| C17:0 | 0.04 | 0.06 | 0.06 | 0.05 | 0.02 | 0.03 | 0.13 | ND | ND | 0.05 | 0.04 | 0.07 | ND | ND | ND | ND |
| C18:0 | 2.4 | 3.5 | 4.5 | 2.6 | 2.8 | 0.7 | 5.7 | 6.5 | 2.1 | 2.3 | 1.7 | 2.1 | 2.3 | 2.7 | 23 | 2 |
| C20:0 | ND | 0.16 | 2.6 | ND | 0.21 | ND | 0.47 | 0.63 | ND | 0.09 | ND | 1.01 | 0.43 | ND | ND | ND |
| C22:0 | ND | ND | ND | ND | ND | ND | ND | 0.14 | ND | ND | ND | ND | 0.15 | ND | ND | ND |
| C16:1 (n-7) | 0.08 | 0.08 | 0.05 | 0.11 | 0.12 | 0.21 | 0.12 | 0.11 | 0.19 | 0.53 | 0.21 | 0.07 | 1.8 | ND | ND | ND |
| C17:1 (n-7) | ND | ND | 0.03 | ND | ND | ND | ND | ND | ND | ND | ND | ND | ND | ND | ND | ND |
| C18:1 (n-9) | ND | ND | ND | ND | ND | ND | ND | ND | ND | ND | ND | ND | ND | ND | 35 | 58 |
| C18:1cis (n-9) | 11.5 | 14.3 | 20.4 | 11.5 | 28.0 | 12.7 | 24.9 | 41.5 | 42.7 | 67.2 | 63.3 | 71.1 | 66.4 | 6.2 | ND | ND |
| C18:1trans (n-9) | ND | ND | ND | ND | ND | ND | ND | ND | ND | ND | 0.14 | ND | ND | ND | ND | ND |
| C20:1 (n-9) | ND | 0.40 | 0.15 | 16.5 | 0.18 | 7.91 | 1.08 | 0.32 | 1.11 | 0.16 | 9.1 | ND | 0.30 | ND | ND | ND |
| C18:2cis (n-6) | 79.0 | 74.7 | 63.3 | 59.4 | 62.2 | 59.7 | 54.2 | 40.9 | 33.1 | 22.8 | 19.6 | 18.2 | 16.4 | 1.6 | 2 | 9 |
| C18:3 | ND | ND | ND | ND | ND | ND | ND | ND | ND | ND | ND | ND | ND | ND | 1 | 23 |
| C18:3 (n-3) | 0.15 | 0.15 | 0.88 | 0.36 | 0.16 | 1.2 | 0.12 | 0.21 | 0.45 | ND | 1.2 | ND | 1.6 | ND | ND | ND |
| C18:3 (n-6) | ND | ND | ND | 3.0 | ND | ND | ND | ND | ND | ND | ND | ND | ND | ND | ND | ND |
| SFAs | 9.3 | 10.4 | 15.1 | 9.2 | 9.4 | 18.2 | 19.6 | 16.9 | 22.5 | 9.3 | 6.3 | 10.7 | 19.4 | 92.1 | ND | ND |
| MUFAs | 11.6 | 14.8 | 20.7 | 28.1 | 28.3 | 20.9 | 26.1 | 42.0 | 44.0 | 67.9 | 72.8 | 71.1 | 68.2 | 6.2 | ND | ND |
| PUFAs | 79.1 | 74.9 | 64.2 | 62.8 | 62.4 | 61.0 | 54.3 | 41.2 | 33.6 | 22.8 | 20.9 | 18.2 | 18.0 | 1.6 | ND | ND |
| n-3 PUFAs | 0.2 | 0.2 | 0.9 | 0.4 | 0.2 | 1.2 | 0.1 | 0.2 | 0.5 | 0.0 | 1.2 | 0.0 | 1.6 | 0.0 | ND | ND |
| n-6 PUFAs | 79.0 | 74.7 | 63.3 | 62.4 | 62.2 | 59.7 | 54.2 | 40.9 | 33.1 | 22.8 | 19.6 | 18.2 | 16.4 | 1.6 | ND | ND |

[1]Data are expressed as percentages of total fatty acid methyl esters (FAMEs);

ND means that FAs was not determined.

Abbreviations of the samples mean: SFA—saturated fatty acids, MUFA—monounsaturated fatty acids, PUFA—polyunsaturated fatty acids, SAF—safflower oil, GRP—grapeseed oil, SIL—silybum marianum (thistle oil), HMP—hemp oil, SFL—sunflower oil, WHG—wheat germ oil, PMS—pumpkin seed oil, SES—sesame oil, RB—rice bran oil, ALM—almond oil, RPS—rapeseed oil, PNT—peanut oil, OL—olive oil, COC—coconut oil, TA—tallow oil, and CA—canola oil.

In any aspect or embodiment described herein, the carboxylic acid composition comprises, consists essentially of, or consists of a modified fatty acid composition. In any aspect or embodiment described herein, the carboxylic acid composition comprises, consists essentially of, or consists of a blend of a modified fatty acid composition and fatty acids (also referred to herein as "blending fatty acids"). Thus, in any aspect or embodiment described herein, the modified fatty acid composition may be blended with blending fatty acids (e.g., up to about 50.0 wt. % of the carboxylic acid composition or about 30.0 wt. % to about 40.0 wt. % of the carboxylic acid composition) prior to preparing a soap or complex soap of the carboxylic composition. For example, in any aspect or embodiment described herein, the fatty acids blended with the modified fatty acid composition is ≤about 50.0 wt. %, ≤about 45.0 wt. %, ≤about 40.0 wt. %, ≤about 35.0 wt. %, ≤about 30.0 wt. %, ≤about 25.0 wt. %, ≤about 20.0 wt. %, ≤about 15.0 wt. %, ≤about 10.0 wt. %, ≤about 5.0 wt. %, about 5.0 wt. % to about 50.0 wt. %, about 5.0 wt. % to about 45.0 wt. %, about 5.0 wt. % to about 40.0 wt. %, about 5.0 wt. % to about 35.0 wt. %, about 5.0 wt. % to about 30.0 wt. %, about 5.0 wt. % to about 25.0 wt. %, about 5.0 wt. % to about 20.0 wt. %, about 5.0 wt. % to about 15.0 wt. %, about 10.0 wt. % to about 50.0 wt. %, about 10.0 wt. % to about 45.0 wt. %, about 10.0 wt. % to about 40.0 wt. %, about 10.0 wt. % to about 35.0 wt. %, about 10.0 wt. % to about 30.0 wt. %, about 10.0 wt. % to about 25.0 wt. %, about 10.0 wt. % to about 20.0 wt. %, about 15.0 wt. % to about 50.0 wt. %, about 15.0 wt. % to about 45.0 wt. %, about 15.0 wt. % to about 40.0 wt. %, about 15.0 wt. % to about 35.0 wt. %, about 15.0 wt. % to about 30.0 wt. %, about 15.0 wt. % to about 25.0 wt. %, about 20.0 wt. % to about 50.0 wt. %, about 20.0 wt. % to about 45.0 wt. %, about 20.0 wt. % to about 40.0 wt. %, about 20.0 wt. % to about 35.0 wt. %, about 20.0 wt. % to about 30.0 wt. %, about 25.0 wt. % to about 50.0 wt. %, about 25.0 wt. % to about 45.0 wt. %, about 25.0 wt. % to about 40.0 wt. %, about 25.0 wt. % to about 35.0 wt. %, about 30.0 wt. % to about 50.0 wt. %, about 30.0 wt. % to about 45.0 wt. %, about 30.0 wt. % to about 40.0 wt. %, about 35.0 wt. % to about 50.0 wt. %, about 35.0 wt. % to about 45.0 wt. %, or about 40.0 wt. % to about 50.0 wt. %.

In any aspect or embodiment described herein, the blending fatty acids are one or more saturated fatty acid, such as palmitic acid, stearic acid, arachidic acid, and/or behenic acid. In any aspect or embodiment described herein, the fatty acids are one or more hydroxy fatty acid, such as 9-hydroxystearic acid, 10-hydroxystearic acid, and/or 12-hydroxystearic acid. In any aspect or embodiment described herein, the fatty acids are one or more branched fatty acids, such as iso-palmitic acid, iso-stearic acid, iso-arachidic acid, iso-behenic acid, 10-methyl-iso-palmitic acid, and/or 14-methyl-hexadecanoic acid.

In any aspect or embodiment described herein, the ratio of modified fatty acid composition to blending fatty acids is from about 95:5 to about 20:80 (such as about 85:15 to about 40:60 or about 75:25 to about 50:50). For example, in any aspect or embodiment described herein the ration of TOFA to fatty acids in the blend is from about 95:5 to about 20:80, about 95:5 to about 30:70, about 95:5 to about 40:60, about 95:5 to about 50:50, about 95:5 to about 60:40, about 90:10 to about 20:80, about 90:10 to about 30:70, about 90:10 to about 40:60, about 90:10 to about 50:50, about 90:10 to about 60:40, about 80:20 to about 20:80, about 80:20 to about 30:70, about 80:20 to about 40:60, about 80:20 to about 50:50, about 80:20 to about 60:40, about 70:30 to about 20:80, about 70:30 to about 30:70, about 70:30 to about 40:60, about 70:30 to about 50:50, about 70:30 to about 60:40, about 60:40 to about 20:80, about 60:40 to about 30:70, about 60:40 to about 40:60, about 60:40 to about 50:50, about 50:50 to about 20:80, about 50:50 to about 30:70, about 50:50 to about 40:60, about 40:60 to about 20:80, about 40:60 to about 30:70, or about 30:70 to about 20:80.

In any aspect or embodiment described herein, the soap thickener or complex soap thickener comprises about 25.0% to about 75.0% polybasic acids, such as about 40.0% to about 60.0% polybasic acids. For example, in any aspect or embodiment described herein, the soap thickener or complex soap thickener comprises about 25.0% to about 75.0%, about 25.0% to about 65.0%, about 25.0% to about 55.0%, about 25.0% to about 45.0%, about 25.0% to about 35.0%, about 35.0% to about 75.0%, about 35.0% to about 65.0%, about 35.0% to about 55.0%, about 35.0% to about 45.0%, about 45.0% to about 75.0%, about 45.0% to about 65.0%, about 45.0% to about 55.0%, about 55.0% to about 75.0%, about 55.0% to about 65.0%, about 65.0% to about 75.0% polybasic acids. By way of further example, in any aspect or embodiment described herein, the soap thickener or complex soap thickener comprises about 40% to about 60%, about 40% to about 55%, about 40% to about 50%, about 40% to about 45%, about 45% to about 60%, about 45% to about 55%, about 45% to about 50%, about 50% to about 60%, about 50% to about 55%, about 55% to about 60% polybasic acids. In any aspect or embodiment described herein, the balance of the soap thickener or complex soap thickener comprises unreacted fatty acids and reaction byproducts other than polybasic acids.

In any aspect or embodiment described herein, the fatty acid mixture is a mixture of $C_{12-20}$ fatty acids.

In any aspect or embodiment described herein, the fatty acid mixture is a mixture of $C_{12-20}$ fatty acids that can undergo pericyclic reaction.

In any aspect or embodiment described herein, the fatty acid mixture is a vegetable oil.

In any aspect or embodiment described herein, the vegetable oil is selected from safflower oil, grapeseed oil, sunflower oil, walnut oil, soybean oil, cottonseed oil, coconut oil, corn oil, olive oil, palm oil, palm olein/kernel oil, peanut oil, rapeseed oil, canola oil, sesame oil, hazelnut oil, almond oil, beech nut oil, cashew oil, macadamia oil, mongongo nut oil, pecan oil, pine nut oil, pistachio oil, grapefruit seed oil, lemon oil, orange oil, watermelon seed oil, bitter gourd oil, buffalo gourd oil, butternut squash seed oil, egusi seed oil, pumpkin seed oil, borage seed oil, blackcurrant seed oil, evening primrose oil, acai oil, black seed oil, flaxseed oil, carob pod oil, amaranth oil, apricot oil, apple seed oil, argan oil, avocado oil, babassu oil, ben oil, borneo tallow nut oil, cape chestnut, algaroba oil, cocoa butter, cocklebur oil, poppyseed oil, cohune oil, coriander seed oil, date seed oil, dika oil, false flax oil, hemp oil, kapok seed oil, kenaf seed oil, lallemantia oil, mafura oil, manila oil, meadowfoam seed oil, mustard oil, okra seed oil, papaya seed oil, perilla seed oil, persimmon seed oil, pequi oil, pili nut oil, pomegranate seed oil, prune kernel oil, quinoa oil, ramtil oil, rice bran oil, royle oil, shea nut oil, sacha inchi oil, sapote oil, seje oil, taramira oil, tea seed oil, thistle oil, tigernut oil, tobacco seed oil, tomato seed oil, wheat germ oil, castor oil, colza oil, flax oil, radish oil, salicornia oil, tung oil, honge oil, jatropha oil, jojoba oil, nahor oil, paradise oil, petroleum nut oil, dammar oil, linseed oil, stillingia oil, vernonia oil, amur cork tree fruit oil, artichoke oil, balanos oil, bladderpod oil, brucea javanica oil, burdock oil, candlenut oil, carrot seed oil, chaulmoogra oil, crambe oil, croton oil, cuphea oil, honesty oil, mango oil, neem oil, oojon oil, rose hip seed oil, rubber seed oil, sea buckthorn oil, sea rocket seed oil, snowball seed oil, tall oil, tamanu oil, tonka bean oil, ucuhuba seed oil, or any mixture thereof.

In any aspect or embodiment described herein, the fatty acid mixture is TOFA.

In any aspect or embodiment described herein, the modified fatty acid composition is a modified TOFA composition.

In any aspect or embodiment described herein, the modified TOFA composition includes, consisting essentially of, or is selected from: maleated TOFA, fumarated TOFA, acylated TOFA, or a combination thereof.

In any aspect or embodiment described herein, the modified TOFA composition comprises, consisting essentially of, or is selected from one or more of DIACID® 1525, AltaVeg DIACID® 1525 (CAS #53980-88-4), DIACID 1550® (CAS #53980-88-4), TENAX® 2010 (CAS #68139-89-9), TENAX® 2010 Feed (CAS #68139-89-9), C21 diacid (CAS #53980-88-4), and a combination thereof.

In any aspect or embodiment described herein, the modified TOFA composition comprises, consisting essentially of, or is DIACID® 1525. DIACID® 1525 is 5(or 6)-carboxy-4-hexylcyclohex-2-ene-1-octanoic acid (CAS Number 53980-88-4) that is commercially available from Ingevity Corporation (North Charleston, South Carolina, USA). DIACID® 1525 has an acid number from 231 to 235 (which can be determined by ASTM D465-92), and a Gardner color of no greater than 7.

In any aspect or embodiment described herein, the modified TOFA composition comprises, consisting essentially of, or is AltaVeg DIACID® 1525. AltaVeg DIACID® 1525 is. 5(or 6)-carboxy-4-hexylcyclohex-2-ene-1-octanoic acid (CAS Number 53980-88-4) that is commercially available from Ingevity Corporation (North Charleston, South Carolina, USA). AltaVeg DIACID® 1525 has an acid number from 240 to 250 (which can be determined by ASTM D465-92), and a Gardner color of no greater than 7.

In any aspect or embodiment described herein, the modified TOFA composition comprises, consisting essentially of, or is DIACID® 1550. DIACID® 1550 is 5(or 6)-carboxy-4-hexylcyclohex-2-ene-1-octanoic acid (CAS Number 53980-88-4) that is commercially available from Ingevity Corporation (North Charleston, South Carolina, USA). DIACID® 1550 has an acid number from 265 to 277 (which can be determined by ASTM D465-92), and a Gardner color of no greater than 9.

In any aspect or embodiment described herein, the modified TOFA composition comprises, consisting essentially of, or is TENAX® 2010n. TENAX® 2010 is a maleated tall oil fatty acid composition (CAS Number 68139-89-9) that is commercially available from Ingevity Corporation (North Charleston, South Carolina, USA). TENAX 2010 has an acid number from 250 to 280 (which can be determined by ASTM D465-92), a monomer percent of less than 5% as determined by OCM-021.01, a hydrous acid number of 310-330, and a saponification number of −360.

In any aspect or embodiment described herein, the modified TOFA composition comprises, consisting essentially of, or is TENAX® 2010 FEED. TENAX® 2010 FEED is maleated tall oil fatty acid composition (CAS Number 68139-89-9) that is commercially available from Ingevity Corporation (North Charleston, South Carolina, USA).

In any aspect or embodiment described herein, the soap thickener or complex soap thickener does not include additional complexing raw acids, such as azelaic acid and/or sebacic acid.

Base Oil of the Soap Thickener or Complex Soap Thickener and Lubricating Composition In any aspect or embodiment described herein, the base oil in the soap thickener or complex soap thickener is a Group I base oil or a Group II base oil.

In any aspect or embodiment described herein, the base oil is a Group I base oil.

In any aspect or embodiment described herein, the base oil is a Group II base oil.

In any aspect or embodiment described herein, the base oil is a Group III base oil.

In any aspect or embodiment described herein, the base oil is a Group IV base oil.

In any aspect or embodiment described herein, the base oil if a Group V base oil.

A wide range of lubricating base oils is known in the art. Lubricating base oils that may be useful in the present disclosure are both natural oils, and synthetic oils, and unconventional oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad base oil stock categories developed and defined by the American Petroleum Institute (API Publication 1509; www.API.org to create guidelines for lubricant base oils. Group I base stocks have a viscosity index of from 80 to 120 and contain greater than 0.03% sulfur and/or less than 90% saturates. Group II base stocks have a viscosity index of from 80 to 120, and contain less than or equal to 0.03% sulfur and greater than or equal to 90% saturates. Group III stocks have a viscosity index greater than 120 and contain less than or equal to 0.03% sulfur and greater than 90% saturates. Group IV includes polyalphaolefins (PAO). Group V base stock includes base stocks not included in Groups I-IV. Table 5 below summarizes properties of each of these five groups.

TABLE 5

Characteristics of Group I, II, III, IV, and V Base Oils

| | Saturates | | Sulfur | | Viscosity Index |
|---|---|---|---|---|---|
| Group I | <90 | and/or | >0.03% | and | ≥80 and <120 |
| Group II | ≥90 | and | ≤0.03% | and | ≥80 and <120 |
| Group III | ≥90 | and | ≤0.03% | and | ≥120 |
| Group IV | ---- polyalphaolefins (PAO) ---- | | | | |
| Group V | ---- all other base stocks not of Groups I-IV ---- | | | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful. Natural oils vary also as to the method used for their production and purification, for example, their distillation range and whether they are straight run or cracked, hydrorefined, or solvent extracted.

Group II and/or Group III hydroprocessed or hydrocracked base stocks, including synthetic oils such as polyalphaolefins, alkyl aromatics and synthetic esters are also well known base stock oils.

Synthetic oils include hydrocarbon oil. Hydrocarbon oils include oils such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks are commonly used synthetic hydrocarbon oil. By way of example, PAOs derived from $C_6$, $C_8$, $C_{10}$, $C_{12}$, $C_{14}$ olefins or mixtures thereof may be utilized. See U.S. Pat. Nos. 4,956,122; 4,827,064; and 4,827,073.

The number average molecular weights of the PAOs, which are known materials and generally available on a major commercial scale from suppliers such as ExxonMobil Chemical Company, Chevron Phillips Chemical Company, BP, and others, typically vary from 250 to 3,000, although PAO's may be made in viscosities up to 100 cSt (100° C.). The PAOs are typically comprised of relatively low molecular weight hydrogenated polymers or oligomers of alphaolefins which include, but are not limited to, $C_2$ to $C_{32}$ alphaolefins with the $C_8$ to $C_{16}$ alphaolefins, such as 1-hexene, 1-octene, 1-decene, 1-dodecene and the like, being preferred. The preferred polyalphaolefins are poly-1-hexene, poly-1-octene, poly-1-decene and poly-1-dodecene and mixtures thereof and mixed olefin-derived polyolefins. However, the dimers of higher olefins in the range of $C_{14}$ to $C_{18}$ may be used to provide low viscosity base stocks of acceptably low volatility. Depending on the viscosity grade and the starting polymer (e.g., oligomer), the PAOs may be predominantly trimers and tetramers of the starting olefins, with minor amounts of the higher polymers, having a viscosity range of 1.5 to 12 cSt. PAO fluids of particular use may include 3.0 cSt, 3.4 cSt, and/or 3.6 cSt and combinations thereof. Bi-modal mixtures of PAO fluids having a viscosity range of 1.5 to about 100 cSt or to about 300 cSt may be used if desired.

The PAO fluids may be conveniently made by the polymerization of an alphaolefin in the presence of a polymerization catalyst such as the Friedel-Crafts catalysts including, for example, aluminum trichloride, boron trifluoride or complexes of boron trifluoride with water, alcohols such as ethanol, propanol or butanol, carboxylic acids or esters such as ethyl acetate or ethyl propionate. For example the methods disclosed by U.S. Pat. No. 4,149,178 or 3,382,291 may be conveniently used herein. Other descriptions of PAO synthesis are found in the following U.S. Pat. Nos. 3,742,082; 3,769,363; 3,876,720; 4,239,930; 4,367,352; 4,413,156; 4,434,408; 4,910,355; 4,956,122; and 5,068,487. The dimers of the $C_{14}$ to $C_{18}$ olefins are described in U.S. Pat. No. 4,218,330.

Other useful lubricant oil base stocks include wax isomerate base stocks and base oils, comprising hydroisomerized waxy stocks (e.g. waxy stocks such as gas oils, slack waxes, fuels hydrocracker bottoms, etc.), hydroisomerized Fischer-Tropsch waxes, Gas-to-Liquids (GTL) base stocks and base oils, and other wax isomerate hydroisomerized base stocks and base oils, or mixtures thereof. Fischer-Tropsch waxes, the high boiling point residues of Fischer-Tropsch synthesis, are highly paraffinic hydrocarbons with very low sulfur content. The hydroprocessing used for the production of such base stocks may use an amorphous hydrocracking/hydroisomerization catalyst, such as one of the specialized lube hydrocracking (LHDC) catalysts or a crystalline hydrocracking/hydroisomerization catalyst, preferably a zeolitic catalyst. For example, one useful catalyst is ZSM-48 as described in U.S. Pat. No. 5,075,269, the disclosure of which is incorporated herein by reference in its entirety. Processes for making hydrocracked/hydroisomerized distillates and hydrocracked/hydroisomerized waxes are described, for example, in U.S. Pat. Nos. 2,817,693; 4,975,177; 4,921,594 and 4,897,178 as well as in British Patent Nos. 1,429,494; 1,350,257; 1,440,230 and 1,390,359. Each of the aforementioned patents is incorporated herein in their entirety. Particularly favorable processes are described in European Patent Application Nos. 464546 and 464547, also incorporated herein by reference. Processes using Fischer-Tropsch wax feeds are described in U.S. Pat. Nos. 4,594,172 and 4,943,672, the disclosures of which are incorporated herein by reference in their entirety.

Gas-to-Liquids (GTL) base oils, Fischer-Tropsch wax derived base oils, and other wax-derived hydroisomerized (wax isomerate) base oils be advantageously used in the instant disclosure, and may have useful kinematic viscosities at 100° C. of 3 cSt to 50 cSt, preferably 3 cSt to 30 cSt, more preferably 3.5 cSt to 25 cSt, as exemplified by GTL 4 with kinematic viscosity of 4.0 cSt at 100° C. and a viscosity index of 141. These Gas-to-Liquids (GTL) base oils, Fischer-Tropsch wax derived base oils, and other wax-derived hydroisomerized base oils may have useful pour points of −20° C. or lower, and under some conditions may have advantageous pour points of −25° C. or lower, with useful pour points of −30° C. to −40° C. or lower. Useful compositions of Gas-to-Liquids (GTL) base oils, Fischer-Tropsch wax derived base oils, and wax-derived hydroisomerized base oils are recited in U.S. Pat. Nos. 6,080,301; 6,090,989, and 6,165,949 for example, and are incorporated herein in their entirety by reference.

The hydrocarbyl aromatics can be used as base oil or base oil component and can be any hydrocarbyl molecule that contains at least 5% of its weight derived from an aromatic moiety such as a benzenoid moiety or naphthenoid moiety, or their derivatives. These hydrocarbyl aromatics include alkyl benzenes, alkyl naphthalenes, alkyl diphenyl oxides, alkyl naphthols, alkyl diphenyl sulfides, alkylated bis-phenol A, alkylated thiodiphenol, and the like. The aromatic can be mono-alkylated, dialkylated, polyalkylated, and the like. The aromatic can be mono- or poly-functionalized. The hydrocarbyl groups can also be comprised of mixtures of alkyl groups, alkenyl groups, alkynyl, cycloalkyl groups, cycloalkenyl groups and other related hydrocarbyl groups. The hydrocarbyl groups can range from $C_6$ up to $C_{60}$ with a range of $C_8$ to $C_{20}$ often being preferred. A mixture of hydrocarbyl groups is often preferred, and up to three such substituents may be present.

The hydrocarbyl group can optionally contain sulfur, oxygen, and/or nitrogen containing substituents. The aromatic group can also be derived from natural (petroleum) sources, provided at least 5% of the molecule is comprised of an above-type aromatic moiety. Viscosities at 100° C. of about 3 cSt to about 50 cSt are preferred, with viscosities of about 3.4 cSt to about 20 cSt often being more preferred for the hydrocarbyl aromatic component. In one embodiment, an alkyl naphthalene where the alkyl group is primarily comprised of 1-hexadecene is used. Other alkylates of aromatics can be advantageously used. Naphthalene or methyl naphthalene, for example, can be alkylated with olefins such as octene, decene, dodecene, tetradecene or higher, mixtures of similar olefins, and the like. Useful concentrations of hydrocarbyl aromatic in a lubricant oil composition can be 2% to 25%, preferably 4% to 20%, and more preferably 4% to 15%, depending on the application.

Alkylated aromatics such as the hydrocarbyl aromatics of the present disclosure may be produced by well-known Friedel-Crafts alkylation of aromatic compounds. See Friedel-Crafts and Related Reactions, Olah, G. A. (ed.), Interscience Publishers, New York, 1963. For example, an aromatic compound, such as benzene or naphthalene, is alkylated by an olefin, alkyl halide or alcohol in the presence of a Friedel-Crafts catalyst. See Friedel-Crafts and Related Reactions, Vol. 2, part 1, chapters 14, 17, and 18, See Olah, G. A. (ed.), Inter-science Publishers, New York, 1964. Many homogeneous or heterogeneous, solid catalysts are known to one skilled in the art. The choice of catalyst depends on the reactivity of the starting materials and product quality requirements. For example, strong acids such as $AlCl_3$, $BF_3$, or HF may be used. In some cases, milder catalysts such as $FeCl_3$ or $SnCl_4$ are preferred. Newer alkylation technology uses zeolites or solid super acids.

Esters comprise a useful base stock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters may be those which are obtained by reacting one or more polyhydric alcohols, preferably the hindered polyols (such as the neopentyl polyols, e.g., neopentyl glycol, trimethylol ethane, 2-methyl-2-propyl-1,3-propanediol, trimethylol propane, pentaerythritol and dipentaerythritol) with alkanoic acids containing at least 4 carbon atoms, preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid, or mixtures of any of these materials.

Suitable synthetic ester components include the esters of trimethylol propane, trimethylol butane, trimethylol ethane, pentaerythritol and/or dipentaerythritol with one or more monocarboxylic acids containing from 5 to 10 carbon atoms. These esters are widely available commercially, for example, the Mobil P-41 and P-51 esters of ExxonMobil Chemical Company.

Also useful are esters derived from renewable material such as coconut, palm, rapeseed, soy, sunflower and the like. These esters may be monoesters, di-esters, polyol esters, complex esters, or mixtures thereof. These esters are widely available commercially, for example, the Mobil P-51 ester of ExxonMobil Chemical Company.

Other useful fluids of lubricating viscosity include non-conventional or unconventional base stocks that have been processed, preferably catalytically, or synthesized to provide high performance lubrication characteristics.

Non-conventional or unconventional base stocks/base oils include one or more of a mixture of base stock(s) derived from one or more Gas-to-Liquids (GTL) materials, as well as isomerate/isodewaxate base stock(s) derived from natural wax or waxy feeds, mineral and or non-mineral oil waxy feed stocks such as slack waxes, natural waxes, and waxy stocks such as gas oils, waxy fuels hydrocracker bottoms, waxy raffinate, hydrocrackate, thermal crackates, or other mineral, mineral oil, or even non-petroleum oil derived waxy materials such as waxy materials received from coal liquefaction or shale oil, and mixtures of such base stocks.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized cat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from 2 $mm^2/s$ to 50 $mm^2/s$ (ASTM D445). They are further characterized typically as having pour points of −5° C. to −40° C. or lower (ASTM D97). They are also characterized typically as having viscosity indices of 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

Base oils for use in the formulated lubricating greases useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

The lubricating base oil or base stock constitutes the major component of the grease composition of the present disclosure. One particularly preferred lubricating oil base stock for the inventive grease and the inventive method for improving high temperature bearing performance is a Group I base stock that is included in the formulated oil at from 75 to 95 wt %, or from 80 to 90 wt %, or from 82 to 88 wt %. Another particularly preferred lubricating oil base stock for the inventive lubricating engine oil and the inventive method for improving fuel efficiency, frictional properties and deposit control is a combination of a Group III, Group IV and Group V base stock wherein the combination is included in the formulated oil at from 75 to 95 wt %, or from 80 to 90 wt %, or from 82 to 88 wt %. In this form, the Group III base stock is included at from 30 to 35 wt % or from 32 to 33 wt %, the Group IV base stock at from 45 to 55 wt % or from 48 to 52 wt %, and the Group V base stock at from 0 to 5 wt %, or from 2 to 4 wt %.

Preferred Group III base stocks are GTL and Yubase Plus (hydroprocessed base stock). Preferred Group V base stocks include alkylated naphthalene, synthetic esters and combinations thereof.

Lubricating oils and base stocks are disclosed for example In US. Pub. Nos. 20170211007, 20150344805 and 2015322367.

Method of Preparing Soap Thickener or Complex Soap Thickener

The present disclosure also provides methods of preparing the soap thickener or complex soap thickener, wherein the method comprises preparing a soap or complex soap of a carboxylic acid composition in a base oil to produce the soap thickener or complex soap thickener, wherein the carboxylic acid composition comprises a modified fatty acid composition prepared by performing a pericyclic reaction between an unsaturated small molecule and a fatty acid mixture (e.g., a fatty acid mixture that can undergo pericyclic reaction).

In any aspect or embodiment described herein, preparing the soap or complex soap includes combining the base oil (e.g., about 70.0 wt. % to about 95.0 wt. % of the soap thickener or complex soap thickener; additional ranges are provided throughout the present disclosure) and the carboxylic acid composition (e.g., about 5.0 wt. % to about 25.0 wt. % of the soap thickener or complex soap thickener; additional ranges are provided throughout the present disclosure) to produce a base oil, carboxylic acid mixture composition in the base oil. For example, in any aspect or embodiment described herein, the base oil is present in an amount of about 70.0 wt. % to about 95.0 wt. %, about 70.0 wt. % to about 90.0 wt. %, about 70.0 wt. % to about 85.0 wt. %, about 70.0 wt. % to about 80.0 wt. %, about 70.0 wt. % to about 75.0 wt. %, about 75.0 wt. % to about 95.0 wt. %, about 75.0 wt. % to about 90.0 wt. %, about 75.0 wt. % to about 85.0 wt. %, about 75.0 wt. % to about 80.0 wt. %, about 80.0 wt. % to about 95.0 wt. %, about 80.0 wt. % to about 90.0 wt. %, about 80.0 wt. % to about 85.0 wt. %, about 85.0 wt. % to about 95.0 wt. %, about 85.0 wt. % to about 90.0 wt. %, or about 90.0 wt. % to about 95.0 wt. % of the soap thickener or complex soap thickener. By way of further example, in any aspect or embodiment described herein, the carboxylic acid composition is present in an amount of about 5.0 wt. % to about 25.0 wt. %, about 5.0 wt. % to about 20.0 wt. %, about 5.0 wt. % to about 15.0 wt. %, about 5.0 wt. % to about 10.0 wt. %, about 10.0 wt. % to about 25.0 wt. %, about 10.0 wt. % to about 20.0 wt. %, about 10.0 wt. % to about 15.0 wt. %, about 15.0 wt. % to about 25.0 wt. %, about 15.0 wt. % to about 20.0 wt. %, or about 20.0 wt. % to about 25.0 wt. % of the soap thickener or complex soap thickener.

In any aspect or embodiment described herein, preparing the soap or complex soap includes dissolving the acid components of the carboxylic acid composition in the base oil. In any aspect or embodiment described herein, dissolving the acid components in the base oil includes heating the base oil, carboxylic acid mixture. For example, in any aspect or embodiment described herein, dissolving the acid components in the base oil includes heating the base oil, carboxylic acid mixture to about 65.0° C. to about 95.0° C., such as about 65.0° C. to about 95.0° C., about 65.0° C. to about 85.0° C., about 65.0° C. to about 75.0° C., about 75.0° C. to about 95.0° C., about 75.0° C. to about 85.0° C., or about 85.0° C. to about 95.0° C.

Furthermore, in any aspect or embodiment described herein, dissolving the acid components in the base oil includes heating the base oil, carboxylic acid mixture for about 20 minutes to 40 minutes. For example, in any aspect or embodiment described herein, dissolving the acid components is performed for about 20 minutes to about 40 minutes, about 20 minutes to about 35 minutes, about 20 minutes to about 30 minutes, about 25 minutes to about 40 minutes, about 25 minutes to about 35 minutes, or about 30 minutes to about 40 minutes, In any aspect or embodiment described herein, preparing the soap or complex soap includes adding a slurry of excess metal base (e.g., about 2.5 wt. % to about 6.0 wt. % of the soap thickener or complex soap thickener) in water to the base oil, carboxylic acid mixture to produce a slurry mixture. For example, in any aspect or embodiment described herein, the slurry of excess metal base is added in an amount of about 2.5 wt. % to about 6.0 wt. %, about 2.5 wt. % to about 5.5 wt. %, about 2.5 wt. % to about 5.0 wt. %, about 2.5 wt. % to about 4.5 wt. %, about 2.5 wt. % to about 4.0 wt. %, about 2.5 wt. % to about 3.5 wt. %, about 3.0 wt. % to about 6.0 wt. %, about 3.0 wt. % to about 5.5 wt. %, about 3.0 wt. % to about 5.0 wt. %, about 3.0 wt. % to about 4.5 wt. %, about 3.5 wt. % to about 4.0 wt. %, about 3.5 wt. % to about 6.0 wt. %, about 3.5 wt. % to about 5.5 wt. %, about 3.5 wt. % to about 5.0 wt. %, about 3.5 wt. % to about 4.5 wt. %, about 4.0 wt. % to about 6.0 wt. %, about 4.0 wt. % to about 5.5 wt. %, about 4.0 wt. % to about 5.0 wt. %, about 4.5 wt. % to about 6.0 wt. %, about 4.5 wt. % to about 5.5 wt. %, about 5.0 wt. % to about 6.0 wt. % of the soap thickener or complex soap thickener.

In any aspect or embodiment described herein, the excess metal base is a slurry of up to about 10.0% excess metal base or about 1.0% to about 10.0% excess metal base (e.g., ≤about 10.0%, ≤about 9.0%, ≤about 8.0%, ≤about 7.0%, ≤about 6.0%, ≤about 5.0%, ≤about 4.0%, <about 3.0%, ≤about 2.0%, ≤about 1.0%, about 1.0% to about 10.0%, about 1.0% to about 9.0%, about 1.0% to about 8.0%, about 1.0% to about 7%, about 1.0%, to about 6.0% about 1.0% to about 5.0%, about 1.0% to about 4.0%, about 2.0% to about 10.0%, about 2.0% to about 9.0%, about 2.0% to about 8.0%, about 2.0% to about 7%, about 2.0%, to about 6.0% about 2.0% to about 5.0%, about 3.0% to about 10.0%, about 3.0% to about 9.0%, about 3.0% to about 8.0%, about 3.0% to about 7%, about 3.0%, to about 6.0%, about 4.0% to about 10.0%, about 4.0% to about 9.0%, about 4.0% to about 8.0%, about 5.0% to about 10.0%, about 5.0% to about 9.0%, about 6.0% to about 10.0% excess metal base).

In any aspect or embodiment described herein, preparing the soap or complex soap includes neutralizing the slurry mixture to form a soap solution. In any aspect or embodiment described herein, neutralizing the slurry mixture includes heating the slurry mixture to about 110.0° C. to about 130.0° C. (e.g., heating the slutty mixture to 115.0° C. to about 125.0° C.). For exemplar, in any aspect or embodiment described herein, neutralizing the slurry mixture includes heating the slurry mixture to about 110.0° C. to about 130.0° C., about 110.0° C. to about 125.0° C., about 110.0° C. to about 120.0° C., about 110.0° C. to about 115.0° C., about 115.0° C. to about 130.0° C., about 115.0° C. to about 125.0° C., about 115.0° C. to about 120.0° C., about 120.0° C. to about 130.0° C., about 120.0° C. to about 125.0° C., or about 125.0° C. to about 130.0° C.

In any aspect or embodiment described herein, neutralizing the slurry mixture includes heating the slurry mixture for about 45 minutes to about 90 minutes, such as about 50 minutes to about 75 minutes. For example, in any aspect or embodiment described herein, neutralizing the slurry mixture includes heating the slurry mixture for about 45 minutes to about 90 minutes, about 45 minutes to about 85 minutes, about 45 minutes to about 75 minutes, about 45 minutes to about 65 minutes, about 45 minutes to about 55 minutes, about 55 minutes to about 90 minutes, about 55 minutes to about 85 minutes, about 55 minutes to about 75 minutes, about minutes to about 65 minutes, about 65 minutes to about 90 minutes, about 65 minutes to about 85 minutes, about 65 minutes to about 75 minutes, about 75 minutes to about 90 minutes, or about 75 minutes to about 85 minutes.

In any aspect or embodiment described herein, prior to neutralizing the slurry mixture, the method further comprises heating the slurry mixture. For example, in any aspect or embodiment described herein, prior to neutralizing the slurry mixture, the method further comprises heating the slurry mixture to about 80.0° C. to about 95.0° C. (e.g., about 80.0° C. to about 90.0° C., about 80.0° C. to about 85.0° C., about 85.0° C. to about 95.0° C., about 85.0° C. to about 90.0° C., or about 90.0° C. to about 95.0° C.). By way of further example, in any aspect or embodiment described herein, prior to neutralizing the slurry mixture, the method further comprises heating the slurry mixture for at least 30 minutes, such as about 30 minutes to about 60 minutes. For example, in any aspect or embodiment described herein, prior to neutralizing the slurry mixture, the method further comprises heating the slurry mixture for about 30 minutes to about 60 minutes, about 30 minutes to about 50 minutes, about 30 minutes to about 40 minutes, about 40 minutes to about 60 minutes, about 40 minutes to about 50 minutes, or about 50 minutes to about 60 minutes.

In any aspect or embodiment described herein, preparing the soap or complex soap includes dehydrating the soap solution to form the soap thickener or complex soap thickener. In any aspect or embodiment described herein, dehydrating the soap solution to form the soap thickener or complex soap thickener includes heating the soap solution. (n any aspect or embodiment described herein, dehydrating the soap solution to form the soap thickener or complex soap thickener includes heating the soap solution to about 190.0° C. to about 250.0° C. For example, in any aspect or embodiment described herein, dehydrating the soap solution to form the soap thickener or complex soap thickener includes heating the soap solution to about 190.0° C. to about 250.0° C., about 190.0° C. to about 240.0° C., about 190.0° C. to about 230.0° C., about 190.0° C. to about 220.0° C., about 190.0° C. to about 210.0° C., about 190.0° C. to about 200.0° C., about 200.0° C. to about 250.0° C., about 200.0° C. to about 240.0° C., about 200.0° C. to about 230.0° C., about 200.0° C. to about 220.0° C., about 200.0° C. to about 210.0° C., about 210.0° C. to about 250.0° C., about 210.0° C. to about 240.0° C., about 210.0° C. to about 230.0° C., about 210.0° C. to about 220.0° C., about 220.0° C. to about 250.0° C., about 220.0° C. to about 240.0° C., about 220.0° C. to about 230.0° C., about 230.0° C. to about 250.0° C., about 230.0° C. to about 240.0° C., or about 240.0° C. to about 250.0° C.

In any aspect or embodiment described herein, dehydrating the soap solution to form the soap thickener or complex soap thickener includes heating the soap solution for about 20 minutes to about 60 minutes. For example, in any aspect or embodiment described herein, dehydrating the soap solution to form the soap thickener or complex soap thickener includes heating the soap solution for about 20 minutes to about 60 minutes, about 20 minutes to about 50 minutes, about 20 minutes to about 40 minutes, about 20 minutes to about 30 minutes, about 30 minutes to about 60 minutes, about 30 minutes to about 50 minutes, about 30 minutes to about 40 minutes, about 40 minutes to about 60 minutes, about 40 minutes to about 50 minutes, or about 50 minutes to about 60 minutes.

Lubricating Compositions

A further aspect of the present disclosure provides a lubricating composition comprising: the soap thickener or complex soap thickener of the present disclosure; and a base oil (e.g., base oil present in an amount of about 70.0 wt. % to about 95.0 wt. % of the lubricating composition), the balance optionally including one or more additive or lubricant additive described herein. An additional aspect of the present disclosure provides a lubricating composition comprising: a base oil (e.g., base oil present in an amount of about 70.0 wt. % to about 95.0 wt. % of the lubricating composition) thickened to a grease consistency with the soap thickener or complex soap thickener of the present disclosure, the balance optionally including one or more additive or lubricant additive described herein. In yet a further aspect, the present disclosure provides a lubricating composition comprising: a base oil (e.g., base oil present in an amount of about 70.0 wt. % to about 95.0 wt. % of the lubricating composition), and the soap thickener or complex soap thickener of the present disclosure in an amount sufficient to thicken the base oil to the consistency of a grease, the balance optionally including one or more additive or lubricant additive described herein. For example, in any aspect or embodiment described herein, the lubricating composition comprises about 70.0 wt. % to about 95.0 wt. %, about 70.0 wt. % to about 90.0 wt. %, about 70.0 wt. % to about 85.0 wt. %, about 70.0 wt. % to about 80.0 wt. %, about 75.0 wt. % to about 95.0 wt. %, about 75.0 wt. % to about 90.0 wt. %, about 75.0 wt. % to about 85.0 wt. %, about 80.0 wt. % to about 95.0 wt. %, about 80.0 wt. % to about 90.0 wt. %, about 85.0 wt. % to about 95.0 wt. % base oil.

In any aspect or embodiment described herein, the soap thickener or complex soap thickener is present in an amount of about 5.0 wt. % to about 20.0 wt. % of the lubricating composition (e.g., about 8.0 wt. % to about 15.0 wt. % or about 12.0 wt. % to about 14.0 wt. % of the lubricating composition). For example, in any aspect or embodiment described herein, the soap thickener or complex soap thickener is present in an amount of about 5.0 wt. % to about 20.0 wt. % of the lubricating composition about 5.0 wt. % to about 20.0 wt. %, about 5.0 wt. % to about 15.0 wt. %, about 5.0 wt. % to about 10.0 wt. %, about 10.0 wt. % to about 20.0 wt. %, about 10.0 wt. % to about 15.0 wt. %, or about 15.0 wt. % to about 20.0 wt. % of the lubricating composition).

In any aspect or embodiment described herein, the lubricating composition of the present disclosure further comprising at least one additive or lubricant additive selected from the group consisting of: a friction modifier, an emulsifier, a surfactant, a co-thickener, a rheology modifier, a corrosion inhibitor, an antioxidant, a wear inhibitor, an extreme pressure agent, a tackiness agent, a viscosity modifier, a colorant, an odor control agent, a filler, and a combination thereof.

In any aspect or embodiment described herein, wherein the lubricating composition is a grease, a gear oil, a chain oil, a track oil grease, a centralized greasing system grease, a cable drawing lubricant, or a wire drawing lubricant.

In any aspect or embodiment described herein, wherein the base oil in the lubricating composition is a Group I base oil, a Group II base oil, a Group III base oil, a Group IV base oil, a Group V base oil, or a combination thereof.

In any aspect or embodiment described herein, the lubricating composition includes decreased amounts/levels of at least one of a co-thickener, a corrosion inhibitor, a tackiness agent, or a combination thereof, relative to lubricating compositions that utilizes a thickener comprising (i) a simple thickener having a metal soap of fatty acids (such as TOFA, TOR, DTO, or 12-hydroxystearic acid), or (ii) a soap thickener or complex soap thickener having a metal soap of fatty acids (such as 12-hydroxystearic acid) complexed with dibasic acids (such as azelaic acid, and/or sebacic acid) instead of the soap thickener or complex soap thickener of the present disclosure.

In any aspect or embodiment described herein, the lubricating composition has at least one of (1) decreased metal staining, (2) increased tackiness, (3) increased dropping point, (4) extended high temperature resistance, and (5) enhanced corrosion resistance relative to similarly formulated lubricating compositions with a thickener (comprising (i) a simple thickener having a metal soap of fatty acids (such as TOFA, TOR, DTO, or 12-hydroxystearic acid), or (ii) a soap thickener or complex soap thickener having a metal soap of fatty acids (such as 12-hydroxystearic acid) complexed with dibasic acids (such as azelaic acid, and/or sebacic acid) (e.g., similar lubricating composition formulation except for the use of one of the above thickeners instead of the soap thickener or complex soap thickener of the present disclosure).

Methods of Preparing Lubricating Compositions

A further aspect of the present disclosure provides a method of preparing a lubricating composition, such as a grease. The method comprising: providing a soap thickener or complex soap thickener of the present disclosure; heating the soap thickener or complex soap thickener; cooling the soap thickener or complex soap thickener; diluting the cooled soap thickener or complex soap thickener with a base oil; and milling the soap thickener or complex soap thickener. In any aspect or embodiment described herein, diluting the cooled soap thickener or complex soap thickener with a base oil includes adding a sufficient amount of base oil to obtain the desired National Lubricating Grease Institute (NLGI) grade of the lubricating composition.

In any aspect or embodiment described herein, heating the soap thickener or complex soap thickener includes heating the soap thickener or complex soap thickener to about 160.0° C. to about 200.0° C. For example, in any aspect or embodiment described herein, heating the soap thickener or complex soap thickener includes in heating to about 160.0° C. to about 200.0° C., about 160.0° C. to about 190.0° C., about 160.0° C. to about 180.0° C., about 160.0° C. to about 170.0° C., about 170.0° C. to about 200.0° C., about 170.0° C. to about 190.0° C., about 170.0° C. to about 180.0° C., about 180.0° C. to about 200.0° C., about 180.0° C. to about 190.0° C., or about 190.0° C. to about 200.0° C. In any aspect or embodiment described herein, heating the soap thickener or complex soap thickener includes heating the soap thickener or complex soap thickener for about 20 minutes to 60 minutes. For example, in any aspect or embodiment described herein, heating the soap thickener or complex soap thickener includes heating the soap thickener or complex soap thickener for about 20 minutes to 60 minutes, In any aspect or embodiment described herein, cooling the soap thickener or complex soap thickener includes cooling the soap thickener or complex soap thickener to a temperature below the flash point of the base oil (e.g. cooling to a temperature of about 160.0° C. to about 190.0° C. and/or for about 20 minutes to about 60 minutes). For example, in any aspect or embodiment described herein, cooling the soap thickener or complex soap thickener includes cooling the soap thickener or complex soap thickener to about 160.0° C. to about 190.0° C., about 160.0° C. to about 185.0° C., about 160.0° C. to about 180.0° C., about 160.0° C. to about 175.0° C., about 160.0° C. to about 170.0° C., about 165.0° C. to about 190.0° C., about 165.0°

C. to about 185.0° C., about 165.0° C. to about 180.0° C., about 165.0° C. to about 175.0° C., about 170.0° C. to about 190.0° C., about 170.0° C. to about 185.0° C., about 170.0° C. to about 180.0° C., about 175.0° C. to about 190.0° C., about 175.0° C. to about 185.0° C., or about 180.0° C. to about 190.0° C. Thus, in any aspect or embodiment described herein, the cooling the soap thickener or complex soap thickener includes cooling the soap thickener or complex soap thickener for about 20 minutes to about 60 minutes, about 20 minutes to about 50 minutes, about 20 minutes to about 40 minutes, about 20 minutes to about 30 minutes, about 30 minutes to about 60 minutes, about 30 minutes to about 50 minutes, about 30 minutes to about 40 minutes, about 40 minutes to about 60 minutes, about 40 minutes to about 50 minutes, or about 50 minutes to about 60 minutes.

In any aspect or embodiment described herein, cooling the soap thickener or complex soap thickener includes at least one of: (i) cooling the soap thickener or complex soap thickener slowly to about 100.0° C. to about 130.0° C. (e.g., about 100.0° C. to about 120.0° C., about 100.0° C. to about 110.0° C., about 110.0° C. to about 130.0° C., about 110.0° C. to about 120.0° C., or about 120.0° C. to about 130.0° C.), (ii) heating the soap thickener or complex soap thickener to about 160.0° C. to about 200.0° C. (see above for additional exemplary temperature ranges and exemplary heating time ranges), (iii) cooling the soap thickener or complex soap thickener to a temperature below the flash point of the base oil (e.g. about 160.0° C. to about 190.0° C. and/or for about 20 minutes to about 60 minutes) for diluting the cooled soap thickener or complex soap thickener with a base oil (see above for additional exemplary temperature ranges and exemplary cooling time ranges), or (iv) a combination thereof.

For example, in any aspect or embodiment described herein, cooling the soap thickener or complex soap thickener includes at least one of: (i) cooling the soap thickener or complex soap thickener slowly to about 100.0° C. to about 130.0° C. (see above for additional exemplary temperature ranges) and heating the soap thickener or complex soap thickener to about 160.0° C. to about 200.0° C. (see above for additional exemplary temperature ranges and exemplary heating time ranges); (ii) cooling the soap thickener or complex soap thickener to a temperature below the flash point of the base oil e.g. about 160.0° C. to about 190.0° C. and/or for about 20 minutes to about 60 minutes) for diluting the cooled soap thickener or complex soap thickener with a base oil (see above for additional exemplary temperature ranges and exemplary cooling time ranges); or (iii) a combination thereof.

In any aspect or embodiment described herein, milling the soap or complex soap includes milling the soap thickener or complex soap thickener at a temperature less than about 80.0° C. (e.g., at a temperature of about 25.0° C. to about 80.0° C. or at a temperature of about 45.0° C. to about 75.0° C.). For example, in any aspect or embodiment, milling the soap thickener or complex soap thickener is performed at about 25.0° C. to about 80.0° C., about 25.0° C. to about 70.0° C., about 25.0° C. to about 60.0° C., about 25.0° C. to about 50.0° C., about 25.0° C. to about 40.0° C., about 35.0° C. to about 80.0° C., about 35.0° C. to about 70.0° C., about 35.0° C. to about 60.0° C., about 35.0° C. to about 50.0° C., about 45.0° C. to about 80.0° C., about 45.0° C. to about 70.0° C., about 45.0° C. to about 60.0° C., about 55.0° C. to about 80.0° C., about 55.0° C. to about 70.0° C., or about 65.0° C. to about 80.0° C.

In any aspect or embodiment described herein, diluting the cooled soap thickener or complex soap thickener with a base oil includes adding base oil in an amount of up to 35.0 wt. % of the lubricating composition depending upon the desired NLGI grade. For example, depending upon the desired NLGI grade ≤about 35.0 wt. %, ≤about 30.0 wt. %, ≤about 25.0 wt. %, ≤about 20.0 wt. %, ≤about 15.0 wt. %, ≤about 10.0 wt. %, ≤about 5.0 wt. %, about 5.0 wt. % to about 35.0 wt. %, about 5.0 wt. % to about 30.0 wt. %, about 5.0 wt. % to about 25.0 wt. %, about 5.0 wt. % to about 20.0 wt. %, about 5.0 wt. % to about 15.0 wt. %, about 5.0 wt. % to about 05.0 wt. %, about 10.0 wt. % to about 35.0 wt. %, about 10.0 wt. % to about 30.0 wt. %, about 10.0 wt. % to about 25.0 wt. %, about 10.0 wt. % to about 20.0 wt. %, about 10.0 wt. % to about 15.0 wt. %, about 15.0 wt. % to about 35.0 wt. %, about 15.0 wt. % to about 30.0 wt. %, about 15.0 wt. % to about 25.0 wt. %, about 15.0 wt. % to about 20.0 wt. %, about 20.0 wt. % to about 35.0 wt. %, about 20.0 wt. % to about 30.0 wt. %, about 20.0 wt. % to about 25.0 wt. %, about 25.0 wt. % to about 35.0 wt. %, about 25.0 wt. % to about 30.0 wt. %, or about 30.0 wt. % to about 35.0 wt. %.

In any aspect or embodiment described herein, at least one of: (i) measuring cone penetration of the grease (e.g., via ASTM D217) to determine the NLGI grade; (ii) mixing in base oil to the grease to increase the cone penetration of the complex thickener soap; and (iii) a combination thereof.

In any aspect or embodiment described herein, the lubricating composition is at least one of a grease, a gear oil, a chain oil, a track oil grease, a centralized greasing system grease, a cable or wire drawing lubricant, and a combination thereof.

In any or embodiment described herein, the method further comprises mixing in at least one additive selected from the group consisting of: a friction modifier, an emulsifier, a surfactant, a co-thickener, a rheology modifier, a corrosion inhibitor, an antioxidant, a wear inhibitor, an extreme pressure agent, a tackiness agent, a viscosity modifier, a colorant, an odor control agent, a filler, and a combination thereof.

Co-Thickeners and Rheology Modifiers

Various types of materials can be incorporated into the thickener to modify or improve certain characteristics, such as structural stability, water resistance, oil release, low temperature mobility, high temperature stability, adhesiveness, cohesiveness, or even to reduce the total amount of thickener required to achieve a desired consistency. These materials are commonly known as co-thickeners or rheology modifiers, and may be incorporated into the thickener of the present disclosure as it is formed, added to the wet thickener of the present disclosure before or during the dehydration step, or added to the dehydrated thickener of the present disclosure before or during the incorporation of cut-back oil and additives. Often, the desired improvement in properties is most effective when the co-thickener or rheology modifier is incorporated during the soap-making step.

These materials may be fillers or powders, such as calcium carbonate, graphite, polytetrafluoroethylene (PTFE), rubbers (such as latex and EPDM), granulated elastomer materials, nylon, plasticizers and cellulosic derivatives. Petrolatum, petroleum, microcrystalline waxes and natural waxes can also be incorporated into the thickener. Variants on the type of molecule typically used as the fatty acid in the soap can also be used to improve structural stability and water resistance. An example of this is isostearic acid, which is commercially available from suppliers such as Kraton ("Century™" range of products).

More useful co-thickeners have been developed more recently, and are represented by polymers and co-polymers (including terpolymers, tetrapolymers, and so on) produced from natural sources (resins such as terpenes and terpenols), petrochemical intermediates and synthetic monomers. For example, polymers derived from ethylene, propylene, butylene and isobutylene may be useful to modify thickener properties, especially when the polymer properties are optimized by including a mixture of monomers to form random or block co-polymers. Such polymers may also be configured as linear, branched, or star structures. Examples of such products are commercially available from many suppliers, including Kraton ("Sylvarez™" range of products), Infineum ("SV™" product range), Functional Products Inc. ("V™" product range) and ExxonMobil Chemical Corp ("Vistamaxx™" product line).

More complex polymers can give further improvements, particularly for cohesiveness, water resistance and oil bleed reduction. For example, co-polymers formed from vinyl monomers and dienes can possess a wide range of properties and can be formed from monomers such as isoprene, styrene, butadiene, cyclopentadiene, and longer chain unsaturated hydrocarbons. Interaction with the thickener can be enhanced by the inclusion of other elements (such as nitrogen and oxygen) to introduce points of higher polarity where there is the possibility of hydrogen bonding with the thickener matrix. Unsaturated amines, amides, carboxylic acids, esters (such as alkylmethacrylates), ethers, oxidized ethylene, oxidized propylene and others have been used successfully and can be optimized towards the choice of thickener chemistry.

Polymer properties can also be optimized by the choice of catalyst and production method to control the tacticity of the polymer chain. Properties and interaction with the thickener can also be enhanced by the attachment of functional groups, such as maleic anhydride, to the end of the polymer chain, to form "reactive" polymers. Examples of these types of materials are available commercially from suppliers such as Lubrizol ("Lubrizol™ 2002", "Lubrizol™ 2006"), and a comprehensive disclosure of the different types of polymer, their composition and manufacturing processes can be found in U.S. Pat. Nos. 6,300,288; 8,563,488; and 8,969,266; and in U.S. Pat. Publication No. 2005/0209114.

Thermoplastic resins, thixotropic gels and caulks can also be incorporated into the grease thickener to modify structural stability, water resistance, oil release, rust prevention and anti-wear and extreme pressure performance of the final composition. These types of components are usually based on co-polymers of diamines and alkyl mono- and di-carboxylic acids. By selecting the appropriate combination of monomers, the characteristics of the polymer can be optimized to maximize the desired improvement in thickener and finished grease properties. Examples of these materials are commercially available from suppliers such as Kraton ("Uni-Rez™" range of products) and Elementis ("Thixatrol™" range of products). A more thorough discussion of their composition and properties can be found in U.S. Pat. No. 6,448,366, and an example of their use in greases can be found in U.S. Pat. Publication No. 2013/0130953.

Usually, all of the co-thickeners and rheology modifiers discussed above will be used at a fraction of the total thickener content, depending on the choice of material, its chemistry and structure, and the desired improvement in properties. For example, the longer chain polymers may give the best balance of properties when used at a maximum treat rate of less than about 3 mass %, preferably between about 0.1 mass % and about 2 mass %, and most preferably between about 0.25 mass % and about 1 mass %. The smaller molecules (such as the polyamides and isostearic acid) may be more effective at higher treat rates, such as less than about 6 mass %, preferably about 1 mass % to about 5 mass %, and most preferably about 2 mass % to about 4 mass %. The preferred ranges may need to be adjusted, depending on the total thickener content and the efficiency of the thickener formation, to maintain the optimum ratios.

Other Performance Additives

The composition of the present disclosure may include small amounts of at least one (e.g., 1, 2, 3, 4, 5, or 6, or more) other performance additive (also referred to as other grease additives). For example, the composition of the present disclosure may include at least one of anticorrosive agent or corrosion inhibitor, an extreme pressure additive, an antiwear agent, a pour point depressants, an antioxidant or oxidation inhibitor, a rust inhibitor, a metal deactivator, a dispersant, a demulsifier, a dye or colorant/chromophoric agent, a seal compatibility agent, a friction modifier, a viscosity modifier/improver, a viscosity index improver, or combinations thereof. For example, solid lubricants such as molybdenum disulfide and graphite may be present in the composition of the present disclosure, such as from about 1 to about 5 wt. % (e.g., from about 1.5 to about 3 wt. %) for molybdenum disulfide and from about 3 to about 15 wt. % (e.g., from about 6 to about 12 wt. %) for graphite.

The amounts of individual additives will vary according to the additive and the level of functionality to be provided by it.

The presence or absence of these lubricating oil performance additives (other grease additives) does not adversely affect the compositions of the present disclosure. For a review of many commonly used additives, see Klamann in Lubricants and Related Products, Verlag Chemie, Deerfield Beach, Fla.; ISBN 0 89573 177 0. Reference is also made to "Lubricant Additives" by M. W. Ranney, published by Noyes Data Corporation of Parkridge, N.J. (1973) and "Lubricant Additives: Chemistry and Applications" edited by L. R. Rudnick, published by CRC Press of Boca Raton, Fla. (2009). The performance additives (also referred to as other grease additives) useful in the present disclosure do not have to be soluble in the lubricating oils. Insoluble additives in oil can be dispersed in the lubricating oils of the present disclosure. The types and quantities of performance additives used in combination with the compositions of the present disclosure are not limited by the examples shown herein as illustrations.

As such, in any aspect or embodiment described herein, the composition further comprises at least one of anticorrosive agent or corrosion inhibitor, an extreme pressure additive, an antiwear agent, a pour point depressants, an antioxidant or oxidation inhibitor, a rust inhibitor, a metal deactivator, a dispersant, a demulsifier, a dye or colorant/chromophoric agent, a seal compatibility agent, a friction modifier, a viscosity modifier/improver, a viscosity index improver, or combinations thereof. In any aspect or embodiment described herein, the dispersant includes succinimide-type dispersant. Unless specified otherwise, the performance additive or performance additives (also referred to as other grease additives) listed above are present in a total amount equal to or less than about 10 wt. %, equal to or less than about 9.5 wt. %, equal to or less than about 9 wt. %, equal to or less than about 8.5 wt. %, equal to or less than about 8 wt. %, equal to or less than about 7.5 wt. %, equal to or less than about 7 wt. %, equal to or less than about 6.5 wt. %, equal to or less than about 6 wt. %, equal to or less than about 5.5 wt. %, equal to or less than about 5 wt. %, equal to or less than about 4.5 wt. %, equal to or less than about 4 wt. %, equal to or less than about 3.5 wt. %, equal to or less than about 3 wt. %, equal to or less than about 2.5 wt. %, equal to or less than about 2 wt. %, equal to or less than about 1.5 wt. %, or equal to or less than about 0.5 wt. %. For example, the performance additive or performance additives (other grease additives) are present in a total amount of about 0.1 to about 10 wt. %, about 0.1 to about 9 wt. %, about 0.1 to about 8 wt. %, about 0.1 to about 7 wt. %, about 0.1 to about 6 wt. %, about 0.1 to about 5 wt. %, about 0.1 to about 4 wt. %, about 0.1 to about 3 wt. %, about 0.1 to about 2 wt. %, about 0.1 to about 1 wt. %, about 0.5 to about 10 wt. %, about 0.5 to about 9 wt. %, about 0.5 to about 8 wt. %, about 0.5 to about 7 wt. %, about 0.5 to about 6 wt. %, about 0.5 to about 5 wt. %, about 0.5 to about 4 wt. %, about 0.5 to about 3 wt. %, about 0.5 to about 2 wt. %, about 1 to about 10 wt. %, about 1 to about 9 wt. %, about 1 to about 8 wt. %, about 1 to about 7 wt. %, about 1 to about 6 wt. %, about 1 to about 5 wt. %, about 1 to about 4 wt. %, about 1 to about 3 wt. %, about 2 to about 10 wt. %, about 2 to about 9 wt. %, about 2 to about 8 wt. %, about 2 to about 7 wt. %, about 2 to about 6 wt. %, about 2 to about 5 wt. %, about 2 to about 4 wt. %, about 3 to about 10 wt. %, about 3 to about 9 wt. %, about 3 to about 8 wt. %, about 3 to about 7 wt. %, about 3 to about 6 wt. %, about 3 to about 5 wt. %, about 4 to about 10 wt. %, about 4 to about 9 wt. %, about 4 to about 8 wt. %, about 4 to about 7 wt. %, about 4 to about 6 wt. %, about 5 to about 10 wt. %, about 5 to about 9 wt. %, about 5 to about 8 wt. %, about 5 to about 7 wt. %, about 6 to about 10 wt. %, about 6 to about 9 wt. %, about 6 to about 8 wt. %, about 7 to about 10 wt. %, about 7 to about 9 wt. %, or about 8 to about 10 wt. %.

When the additives are described below by reference to individual components used in the formulation, they will not necessarily be present or identifiable as discrete entities in the final product but may be present as reaction products which are formed during the grease manufacture or even its use. This will depend on the respective chemistries of the ingredients, their stoichiometry, and the temperatures encountered in the grease making process or during its use. It will also depend, naturally enough, on whether or not the species are added as a pre-reacted additive package. For example, the acid amine phosphates may be added as discrete amines and acid phosphates but these may react to form a new entity in the final grease composition under the processing conditions used in the grease manufacture.

Viscosity Improver(s) or Modifier(s). In any aspect or embodiment described herein, the composition of the present disclosure comprises at least one viscosity improver or modifier (e.g., 1, 2, 3, 4, 5, 6, or more viscosity improver or modifier). The viscosity improver, viscosity modifier, or Viscosity Index (VI) modifier increases the viscosity of the composition of the present disclosure at elevated temperatures, thereby increasing film thickness, and having limited effects on the viscosity of the composition of the present disclosure at low temperatures. In certain embodiments, the composition of the present disclosure comprises at least one viscosity improver (e.g., 1, 2, 3, 4, 5, 6, or more viscosity improver(s)). Any viscosity improver that is known or that becomes known in the art may be utilized in the composition of the present disclosure. Exemplary viscosity improvers include high molecular weight hydrocarbons, polyesters and viscosity index improver dispersants that function as both a viscosity index improver and a dispersant. The molecular weight of these polymers can range from about 1,000 to about 1,500,000 (e.g., about 20,000 to about 1,200,000 or about 50,000 to about 1,000,000). In a particular embodiment, the molecular weights of these polymers can range from about 1,000 to about 1,000,000 (e.g., about 1,200 to about 500,000 or about 1,200 to about 5,000).

In certain embodiments, the viscosity improver is at least one of linear or star-shaped polymers of methacrylate, linear or star-shaped copolymers of methacrylate, butadiene, olefins, alkylated styrenes, polyisobutylene, polymethacrylate (e.g., copolymers of various chain length alkyl methacrylates), copolymers of ethylene and propylene, hydrogenated block copolymers of styrene and isoprene, or combinations thereof. For example, the viscosity improver may include styrene-isoprene or styrene-butadiene based polymers of about 50,000 to about 200,000 molecular weight.

Olefin copolymers are commercially available from Chevron Oronite Company LLC under the trade designation "PARATONE®" (such as "PARATONE® 8921" and "PARATONE® 8941"); from Afton Chemical Corporation under the trade designation "HiTEC®" (such as "HiTEC® 5850B"); and from The Lubrizol Corporation under the trade designation "Lubrizol® 7067C". Hydrogenated polyisoprene star polymers are commercially available from Infineum International Limited, e.g., under the trade designation "SV200" and "SV600". Hydrogenated diene-styrene block copolymers are commercially available from Infineum International Limited, e.g., under the trade designation "SV 50".

The polymethacrylate or polyacrylate polymers can be linear polymers which are available from Evnoik Industries under the trade designation "Viscoplex®" (e.g., Viscoplex 6-954) or star polymers which are available from Lubrizol Corporation under the trade designation Asteric™ (e.g., Lubrizol 87708 and Lubrizol 87725).

Illustrative vinyl aromatic-containing polymers useful in the present disclosure may be derived predominantly from vinyl aromatic hydrocarbon monomer. Illustrative vinyl aromatic-containing copolymers useful in the present disclosure may be represented by the following formula:

A-B, wherein: A is a polymeric block derived predominantly from vinyl aromatic hydrocarbon monomer, and B is a polymeric block derived predominantly from conjugated diene monomer.

Although their presence is not required to obtain the benefit of the composition of the present disclosure, viscosity modifiers may be used in an amount of less than about 10 weight percent (e.g. less than about 7 weight percent or less than about 4 weight percent). In certain embodiments, the viscosity improver is present in an amount less than 2 weight percent, less than about 1 weight percent, or less than about 0.5 weight percent, based on the total weight of the composition of the present disclosure. Viscosity modifiers are generally added as concentrates, in large amounts of diluent oil.

As used herein, the viscosity modifier concentrations are given on an "as delivered" basis. The active polymer may be delivered with a diluent oil. The "as delivered" viscosity modifier may contain from about 20 weight percent to about 75 weight percent of an active polymer for polymethacrylate or polyacrylate polymers, or from about 8 weight percent to about 20 weight percent of an active polymer for olefin copolymers, hydrogenated polyisoprene star polymers, or hydrogenated diene-styrene block copolymers, in the "as delivered" polymer concentrate.

Antioxidant(s). In any aspect or embodiment described herein, the composition of the present disclosure comprises at least one antioxidant (e.g., 1, 2, 3, 4, 5, 6, or more antioxidant(s)). The antioxidant(s) may be added to retard the oxidative degradation of the composition in storage or during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cite, and U.S. Pat. Nos. 4,798,684 and 5,084,197, for example. Any antioxidant that is known or that becomes known in the art may be utilized in the composition of the present disclosure.

Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methylphenol [2,6-di(tert-butyl)-p-cresol, DBPC], and aromatic amines, e.g. N-phenyl-.alpha.-naphthylamine. These oxidation inhibitors are used in turbine, circulation, and hydraulic oils that are intended for extended service.

The antioxidant or antioxidants may be present in an amount equal to or less than about 6 wt. %, equal to or less than about 5.75 wt. %, equal to or less than about 5.5 wt. %, equal to or less than about 5.25 wt. %, equal to or less than about 5 wt. %, equal to or less than about 4.75 wt. %, equal to or less than about 4.5 wt. %, equal to or less than about 4.25 wt. %, equal to or less than about 4 wt. %, equal to or less than about 3.75 wt. %, equal to or less than about 3.5 wt. %, equal to or less than about 3.25 wt. %, equal to or less than about 3 wt. %, equal to or less than about 2.75 wt. %, equal to or less than about 2.5 wt. %, equal to or less than about 2.25 wt. %, equal to or less than about 2 wt. %, equal to or less than about 1.75 wt. %, equal to or less than about 1.5 wt. %, equal to or less than about 1.25 wt. %, equal to or less than about 1 wt. %, equal to or less than about 0.75 wt. %, equal to or less than about 0.50 wt. %, or equal to or less than about 0.25 wt. % on an as-received basis. For example, the antioxidant or antioxidants may be present in an amount of about 0.1 wt. % to about 6 wt. %, about 0.1 wt. % to about 5 wt. %, about 0.1 wt. % to about 4 wt. %, about 0.1 wt. % to about 3 wt. %, about 0.1 wt. % to about 2 wt. %, about 0.1 wt. % to about 1.5 wt. %, about 0.1 wt. % to about 1 wt. %, about 0.1 wt. % to about 0.75 wt. %, about 0.1 wt. % to about 0.5 wt. %, about 0.2 wt. % to about 6 wt. %, about 0.2 wt. % to about 5 wt. %, about 0.2 wt. % to about 4 wt. %, about 0.2 wt. % to about 3 wt. %, about 0.2 wt. % to about 2 wt. %, about 0.2 wt. % to about 1.5 wt. %, about 0.2 wt. % to about 1 wt. %, about 0.2 wt. % to about 0.75 wt. %, about 0.2 wt. % to about 0.5 wt. %, about 0.3 wt. % to about 6 wt. %, about 0.3 wt. % to about 5 wt. %, about 0.3 wt. % to about 4 wt. %, about 0.3 wt. % to about 3 wt. %, about 0.3 wt. % to about 2 wt. %, about 0.3 wt. % to about 1.5 wt. %, about 0.3 wt. % to about 1 wt. %, about 0.3 wt. % to about 0.75 wt. %, about 0.3 wt. % to about 0.5 wt. %, about 0.5 wt. % to about 6 wt. %, about 0.5 wt. % to about 5 wt. %, about 0.5 wt. % to about 4 wt. %, about 0.5 wt. % to about 3 wt. %, about 0.5 wt. % to about 2 wt. % about 0.5 wt. % to about 1.5 wt. %, about 0.5 wt. % to about 1 wt. %, about 0.5 wt. % to about 0.75 wt. %, about 0.5 wt. % to about 0.5 wt. %, about 1 wt. % to about 6 wt. %, about 1 wt. % to about 5 wt. %, about 1 wt. % to about 4 wt. %, about 1 wt. % to about 3 wt. %, about 2 wt. % to about 6 wt. %, about 2 wt. % to about 5 wt. %, about 2 wt. % to about 4 wt. %, about 3 wt. % to about 6 wt. %, about 3 wt. % to about 5 wt. %, about 4 wt. % to about 6 wt. %, or about 5 wt. % to about 6 wt. % on an as-received basis.

The below discussion of phenolic antioxidants is presented only by way of example, and is not limiting on the type of phenolic antioxidants that can be utilized in the composition of the present disclosure.

Useful antioxidants include hindered phenols. These phenolic antioxidants may be ashless (metal-free) phenolic compounds or neutral or basic metal salts of certain phenolic compounds. In an embodiment, the phenolic antioxidant compounds or compounds are hindered phenolics which are the ones which contain a sterically hindered hydroxyl group, such as those that are derivatives of dihydroxy aryl compounds in which the hydroxyl groups are in the o- or p-position to each other. In certain embodiments, the phenolic antioxidant or antioxidants are hindered phenols substituted with C6+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic propionic ester derivatives. Bis-phenolic antioxidants may also be advantageously used in combination with the composition of the present disclosure. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Further examples of phenol-based antioxidants include 2-t-butylphenol, 2-t-butyl-4-methylphenol, 2-t-butyl-5-methylphenol, 2,4-di-t-butylphenol, 2,4-dimethyl-6-t-butylphenol, 2-t-butyl-4-methoxyphenol, 3-t-butyl-4-methoxyphenol, 2,5-di-t-butylhydroquinone (manufactured by the Kawaguchi Kagaku Co. under trade designation "Antage DBH"), 2,6-di-t-butylphenol and 2,6-di-t-butyl-4-alkylphenols such as 2,6-di-t-butyl-4-methylphenol and 2,6-di-t-butyl-4-ethylphenol; 2,6-di-t-butyl-4-alkoxyphenols such as 2,6-di-t-butyl-4-methoxyphenol and 2,6-di-t-butyl-4-ethoxyphenol, 3,5-di-t-butyl-4-hydroxybenzylmercaptoocty-1 acetate, alkyl-3-(3,5-di-t-butyl-4-hydroxyphenyl) propionates such as n-octyl-3-(3,5-di-t-butyl-4-hydroxyphenyl)propionate (manufactured by the Yoshitomi Seiyaku Co. under the trade designation "Yonox SS"), n-dodecyl-3-(3,5-di-t-butyl-4-hydroxyphenyl)propionate and 2'-ethylhexyl-3-(3,5-di-t-butyl-4-hydroxyphenyl)propionate; 2,6-di-t-butyl-alpha-dimethylamino-p-cresol, 2,2'-methylenebis(4-alkyl-6-t-butylphenol) compounds such as 2,2'-methylenebis(4-methyl-6-t-butylphenol) (manufactured by the Kawaguchi Kagaku Co. under the trade designation "Antage W-400") and 2,2'-methylenebis(4-ethyl-6-t-butylphenol) (manufactured by the Kawaguchi Kagaku Co. under the trade designation "Antage W-500"); bisphenols such as 4,4'-butylidenebis(3-methyl-6-t-butyl-phenol) (manufactured by the Kawaguchi Kagaku Co. under the trade designation "Antage W-300"), and 4,4'-methylenebis (2,6-di-t-butylphenol) (manufactured by Laporte Performance Chemicals under the trade designation "Ionox 220AH").

Other examples of phenol-based antioxidants include 4,4'-bis(2,6-di-t-butylphenol), 2,2-(di-p-hydroxyphenyl) propane (Bisphenol A), 2,2-bis(3,5-di-t-butyl-4-hydroxyphenyl)propane, 4,4'-cyclohexylidenebis(2,6-di-t-butylphenol), hexamethylene glycol bis[3, (3,5-di-t-butyl-4-hydroxyphenyl)propionate] (manufactured by the Ciba Specialty Chemicals Co. under the trade designation "Irganox L109"), triethylene glycol bis[3-(3-t-butyl-4-hydroxy-5-methylphenyl)propionate] (manufactured by the Yoshitomi Seiyaku Co. under the trade designation "Tominox 917"), 2,2'-thio[diethyl-3-(3,5-di-t-butyl-4-hydroxyphenyl)propionate] (manufactured by the Ciba Specialty Chemicals Co. under the trade designation "Irganox L115"), 3,9-bis{1,1-dimethyl-2-[3-(3-t-butyl-4-hydroxy-5-methylphenyl)-propionylo-xy]ethyl}2,4,8,10-tetraoxaspiro[5,5] undecane (manufactured by the Sumitomo Kagaku Co. under the trade designation "Sumilizer GA80") and 4,4'-thiobis(3-methyl-6-t-butylphenol) (manufactured by the Kawaguchi Kagaku Co. under the trade designation "Antage RC"), 2,2'-thiobis(4,6-di-t-butylresorcinol); polyphenols, such as tetrakis[methylene-3-(3,5-di-t-butyl-4-hydroxyphenyl)propionato]methane (manufactured by the Ciba Specialty Chemicals Co. under the trade designation "Irganox L101"), 1,1,3-tris(2-methyl-4-hydroxy-5-t-butylpheny-1) butane (manufactured by the Yoshitomi Seiyaku Co. under the trade designation "Yoshinox 930"), 1,3,5-trimethyl-2,4,6-tris(3,5-di-t-butyl-4-hydroxybenzyl)benzene (manufactured by Ciba Specialty Chemicals under the trade designation "Irganox 330"), bis[3,3'-bis(4'-hydroxy-3'-t-butylpheny-1)butyric acid] glycol ester, 2-(3',5'-di-t-butyl-4-hydroxyphenyl)-methyl-4-(2",4"-di-t-butyl-3"-hydroxyphenyl)methyl-6-t-butylphenol and 2,6-bis(2'-hydroxy-3'-t-butyl-5'-methylbenzyl)-4-methylphenol; and phenol/aldehyde condensates, such as the condensates of p-t-butylphenol and formaldehyde and the condensates of p-t-butylphenol and acetaldehyde.

The phenolic antioxidant or phenolic type antioxidant include sulfurized and non-sulfurized phenolic antioxidants. Phenolic antioxidants include compounds having one or more than one hydroxyl group bound to an aromatic ring which may itself be mononuclear (e.g., benzyl) or polynuclear (e.g., naphthyl and spiro aromatic compounds). Thus, phenol type antioxidants include phenol per se, catechol, resorcinol, hydroquinone, naphthol, etc., as well as alkyl or alkenyl and sulfurized alkyl or alkenyl derivatives thereof, and bisphenol type compounds including such biphenol compounds linked by alkylene bridges sulfuric bridges or oxygen bridges. Alkyl phenols may include mono- and poly-alkyl or alkenyl phenols, the alkyl or alkenyl group containing from about 3 to about 100 carbons (e.g., about 4 to about 50 carbons) and sulfurized derivatives thereof. The number of alkyl or alkenyl groups present in the aromatic ring may range from 1 up to the available unsatisfied valences of the aromatic ring remaining after counting the number of hydroxyl groups bound to the aromatic ring.

For example, the phenolic antioxidant may be represented by the following formula:

$$(R)_x—Ar—(OH)_y,$$

wherein:

Ar is selected from the group consisting of:

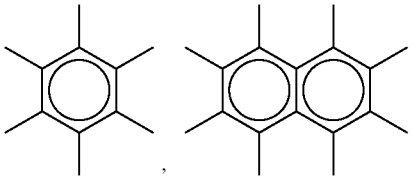

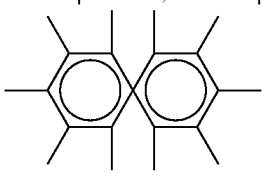

-continued

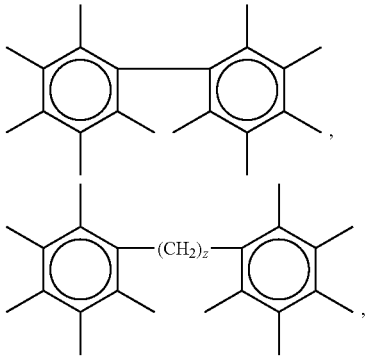

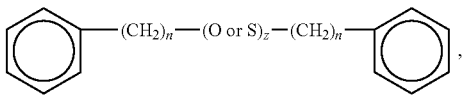

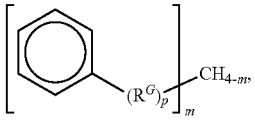

R is a $C_3$-$C_{100}$ alkyl or alkenyl group, a sulfur substituted alkyl or alkenyl group (e.g., a $C_4$-$C_{50}$ alkyl or alkenyl group or sulfur substituted alkyl or alkenyl group, a $C_3$-$C_{100}$ alkyl or sulfur substituted alkyl group, or a $C_4$-$C_{50}$ alkyl group);

$R^G$ is a $C_1$-$C_{100}$ alkylene or sulfur substituted alkylene group (e.g., a $C_2$-$C_{50}$ alkylene or sulfur substituted alkylene group or a $C_2$-$C_{25}$ alkylene or sulfur substituted alkylene group);

y is at least 1 to up to the available valences of Ar;

x ranges from 0 to up to the available valances of Ar-y;

z ranges from 1 to 10;

n ranges from 0 to 20; m is 0 to 4; and p is 0 or 1.

In any aspect or embodiment described herein, at least one of: R is $C_4$-$C_{50}$ alkyl group, $R^G$ is a $C_2$-$C_{20}$ alkylene or sulfur substituted alkylene group, y ranges from 1 to 3, x ranges from 0 to 3, z ranges from 1 to 4, n ranges from 0 to 5, p is 0, or a combination thereof.

In any aspect or embodiment described herein, the phenolic antioxidant include hindered phenolics and phenolic esters that contain a sterically hindered hydroxyl group. For example, the phenolic antioxidant can include derivatives of dihydroxy aryl compounds in which the hydroxyl groups are in the o- or p-position to each other. The phenolic antioxidant may include the hindered phenols substituted with $C_1$+ alkyl groups and the alkylene coupled derivatives of these hindered phenols, such as: 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; 2,6-di-t-butyl-4-alkoxy phenol; and/or

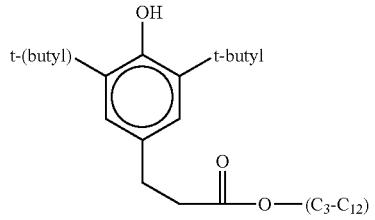

In any aspect or embodiment described herein, the phenolic type antioxidant is at least one of Ethanox® 4710, Irganox® 1076, Irganox® L1035, Irganox® 1010, Irganox® L109, Irganox® L118, Irganox® L135, or a combination thereof.

The phenolic antioxidant or antioxidants may be present in an amount of about 0.05 wt. % to about 3 wt. %, about 0.05 wt. % to about 2.5 wt. %, about 0.05 wt. % to about 2 wt. %, about 0.05 wt. % to about 1.5 wt. %, about 0.05 wt. % to about 1 wt. %, about 0.05 wt. % to about 0.75 wt. %, about 0.05 wt. % to about 0.5 wt. %, about 0.05 wt. % to about 0.3 wt. %, about 0.1 wt. % to about 3 wt. %, about 0.1 wt. % to about 2.5 wt. %, about 0.1 wt. % to about 2 wt. %, about 0.1 wt. % to about 1.5 wt. %, about 0.1 wt. % to about 1 wt. %, about 0.1 wt. % to about 0.75 wt. %, about 0.1 wt. % to about 0.5 wt. %, about 0.1 wt. % to about 0.3 wt. %, about 0.5 wt. % to about 3 wt. %, about 0.5 wt. % to about 2.5 wt. %, about 0.5 wt. % to about 2 wt. %, about 0.5 wt. % to about 1.5 wt. %, about 0.5 wt. % to about 1 wt. %, about 1 wt. % to about 3 wt. %, about 1 wt. % to about 2.5 wt. %, about 1 wt. % to about 2 wt. %, about 1 wt. % to about 1.75 wt. %, about 1 wt. % to about 1.5 wt. %, about 1.5 wt. % to about 3 wt. %, about 1.5 wt. % to about 2.5 wt. %, about 1.5 wt. % to about 2 wt. %, about 2 wt. % to about 3 wt. %, about 2 wt. % to about 2.5 wt. %, or about 2.5 wt. % to about 3 wt. %, on an as-received basis.

Effective amounts of one or more catalytic antioxidants may be used. The catalytic antioxidants comprise an effective amount of (a) one or more oil soluble polymetal organic compounds; and, effective amounts of (b) one or more substituted N,N'-diaryl-o-phenylenediamine compounds or (c) one or more hindered phenol compounds; or a combination of both (b) and (c). Catalytic antioxidants are more fully described in U.S. Pat. No. 8,048,833, which is incorporated herein by reference in its entirety.

Non-phenolic oxidation inhibitors that may be used in the composition of the present disclosure include aromatic amine antioxidants, which may be used either as such or in combination with phenolic antioxidants.

An exemplary aromatic amine antioxidant include alkylated and non-alkylated aromatic amines, such as aromatic monoamines of the formula $$R^1R^2R^3N,$$

wherein: $R^1$ is an aliphatic, aromatic or substituted aromatic group; $R^2$ is an aromatic or a substituted aromatic group; $R^3$ is H, alkyl, aryl or $R^4S(O)_xR^5$; $R^4$ is an alkylene, alkenylene, or aralkylene group; $R^5$ is a higher alkyl group, or an alkenyl, aryl, or alkaryl group; and x is 0, 1 or 2.

The aliphatic group $R^1$ may contain from 1 to about 20 carbon atoms (e.g. from about 6 to 12 carbon atoms). The aliphatic group may be a saturated aliphatic group. In certain embodiments, both $R^1$ and $R^2$ are aromatic or substituted aromatic groups, and the aromatic group may be a fused ring aromatic group such as naphthyl. Aromatic groups $R^1$ and $R^2$ may be joined together with other groups such as S.

The aminic antioxidant may be an aromatic amine antioxidant, such as an phenyl-α-naphthyl amine (e.g., Irganox® L06) which is described by the following chemical structure:

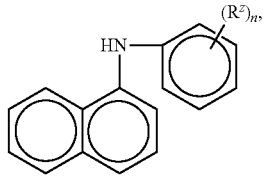

wherein: $R^Z$ is hydrogen or a $C_1$ to $C_{14}$ linear or $C_3$ to $C_{14}$ branched alkyl group; and n is an integer ranging from 1 to 5 (e.g. 1).

In certain embodiments, at least one of: $R^Z$ is $C_1$ to $C_{10}$ linear or $C_3$ to $C_{10}$ branched alkyl group; n is 1; or a combination thereof.

In another embodiment, $R^Z$ is a linear or branched $C_6$ to $C_8$.

In any aspect or embodiment described herein, the aromatic amine antioxidant can have at least 6 carbon atoms substituted with an alkyl groups. Examples of aliphatic groups include hexyl, heptyl, octyl, nonyl, and decyl. In an embodiments, the aliphatic groups will not contain more than about 14 carbon atoms. Additional amine antioxidants include diphenylamines, phenyl naphthylamines, phenothiazines, imidodibenzyls, and diphenyl phenylene diamines. In a particular embodiment, a mixture of two or more (e.g., 2, 3, 4, 5, or more) aromatic amine antioxidants are present in the composition of the present disclosure. Polymeric amine antioxidants can also be used. Particular examples of aromatic amine antioxidants useful in the composition of the present disclosure include: p,p'-dioctyldiphenylamine; t-octylphenyl-alpha-naphthylamine; phenyl-alphanaphthylamine; and p-octylphenyl-alpha-naphthylamine.

Further examples of amine-based antioxidants include dialkyldiphenylamines, such as p,p'-dioctyldiphenylamine (manufactured by the Seiko Kagaku Co. under the trade designation "Nonflex OD-3"), p,p'-di-alpha-methylbenzyldiphenylamine and N-p-butylphenyl-N-p'-octylphenylamine; monoalkyldiphenylamines, such as mono-t-butyldiphenylamine, and monooctyldiphenylamine; bis(dialkylphenyl) amines such as di(2,4-diethylphenyl)amine and di(2-ethyl-4-nonylphenyl)amine; alkylphenyl-1-naphthylamines, such as octylphenyl-1-naphthylamine and N-t-dodecylphenyl-1-naphthylamine; arylnaphthylamines, such as 1-naphthylamine, phenyl-1-naphthylamine, phenyl-2-naphthylamine, N-hexylphenyl-2-naphthylamine and N-octylphenyl-2-naphthylamine, phenylenediamines such as N,N'-diisopropyl-p-phenylenediamine and N,N'-diphenyl-p-phenylenediamine, and phenothiazines such as phenothiazine (manufactured by the Hodogaya Kagaku Co.: Phenothiazine) and 3,7-dioctylphenothiazine.

A sulfur-containing antioxidant may be any and every antioxidant containing sulfur, for example, including dialkyl thiodipropionates such as dilauryl thiodipropionate and distearyl thiodipropionate, dialkyldithiocarbamic acid derivatives (excluding metal salts), bis(3,5-di-t-butyl-4-hydroxybenzyl)sulfide, mercaptobenzothiazole, reaction products of phosphorus pentoxide and olefins, and dicetyl sulfide. For example, the sulfur-containing antioxidant is a dialkyl thiodipropionate, such as dilauryl thiodipropionate and distearyl thiodipropionate.

Additional examples of sulphur-based antioxidants include dialkylsulphides, such as didodecylsulphide and dioctadecylsulphide; thiodipropionic acid esters, such as didodecyl thiodipropionate, dioctadecyl thiodipropionate, dimyristyl thiodipropionate and dodecyloctadecyl thiodipropionate, and 2-mercaptobenzimidazole. In an embodiment, the antioxidant is a sulfurized alkyl phenols, or an alkali or alkaline earth metal salt thereof.

In any aspect or embodiment described herein, the composition of the present disclosure includes at least one aminic antioxidant (e.g., 1, 2, 3, 4, 5, or more) present in an amount equal to or less than about 6 wt. %, equal to or less than about 5.75 wt. %, equal to or less than about 5.5 wt. %, equal to or less than about 5.25 wt. %, equal to or less than about 5 wt. %, equal to or less than about 4.75 wt. %, equal to or less than about 4.5 wt. %, equal to or less than about 4.25 wt. %, equal to or less than about 4 wt. %, equal to or less than about 3.75 wt. %, equal to or less than about 3.5 wt. %, equal to or less than about 3.25 wt. %, equal to or less than about 3 wt. %, equal to or less than about 2.75 wt. %, equal to or less than about 2.5 wt. %, equal to or less than about 2.25 wt. %, equal to or less than about 2 wt. %, equal to or less than about 1.75 wt. %, equal to or less than about 1.5 wt. %, equal to or less than about 1.25 wt. %, equal to or less than about 1 wt. %, equal to or less than about 0.75 wt. %, equal to or less than about 0.50 wt. %, or equal to or less than about 0.25 wt. % on an as-received basis. For example, the aminic antioxidant or antioxidants may be present in an amount of about 0.1 wt. % to about 6 wt. %, about 0.1 wt. % to about 5 wt. %, about 0.1 wt. % to about 4 wt. %, about 0.1 wt. % to about 3 wt. %, about 0.1 wt. % to about 2 wt. %, about 0.1 wt. % to about 1.5 wt. %, about 0.1 wt. % to about 1 wt. %, about 0.1 wt. % to about 0.75 wt. %, about 0.1 wt. % to about 0.5 wt. %, about 0.2 wt. % to about 6 wt. %, about 0.2 wt. % to about 5 wt. %, about 0.2 wt. % to about 4 wt. %, about 0.2 wt. % to about 3 wt. %, about 0.2 wt. % to about 2 wt. %, about 0.2 wt. % to about 1.5 wt. %, about 0.2 wt. % to about 1 wt. %, about 0.2 wt. % to about 0.75 wt. %, about 0.2 wt. % to about 0.5 wt. %, about 0.3 wt. % to about 6 wt. %, about 0.3 wt. % to about 5 wt. %, about 0.3 wt. % to about 4 wt. %, about 0.3 wt. % to about 3 wt. %, about 0.3 wt. % to about 2 wt. %, about 0.3 wt. % to about 1.5 wt. %, about 0.3 wt. % to about 1 wt. %, about 0.3 wt. % to about 0.75 wt. %, about 0.3 wt. % to about 0.5 wt. %, about 0.5 wt. % to about 6 wt. %, about 0.5 wt. % to about 5 wt. %, about 0.5 wt. % to about 4 wt. %, about 0.5 wt. % to about 3 wt. %, about 0.5 wt. % to about 2 wt. %, about 0.5 wt. % to about 1.5 wt. %, about 0.5 wt. % to about 1 wt. %, about 0.5 wt. % to about 0.75 wt. %, about 0.5 wt. % to about 0.5 wt. %, about 1 wt. % to about 6 wt. %, about 1 wt. % to about 5 wt. %, about 1 wt. % to about 4 wt. %, about 1 wt. % to about 3 wt. %, about 2 wt. % to about 6 wt. %, about 2 wt. % to about 5 wt. %, about 2 wt. % to about 4 wt. %, about 3 wt. % to about 6 wt. %, about 3 wt. % to about 5 wt. %, about 4 wt. % to about 6 wt. %, or about 5 wt. % to about 6 wt. % on an as-received basis.

Other oxidation inhibitors that have proven useful in compositions of the present disclosure are chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)(phosphorodithioate, cadmium dinonylphosphorodithioate, and the reaction of phosphorus pentasulfide with an equimolar mixture of isopropyl alcohol, 4-methyl-2-pentanol, and n-hexyl alcohol.

Another class of antioxidants which may be used in the lubricating oil compositions disclosed herein are oil soluble copper compounds. Any oil soluble suitable copper compound may be blended into the composition of the present disclosure. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

In an embodiment, the antioxidant includes hindered phenols, arylamines, or a combination thereof. These antioxidants may be used individually by type or in combination with one another.

Pour Point Depressant(s). In any aspect or embodiment described herein, the composition of the present disclosure comprises at least one (e.g., 1, 2, 3, 4, 5, or 6, or more) pour point depressant or a lube oil flow improver. Pour point depressant may be added to lower the minimum temperature at which the fluid will flow or can be poured. Any pour point depressant or lube oil flow improved that is known or that becomes known in the art may be utilized in the composition of the present disclosure. In certain embodiments, the pour point depressant includes at least one (e.g., 1, 2, 3, or 4 or more) pour point depressant or lube oil flow improver, such as at least one of alkylated naphthalenes polymethacrylates (e.g., copolymers of various chain length alkyl methacrylates), polyacrylates, polyarylamides, condensation products of haloparaffin waxes and aromatic compounds, vinyl carboxylate polymers, terpolymers of dialkylfumarates, vinyl esters of fatty acids, allyl vinyl ethers, or combinations thereof. U.S. Pat. Nos. 1,815,022; 2,015,748; 2,191,498; 2,387,501; 2,655, 479; 2,666,746; 2,721,877; 2,721,878; and 3,250,715 describe useful pour point depressants and/or the preparation thereof. The pour point depressant or depressants may be present in an amount equal to or less than about 5 wt. %, for example about 0.01 to about 1.5 wt. %. For example, the pour point depressant or depressants may be present in an amount equal to or less than about 5 wt. %, equal to or less than about 4.75 wt. %, equal to or less than about 4.5 wt. %, equal to or less than about 4.25 wt. %, equal to or less than about 4 wt. %, equal to or less than about 3.75 wt. %, equal to or less than about 3.5 wt. %, equal to or less than about 3.25 wt. %, equal to or less than about 3 wt. %, equal to or less than about 2.75 wt. %, equal to or less than about 2.5 wt. %, equal to or less than about 2.25 wt. %, equal to or less than about 2 wt. %, equal to or less than about 1.75 wt. %, equal to or less than about 1.5 wt. %, equal to or less than about 1.25 wt. %, equal to or less than about 1 wt. %, equal to or less than about 0.75 wt. %, equal to or less than about 0.50 wt. %, or equal to or less than about 0.25 wt. % of the composition of the present disclosure. For example, the pour point depressant or depressants may be present in an amount of about 0.1 wt. % to about 5 wt. %, about 0.1 wt. % to about 4 wt. %, about 0.1 wt. % to about 3 wt. %, about 0.1 wt. % to about 2 wt. %, about 0.1 wt. % to about 1.5 wt. %, about 0.1 wt. % to about 1 wt. %, about 0.1 wt. % to about 0.75 wt. %, about 0.1 wt. % to about 0.5 wt. %, about 0.2 wt. % to about 5 wt. %, about 0.2 wt. % to about 4 wt. %, about 0.2 wt. % to about 3 wt. %, about 0.2 wt. % to about 2 wt. %, about 0.2 wt. % to about 1.5 wt. %, about 0.2 wt. % to about 1 wt. %, about 0.2 wt. % to about 0.75 wt. %, about 0.2 wt. % to about 0.5 wt. %, about 0.3 wt. % to about 5 wt. %, about 0.3 wt. % to about 4 wt. %, about 0.3 wt. % to about 3 wt. %, about 0.3 wt. % to about 2 wt. %, about 0.3 wt. % to about 1.5 wt. %, about 0.3 wt. % to about 1 wt. %, about 0.3 wt. % to about 0.75 wt. %, about 0.3 wt. % to about 0.5 wt. %, about 0.5 wt. % to about 5 wt. %, about 0.5 wt. % to about 4 wt. %, about 0.5 wt. % to about 3 wt. %, about 0.5 wt. % to about 2 wt. %, about 0.5 wt. % to about 1.5 wt. %, about 0.5 wt. % to about 1 wt. %, about 0.5 wt. % to about 0.75 wt. %, about 0.5 wt. % to about 0.5 wt. %, about 1 wt. % to about 5 wt. %, about 1 wt. % to about 4 wt. %, about 1 wt. % to about 3 wt. %, about 2 wt. % to about 5 wt. %, about 2 wt. % to about 4 wt. %, or about 3 wt. % to about 5 wt. % of the composition of the present disclosure.

Seal Compatibility Agent(s). In any aspect or embodiment described herein, the composition comprises of the present disclosure at least one (e.g., 1, 2, 3, 4, or more) seal compatibility agent. The seal compatibility agent(s) may be added to help swell elastomeric seals by causing a chemical reaction in the fluid or physical change in the elastomer. Any seal compatibility agent that is known or that becomes know may be utilized in the composition of the present disclosure. For example, the seal compatibility agent or agents may include at least one of organic phosphates, aromatic esters, aromatic hydrocarbons, esters (e.g. butylbenzyl phthalate), polybutenyl succinic anhydride, or sulfolane-type seal swell agents (e.g. Lubrizol 730-type seal swell additives), or combinations thereof. Although their presence is not required to obtain the benefit of the present disclosure, seal compatibility additives may be present in an amount of zero to about 3 weight percent (e.g., about 0.01 to about 2 weight percent) of the composition of the present disclosure.

Demulsifier(s). In any aspect or embodiment described herein, the composition of the present disclosure comprises at least one (e.g., 1, 2, 3, or 4, or more) demulsifier. The demulsifier may be added to separate emulsions (e.g., water-in-oil). Any demulsifier that is known or that becomes know may be utilized in the composition of the present disclosure. An illustrative demulsifying component is described in EP-A-330,522. This exemplary demulsifying agent is obtained by reacting an alkylene oxide with an adduct obtained by reaction of a bis-epoxide with a polyhydric alcohol. Demulsifiers are commercially available and may be used in conventional minor amounts along with other additives such as antifoam agents. Although their presence is not required to obtain the benefit of the present disclosure, the emulsifier or emulsifiers may be present a combined amount less than 1 weight percent (e.g. less than 0.1 weight percent).

In any aspect or embodiment described herein, the demulsifying agent includes at least one of alkoxylated phenols, phenol-formaldehyde resins, synthetic alkylaryl sulfonates (such as metallic dinonylnaphthalene sulfonates), or a combination thereof. In any aspect or embodiment described herein, a demulsifing agent is a predominant amount of a water-soluble polyoxyalkylene glycol having a pre-selected molecular weight of any value in the range of between about 450 and about 5000 or more. In an embodiment, the water soluble polyoxyalkylene glycol demulsifier may also be one produced from alkoxylation of n-butanol with a mixture of alkylene oxides to form a random alkoxylated product.

Polyoxyalkylene glycols useful in the present disclosure may be produced by a well-known process for preparing polyalkylene oxide having hydroxyl end-groups by subjecting an alcohol or a glycol ether and one or more alkylene oxide monomers, such as ethylene oxide, butylene oxide, or propylene oxide, to form block copolymers in addition polymerization, while employing a strong base, such as potassium hydroxide as a catalyst. In such a process, the polymerization is commonly carried out under a catalytic concentration of about 0.3 to about 1.0% by mole of potassium hydroxide to the monomer(s) and at high temperature of about 100° C. to about 160° C. It is well known that the catalyst potassium hydroxide is, for the most part, bonded to the chain-end of the produced polyalkylene oxide in a form of alkoxide in the polymer solution so obtained.

The soluble polyoxyalkylene glycol emulsifier(s) useful in the compositions of the present disclosure may also be one produced from alkoxylation of n-butanol with a mixture of alkylene oxides to form a random alkoxylated product.

Corrosion Inhibitor or Anti-Rust Additive. In any aspect or embodiment described herein, the composition of the present disclosure comprises at least one (e.g. 1, 2, 3, 4, or more) corrosion inhibitor or anti-rust additive. The corrosion inhibitor or anti-rust additive may be added to protect lubricated metal surfaces against chemical attack by water or other contaminants. A wide variety of corrosion inhibitors are commercially available, and any corrosion inhibitor or anti-rust additive that is known or that becomes know may be utilized in the composition of the present disclosure. In an embodiment, the corrosion inhibitor can be a polar compound that wets the metal surface protecting it with a film of oil. In another embodiment, the anti-rust additive may absorb water by incorporating it in a water-in-oil emulsion so that only the oil touches the surface. In yet a further embodiment, the corrosion inhibitor chemically adheres to the metal to produce a non-reactive surface. In certain embodiments, the anti-rust additive or corrosion inhibitor includes at least one of zinc dithiophosphates, metal phenolates, metal sulfonates, metal salicylates, a fatty acid, fatty acid mixture, amines, or a combination thereof.

The metal phenolates, sulfonates and salicylates may include those containing short ($C_1$ to about $C_{20}$), medium (about $C_{20}$ to about $C_{40}$), and long (about $C_{40}$ or longer) alkyl or alkenyl chains, which may also contain additional elements, such as oxygen, nitrogen or phosphorus. The metal phenolates, sulfonates and salicylates may be salts of alkali or alkaline earth metals, and may be generally classified as "Neutral" (TBN lower than about 20 mgKOH/g), or "Overbased" with addition metal hydroxide or carbonate (giving TBN values from about 10 to about 100, from about 100 to about 250, and higher than 250).

Antirust additives may include (short-chain) alkenyl succinic acids, partial esters thereof and nitrogen-containing derivatives thereof and synthetic alkarylsulfonates, such as metal dinonylnaphthalene sulfonates. Antirust agents include, for example, monocarboxylic acids which have from 8 to 30 carbon atoms, alkyl or alkenyl succinates or partial esters thereof, hydroxy-fatty acids, which have from 12 to 30 carbon atoms and derivatives thereof, sarcosines which have from 8 to 24 carbon atoms and derivatives thereof, amino acids and derivatives thereof, naphthenic acid and derivatives thereof, lanolin fatty acid, mercapto-fatty acids, and/or paraffin oxides.

Examples of monocarboxylic acids ($C_8$-$C_{30}$), include, for example, caprylic acid, pelargonic acid, decanoic acid, undecanoic acid, lauric acid, myristic acid, palmitic acid, stearic acid, arachic acid, behenic acid, cerotic acid, montanic acid, melissic acid, oleic acid, docosanic acid, erucic acid, eicosenic acid, beef tallow fatty acid, soy bean fatty acid, coconut oil fatty acid, linolic acid, linoleic acid, tall oil fatty acid, 12-hydroxystearic acid, laurylsarcosinic acid, myritsylsarcosinic acid, palmitylsarcosinic acid, stearylsarcosinic acid, oleylsarcosinic acid, alkylated (C8-C20) phenoxyacetic acids, lanolin fatty acid, and C8-C24 mercapto-fatty acids.

Examples of polybasic carboxylic acids include, for example, the alkenyl (C10-C100) succinic acids indicated in CAS No. 27859-58-1 and ester derivatives thereof, dimer acid, N-acyl-N-alkyloxyalkyl aspartic acid esters (U.S. Pat. No. 5,275,749).

Examples of the alkylamines that function as antirust additives or as reaction products with the above carboxylates to give amides and the like are represented by primary amines, such as laurylamine, coconut-amine, n-tridecylamine, myristylamine, n-pentadecylamine, palmitylamine, n-heptadecylamine, stearylamine, n-nonadecylamine, n-eicosylamine, n-heneicosylamine, n-docosylamine, n-tricosylamine, n-pentacosylamine, oleylamine, beef tallow-amine, hydrogenated beef tallow-amine and soy bean-amine. Examples of the secondary amines include dilaurylamine, di-coconut-amine, di-n-tridecylamine, dimyristylamine, di-n-pentadecylamine, dipalmitylamine, di-n-pentadecylamine, distearylamine, di-n-nonadecylamine, di-n-eicosylamine, di-n-heneicosylamine, di-n-docosylamine, di-n-tricosylamine, di-n-pentacosyl-amine, dioleylamine, di-beef tallow-amine, di-hydrogenated beef tallow-amine and di-soy bean-amine.

Examples of the aforementioned N-alkylpolyalkyenediamines include: ethylenediamines, such as laurylethylenediamine, coconut ethylenediamine, n-tridecylethylenediamine-myristylethylenediamine, n-pentadecylethylenediamine, palmitylethylenediamine, n-heptadecylethylenediamine, stearylethylenediamine, n-nonadecylethylenediamine, n-eicosylethylenediamine, n-heneicosylethylenediamine, n-docosylethylendiamine, n-tricosylethylenediamine, n-pentacosylethylenediamine, oleylethylenediamine, beef tallow-ethylenediamine, hydrogenated beef tallow-ethylenediamine and soy bean-ethylenediamine; propylenediamines such as laurylpropylenediamine, coconut propylenediamine, n-tridecylpropylenediamine, myristylpropylenediamine, n-pentadecylpropylenediamine, palmitylpropylenediamine, n-heptadecylpropylenediamine, stearylpropylenediamine, n-nonadecylpropylenediamine, n-eicosylpropylenediamine, n-heneicosylpropylenediamine, n-docosylpropylendiamine, n-tricosylpropylenediamine, n-pentacosylpropylenediamine, diethylene triamine (DETA) or triethylene tetramine (TETA), oleylpropylenediamine, beef tallow-propylenediamine, hydrogenated beef tallow-propylenediamine and soy bean-propylenediamine; butylenediamines such as laurylbutylenediamine, coconut butylenediamine, n-tridecylbutylenediamine-myristylbutylenediamine, n-pentadecylbutylenediamine, stearylbutylenediamine, n-eicosylbutylenediamine, n-heneicosylbutylenediamine, n-docosylbutylendiamine, n-tricosylbutylenediamine, n-pentacosylbutylenediamine, oleylbutylenediamine, beef tallow-butylenediamine, hydrogenated beef tallow-butylenediamine and soy bean butylenediamine; and pentylenediamines such as laurylpentylenediamine, coconut pentylenediamine, myristylpentylenediamine, palmitylpentylenediamine, stearylpentylenediamine, oleylpentylenediamine, beef tallow-pentylenediamine, hydrogenated beef tallow-pentylenediamine and soy bean pentylenediamine.

In any aspect or embodiment described herein, the corrosion inhibitor or anti-rust additive may be present in an amount equal to or less than about 5 wt. %, for example about 0.01 to 5 wt. %, on an as-received basis. For example, the corrosion inhibitor may be present in an amount equal to or less than 4 wt. %, equal or less than 3 wt. %, equal to or less than 2 wt. %, or equal to or less than 1 wt. % on an as-received basis. By way of further example, the corrosion inhibitor may be present in an amount of about 0.01 to about 5 wt. %, about 0.01 to about 4 wt. %, about 0.01 to about 3 wt. %, about 0.01 to about 2 wt. %, about 0.05 to about 5 wt. %, about 0.05 to about 4 wt. %, about 0.05 to about 3 wt. %, about 0.05 to about 2 wt. %, about 0.1 to about 5 wt. %, about 0.1 to about 4 wt. %, about 0.1 to about 3 wt. %, about 0.1 to about 2 wt. %, about 1 to about 5 wt. %, about 1 to about 4 wt. %, about 1 to about 3 wt. %, about 2 to about 5 wt. %, about 2 to about 4 wt. %, or about 3 to about 5 wt. %, on an as-received basis.

Metal Passivator(s), Deactivator(s) and Corrosion Inhibitor(s). In any aspect or embodiment described herein, the composition of the present disclosure comprises at least one (e.g. 1, 2, 3, 4, 5, or 6, or more) metal passivator, deactivator, or corrosion inhibitor. This type of component includes 2,5-dimercapto-1,3,4-thiadiazoles and derivatives thereof, mercaptobenzothiazoles, alkyltriazoles and benzotriazoles. Examples of dibasic acids useful as anti-corrosion agents, other than sebacic acids, which may be used in the present disclosure, are adipic acid, azelaic acid, dodecanedioic acid, 3-methyladipic acid, 3-nitrophthalic acid, 1,10-decanedicarboxylic acid, and fumaric acid. The anti-corrosion combination is a straight or branch-chained, saturated or unsaturated monocarboxylic acid or ester thereof which may optionally be sulphurized in an amount up to 35% by weight. In an embodiment, the acid is a $C_4$ to $C_{22}$ straight chain unsaturated monocarboxylic acid. The monocarboxylic acid may be a sulphurized oleic acid. However, other suitable materials are oleic acid itself, valeric acid and erucic acid. A component of the anti-corrosion combination is a triazole as previously defined. In an embodiment, the triazole is tolyltriazole, which may be included in the compositions of the disclosure include triazoles, thiazoles and certain diamine compounds which are useful as metal deactivators or metal passivators. Examples include triazole, benzotriazole and substituted benzotriazoles, such as alkyl substituted derivatives. The alkyl substituent may contain up to 1.5 carbon atoms, e.g. up to 8 carbon atoms. The triazoles may contain other substituents on the aromatic ring such as halogens, nitro, amino, mercapto, etc. Examples of suitable compounds are benzotriazole and the tolyltriazoles, ethylbenzotriazoles, hexylbenzotriazoles, octylbenzotriazoles, chlorobenzotriazoles and nitrobenzotriazoles. In a particular embodiment, the compound is benzotriazole and/or tolyltriazole.

Illustrative substituents include, for example, alkyl that is straight or branched chain, for example, methyl, ethyl, n-propyl, iso-propyl, n-butyl, sec-butyl, n-pentyl, n-hexyl, n-heptyl, n-octyl, 2-ethylhexyl, n-nonyl, n-decyl, n-dodecyl, n-tetradecyl, n-hexadecyl, n-octadecyl or n-eicosyl; alkenyl that is straight or branched chain, for example, prop-2-enyl, but-2-enyl, 2-methyl-prop-2-enyl, pent-2-enyl, hexa-2,4-dienyl, dec-10-enyl or eicos-2-enyl; cycloalkyl that is, for example, cyclopentyl, cyclohexyl, cyclooctyl, cyclodecyl, adamantyl or cyclododecyl; aralkyl that is, for example, benzyl, 2-phenylethyl, benzhydryl or naphthylmethyl; aryl that is, for example, phenyl or naphthyl; heterocyclic group that is, for example, a morpholine, pyrrolidine, piperidine or a perhydroazepine ring; alkylene moieties that include, for example, methylene, ethylene, 1:2- or 1:3-propylene, 1:4-butylene, 1:6-hexylene, 1:8-octylene, 1:10-decylene and 1:12-dodecylene.

Illustrative arylene moieties include, for example, phenylene and naphthylene. 1-(or 4)-(dimethylaminomethyl) triazole, 1-(or 4)-(diethylaminomethyl) triazole, 1-(or 4)-(di-isopropylaminomethyl) triazole, 1-(or 4)-(di-n-butylaminomethyl) triazole, 1-(or 4)-(di-n-hexylaminomethyl) triazole, 1-(or 4)-(di-isooctylaminomethyl) triazole, 1-(or 4)-(di-(2-ethylhexyl)aminomethyl) triazole, 1-(or 4)-(di-n-decylaminomethyl) triazole, 1-(or 4)-(di-n-dodecylaminomethyl) triazole, 1-(or 4)-(di-n-octadecylaminomethyl) triazole, 1-(or 4)-(di-n-eicosylaminomethyl) triazole, 1-(or 4)-[di-(prop-2'-enyl) aminomethyl] triazole, 1-(or 4)-[di-(but-2'-enyl) aminomethyl] triazole, 1-(or 4)-[di-(eicos-2'-enyl) aminomethyl] triazole, 1-(or 4)-(di-cyclohexylaminomethyl) triazole, 1-(or 4)-(di-benzylaminomethyl) triazole, 1-(or 4)-(di-phenylaminomethyl) triazole, 1-(or 4)-(4'-morpholinomethyl) triazole, 1-(or 4)-(1'-pyrrolidinomethyl) triazole, 1-(or 4)-(1'-piperidinomethyl) triazole, 1-(or 4)-(1'-perhydroazepinomethyl) triazole, 1-(or 4)-(2',2"-dihydroxyethyl)aminomethyl] triazole, 1-(or 4)-(dibutoxypropyl-aminomethyl) triazole, 1-(or 4)-(dibutylthiopropyl-aminomethyl) triazole, 1-(or 4)-(di-butylaminopropyl-aminomethyl) triazole, 1-(or-4)-(1-methanomine)-N,N-bis (2-ethylhexyl)-methyl benzotriazole, N,N-bis-(1- or 4-triazolylmethyl) laurylamine, N,N-bis-(1- or 4-triazolylmethyl) oleylamine, N,N-bis-(1- or 4-triazolylmethyl) ethanolamine and N,N,N',N'-tetra(1- or 4-triazolylmethyl) ethylene diamine.

The metal deactivating agents which can be used in the composition of the present disclosure includes, for example, benzotriazole and the 4-alkylbenzotriazoles such as 4-methylbenzotriazole and 4-ethylbenzotriazole; 5-alkylbenzotriazoles such as 5-methylbenzotriazole, 5-ethylbenzotriazole; 1-alkylbenzotriazoles such as 1-dioctylauainomethyl-2,3-benzotriazole; benzotriazole derivatives such as the 1-alkyltolutriazoles, for example, 1-dioctylaminomethyl-2,3-t-olutriazole; benzimidazole and benzimidazole derivatives such as 2-(alkyldithio)-benzimidazoles, for example, such as 2-(octyldithio)-benzimidazole, 2-(decyldithio)benzimidazole and 2-(dodecyldithio)-benzimidazole; 2-(alkyldithio)-toluimidazoles such as 2-(octyldithio)-toluimidazole, 2-(decyldithio)-toluimidazole and 2-(dodecyldithio)-toluimidazole; indazole and indazole derivatives of toluimidazoles such as 4-alkylindazole, 5-alkylindazole; benzothiazole, 2-mercaptobenzothiazole derivatives (manufactured by the Chiyoda Kagaku Co. under the trade designation "Thiolite B-3100") and 2-(alkyldithio)benzothiazoles such as 2-(hexyldithio)benzothiazole and 2-(octyldithio)benzothiazole; 2-(alkyl-dithio)toluthiazoles such as 2-(benzyldithio) toluthiazole and 2-(octyldithio)toluthiazole, 2-(N,N-dialkyl-dithiocarbamyl)benzothiazoles such as 2-(N,N-diethyldithiocarbamyl)benzothiazole, 2-(N,N-dibutyl dithiocarbamyl)-benzotriazole and 2-N,N-dihexyl-dithiocarbamyl)benzotriazole; benzothiazole derivatives of 2-(N,N-dialkyldithiocarbamyl)toluthiazoles such as 2-(N,N-diethyldithiocarbamyl)toluthiazole, 2-(N,N-dibutyldithiocarbamyl)toluthiazole, 2-(N,N-dihexyl-dithiocarbamyl)-toluthiazole; 2-(alkyldithio)benzoxazoles such as 2-(octyldithio)benzoxazole, 2-(decyldithio)-benzoxazole and 2-(dodecyldithio)benzoxazole; benzoxazole derivatives of 2-(alkyldithio)toluoxazoles such as 2-(octyl-dithio)toluoxazole, 2-(decyldithio)toluoxazole, 2-(dodecyl-dithio)toluoxazole; 2,5-bis(alkyldithio)-1,3,4-thiadiazoles such as 2,5-bis(heptyldithio)-1,3,4-thiadiazole, 2,5-bis-(nonyldithio)-1,-3,4-thiadiazole, 2,5-bis(dodecyldithio)-1,3,4-thiadiazole and 2,5-bis-(octadecyldithio)-1,3,4-thiadiazole; 2,5-bis(N,N-dialkyl-dithiocarbamyl)-1,3,4-thiadiazoles such as 2,5-bis(N,N-diethyldithiocarbamyl)-1,3,-4-thiadiazole, 2,5-bis(N,N-dibutyldithiocarbamyl)-1,3,4-thiadiazole and 2,5-bis(N,N-dioctyldithiocarbamyl)1,3,4-thiadiazole; thiadiazole derivatives of 2-N,N-dialkyldithiocarbamyl-5-mercapto-1,3,4-thiadiazoles such as 2-N,N-dibutyldithiocarbamyl-5-mercapto-1,3,4-thiadiazole and 2-N,N-dioctyl-dithiocarbamyl-5-mercapto-1,3,4-thiadiazole, and triazole derivatives of 1-alkyl-2,4-triazoles such as 1-dioctylaminomethyl-2,4-triazole; or concentrates and/or mixtures thereof.

Although their presence is not required to obtain the benefit of the present disclosure, in any aspect or embodiment described herein, the metal deactivator(s) and corrosion inhibitor(s) may be present from zero to about 1% by weight (e.g. from 0.01% to about 0.5% by weight) of the total composition of the present disclosure.

Antiwear Additive(s) or Inhibitor(s). In any aspect or embodiment described herein, the composition of the present disclosure comprises at least one (e.g., 1, 2, 3, 4, 5, or 6, or more) antiwear additive or wear inhibitor. Any antiwear additive that is known or that becomes known may be utilized in the lubricating of the present disclosure. The antiwear additive may be an alkyldithiophosphate(s), aryl phosphate(s) and/or phosphite(s). The antiwear additive(s) may be essentially free of metals, or they may contain metal salts.

In any aspect or embodiment described herein, the antiwear additive is a phosphate ester or salt thereof. A phosphate ester or salt may be a monohydrocarbyl, dihydrocarbyl or a trihydrocarbyl phosphate, wherein each hydrocarbyl group is saturated. In an embodiment, each hydrocarbyl group independently contains from about 8 to about 30, or from about 12 up to about 28, or from about 14 up to about 24, or from about 14 up to about 18 carbons atoms. In an embodiment, the hydrocarbyl groups are alkyl groups. Examples of hydrocarbyl groups include at least one of tridecyl, tetradecyl, pentadecyl, hexadecyl, heptadecyl, octadecyl groups, and mixtures thereof.

A phosphate ester or salt is a phosphorus acid ester prepared by reacting at least one (e.g., 1, 2, 3, 4, or more) phosphorus acid or anhydride with a saturated alcohol. The phosphorus acid or anhydride cam be an inorganic phosphorus reagent, such as phosphorus pentoxide, phosphorus trioxide, phosphorus tetroxide, phosphorous acid, phosphoric acid, phosphorus halide, lower phosphorus esters, or a phosphorus sulfide, including phosphorus pentasulfide, and the like. Lower phosphorus acid esters may contain from 1 to about 7 carbon atoms in each ester group. Alcohols used to prepare the phosphorus acid esters or salts. Examples of commercially available alcohols and alcohol mixtures include Alfol 1218 (a mixture of synthetic, primary, straight-chain alcohols containing 12 to 18 carbon atoms); Alfol 20+ alcohols (mixtures of $C_{18}$-$C_{28}$ primary alcohols having mostly $C_{20}$ alcohols as determined by GLC (gas-liquid-chromatography)); and Alfol22+ alcohols ($C_{18}$-$C_{28}$ primary alcohols containing primarily $C_{22}$ alcohols). Alfol alcohols are available from, e.g., Continental Oil Company. Another example of a commercially available alcohol mixture is Adol 60 (about 75% by weight of a straight chain $C_{22}$ primary alcohol, about 15% of a $C_{20}$ primary alcohol, and about 8% of $C_{18}$ and $C_{24}$ alcohols). The Adol alcohols are marketed by Ashland Chemical.

The antiwear additive may include at least one (e.g., a mixture of) monohydric fatty alcohol. For example, a mixture of monohydric fatty alcohols derived from naturally occurring triglycerides and ranging in chain length from $C_8$ to $C_{18}$ may be utilized as an antiwear additive. A variety of monohydric fatty alcohol mixtures are available from Procter & Gamble Company. These mixtures contain various amounts of fatty alcohols containing 12, 14, 16, or 18 carbon atoms. For example, CO-1214 is a fatty alcohol mixture containing 0.5% of $C_{10}$ alcohol, 66.0% of Cu alcohol, 26.0% of $C_{14}$ alcohol and 6.5% of $C_{16}$ alcohol.

Another group of commercially available alcohol mixtures include the "Neodol" products available from Shell Chemical Co. For example, Neodol 23 is a mixture of Cu and $C_{13}$ alcohols; Neodol 25 is a mixture of Cu to $C_{15}$ alcohols; and Neodol 45 is a mixture of $C_{14}$ to $C_{15}$ linear alcohols. The phosphate contains from about 14 to about 18 carbon atoms in each hydrocarbyl group. The hydrocarbyl groups of the phosphate may be derived from a mixture of fatty alcohols having from about 14 up to about 18 carbon atoms. The hydrocarbyl phosphate may also be derived from a fatty vicinal diol. Fatty vicinal diols include, but not limited to, those available from Ashland Oil under the general trade designation Adol 114 and Adol 158. The former is derived from a straight chain alpha olefin fraction of $C_{11}$-$C_{14}$, and the latter is derived from a $C_{15}$-$C_{18}$ fraction.

Phosphate salts may be prepared by reacting an acidic phosphate ester with an amine compound or a metallic base to form an amine or a metal salt. The amines may be monoamines or polyamines. Useful amines include those amines disclosed in U.S. Pat. No. 4,234,435.

Illustrative monoamines may contain a hydrocarbyl group, which contains from 1 to about 30 carbon atoms, or from 1 to about 12, or from 1 to about 6. Examples of primary monoamines useful in the present disclosure include methylamine, ethylamine, propylamine, butylamine, cyclopentylamine, cyclohexylamine, octylamine, dodecylamine, allylamine, cocoamine, stearylamine, and laurylamine. Examples of secondary monoamines include dimethylamine, diethylamine, dipropylamine, dibutylamine, dicyclopentylamine, dicyclohexylamine, methylbutylamine, ethylhexylamine, etc.

An amine may be a fatty ($C_8$-$C_{30}$) amine which includes n-octylamine, n-decylamine, n-dodecylamine, n-tetradecylamine, n-hexadecylamine, n-octadecylamine, oleyamine, etc. Also useful fatty amines include commercially available fatty amines, such as "Armeen" amines (products available from Akzo Chemicals, Chicago, Ill.), e.g. Armeen C, Armeen O, Armeen O L, Armeen T, Armeen H T, Armeen S and Armeen S D, wherein the letter designation relates to the fatty group, such as coco, oleyl, tallow, or stearyl groups.

Other useful amines include primary ether amines, such as those represented by the formula:

$$R''(OR')_x NH_2,$$

wherein: R' is a divalent alkylene group having about 2 to about 6 carbon atoms; x is a number from one to about 150, or from about one to about five, or one; and R" is a hydrocarbyl group of about 5 to about 150 carbon atoms.

An exemplary or illustrative ether amine is available under the name SURFAM® amines produced and marketed by Mars Chemical Company, Atlanta, Ga. Additional exemplary ether amines include those identified as SURFAM P14B (decyloxypropylamine), SURFAM P16A (linear $C_{16}$), and SURFAM P17B (tridecyloxypropylamine). The carbon chain lengths (i.e., $C_{14}$, etc.) of the SURFAM ether amines described above and used hereinafter are approximate and include the oxygen ether linkage.

A further illustrative amine is a tertiary-aliphatic primary amine. For example, the aliphatic group, such as an alkyl group, contains from about 4 to about 30, or from about 6 to about 24, or from about 8 to about 22 carbon atoms. Usually the tertiary alkyl primary amines are monoamines the alkyl group is a hydrocarbyl group containing from one to about 27 carbon atoms. Such amines are illustrated by tert-butylamine, tert-hexylamine, 1-methyl-1-amino-cyclohexane, tert-octylamine, tert-decylamine, tert-dodecylamine, tert-tetradecylamine, tert-hexadecylamine, tert-octadecylamine, tert-tetracosanylamine, tert-octacosanylamine, and combinations thereof. Mixtures of tertiary aliphatic amines may also be used in preparing the phosphate salt. Illustrative of amine mixtures of this type are "Primene 81R", which is a mixture of $C_{11}$-$C_{14}$ tertiary alkyl primary amines, and "Primene JMT", which is a similar mixture of $C_{18}$-$C_{22}$ tertiary alkyl primary amines (both are available from Rohm and Haas Company). The tertiary aliphatic primary amines and methods for their preparation are known to those of ordinary skill in the art.

Another illustrative amine is a heterocyclic polyamine. The heterocyclic polyamines include aziridines, azetidines, azolidines, tetra- and dihydropyridines, pyrroles, indoles, piperidines, imidazoles, di- and tetra-hydroimidazoles, piperazines, isoindoles, purines, morpholines, thiomorpholines, N-aminoalkylmorpholines, N-aminoalkylthiomorpholines, N-aminoalkyl-piperazines, N,N'-diaminoalkylpiperazines, azepines, azocines, azonines, azecines and tetra-, di- and perhydro derivatives of each of the above, and mixtures of two or more (e.g., 2, 3, 4, 5, 6, or more) of these heterocyclic amines. In certain embodiments, the heterocyclic amines are saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl substituted piperidines, piperazine, aminoalkyl substituted piperazines, morpholine, aminoalkyl substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine. Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The metal salts of the phosphorus acid esters may be prepared by the reaction of a metal base with the acidic phosphorus ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In an embodiment, the metal is a Group IIA metal, such as calcium or magnesium, Group IIB metal, such as zinc, or a Group VIIB metal, such as manganese. In particular embodiments, the metal is magnesium, calcium, manganese or zinc. Examples of metal compounds which may be reacted with the phosphorus acid include zinc hydroxide, zinc oxide, copper hydroxide, copper oxide, etc.

The composition of the present disclosure also may include a fatty imidazoline or a reaction product of a fatty carboxylic acid and at least one polyamine. The fatty imidazoline has fatty substituents containing from 8 to about 30, or from about 12 to about 24 carbon atoms. The substituent may be saturated or unsaturated, for example, heptadeceneyl derived olyel groups. In a particular embodiment, the substituents are saturated. In one aspect, the fatty imidazoline may be prepared by reacting a fatty carboxylic acid with a polyalkylenepolyamine. The fatty carboxylic acids are can be mixtures of straight and branched chain fatty carboxylic acids containing about 8 to about 30 carbon atoms, or from about 12 to about 24, or from about 16 to about 18. Carboxylic acids include the polycarboxylic acids or carboxylic acids or anhydrides having from 2 to about 4 carbonyl groups, (e.g. 2 carbonyl groups). The polycarboxylic acids include succinic acids and anhydrides and Diels-Alder reaction products of unsaturated monocarboxylic acids with unsaturated carboxylic acids (such as acrylic, methacrylic, maleic, fumaric, crotonic and itaconic acids). In particular embodiments, the fatty carboxylic acids are fatty monocarboxylic acids, having from about 8 to about 30, (e.g. about 12 to about 24 carbon atoms), such as octanoic, oleic, stearic, linoleic, dodecanoic, and tall oil acids. In an embodiment, the fatty carboxylic acid is stearic acid. The fatty carboxylic acid or acids are reacted with at least one polyamine. The polyamines may be aliphatic, cycloaliphatic, heterocyclic or aromatic. Examples of the polyamines include alkylene polyamines and heterocyclic polyamines.

The antiwear additive according to the present disclosure has very high effectiveness when used in low concentrations and is free of chlorine. For the neutralization of the phosphoric esters, the latter are taken and the corresponding amine slowly added with stirring. The resulting heat of neutralization is removed by cooling. The antiwear additive according to the present disclosure can be incorporated into the respective base liquid with the aid of fatty substances (e.g., tall oil fatty acid, oleic acid, etc.) as solubilizers. The base liquids used are napthenic or paraffinic base oils, synthetic oils (e.g., polyglycols, mixed polyglycols), polyolefins, carboxylic esters, etc.

In any aspect or embodiment described herein, the compositions of the present disclosure can contain at least one phosphorus containing antiwear additive. Examples of such additives are amine phosphate antiwear additives such as that known under the trade name IRGALUBE 349 and/or triphenyl phosphorothionate antiwear additives, such as that known under the trade name IRGALUBE TPPT. Such amine phosphates may be present in an amount of from about 0.01 to about 2% (e.g. about 0.2 to about 1.5%) by weight of the lubricant composition, while such phosphorothionates are suitably present in an amount of from about 0.01 to about 3% (e.g., about 0.5 to about 1.5%) by weight of the composition of the present disclosure. A mixture of an amine phosphate and phosphorothionate may be employed.

Neutral organic phosphates may be present in an amount from zero to about 4% (e.g., about 0.1 to about 2.5%) by weight of the composition of the present disclosure. The above amine phosphates can be mixed together to form a single component capable of delivering antiwear performance. The neutral organic phosphate is also a conventional ingredient of lubricating oils.

Phosphates for use in the present disclosure include phosphates, acid phosphates, phosphites, and acid phosphites. The phosphates include triaryl phosphates, trialkyl phosphates, trialkylaryl phosphates, triarylalkyl phosphates, trialkenyl phosphates, or combinations thereof. As specific examples of these, referred to are triphenyl phosphate, tricresyl phosphate, benzyldiphenyl phosphate, ethyldiphenyl phosphate, tributyl phosphate, ethyldibutyl phosphate, cresyldiphenyl phosphate, dicresylphenyl phosphate, ethylphenyldiphenyl phosphate, diethylphenylphenyl phosphate, propylphenyldiphenyl phosphate, dipropylphenylphenyl phosphate, triethylphenyl phosphate, tripropylphenyl phosphate, butylphenyldiphenyl phosphate, dibutylphenylphenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate, trioleyl phosphate, or combinations thereof.

The acid phosphates include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, isostearyl acid phosphate, or combinations thereof.

The phosphites include, for example, triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenylisodecyl phosphite, tristearyl phosphite, trioleyl phosphite, or combinations thereof.

The acid phosphites include, for example, dibutyl hydrogenphosphite, dilauryl hydrogenphosphite, dioleyl hydrogenphosphite, distearyl hydrogenphosphite, diphenyl hydrogenphosphite, or combinations thereof.

Amines that form amine salts with such phosphates include, for example, mono-substituted amines, di-substituted amines and tri-substituted amines. Examples of the mono-substituted amines include butylamine, pentylamine, hexylamine, cyclohexylamine, octylamine, laurylamine, stearylamine, oleylamine and benzylamine; and those of the di-substituted amines include dibutylamine, dipentylamine, dihexylamine, dicyclohexylamine, dioctylamine, dilaurylamine, distearylamine, dioleylamine, dibenzylamine, stearyl monoethanolamine, decyl monoethanolamine, hexyl monopropanolamine, benzyl monoethanolamine, phenyl monoethanolamine, and tolyl monopropanolamine. Examples of tri-substituted amines include tributylamine, tripentylamine, trihexylamine, tricyclohexylamine, trioctylamine, trilaurylamine, tristearylamine, trioleylamine, tribenzylamine, dioleyl monoethanolamine, dilauryl monopropanolamine, dioctyl monoethanolamine, dihexyl monopropanolamine, dibutyl monopropanolamine, oleyl diethanolamine, stearyl dipropanolamine, lauryl diethanolamine, octyl dipropanolamine, butyl diethanolamine, benzyl diethanolamine, phenyl diethanolamine, tolyl dipropanolamine, xylyl diethanolamine, triethanolamine, and tripropanolamine. Phosphates or their amine salts are added to the base oil in an amount from zero to about 5% by weight, (e.g. from about 0.1 to about 2% by weight) relative to the total weight of the composition of the present disclosure.

Illustrative carboxylic acids to be reacted with amines include, for example, aliphatic carboxylic acids, dicarboxylic acids (dibasic acids), aromatic carboxylic acids, or combinations thereof. The aliphatic carboxylic acids have from 8 to 30 carbon atoms, and may be saturated or unsaturated, and linear or branched. Specific examples of the aliphatic carboxylic acids include pelargonic acid, lauric acid, tridecanoic acid, myristic acid, palmitic acid, stearic acid, isostearic acid, eicosanoic acid, behenic acid, triacontanoic acid, caproleic acid, undecylenic acid, oleic acid, linolenic acid, erucic acid, linoleic acid, or combinations thereof. Specific examples of the dicarboxylic acids include octadecylsuccinic acid, octadecenylsuccinic acid, adipic acid, azelaic acid, sebacic acid, or combinations thereof. One example of the aromatic carboxylic acids is salicylic acid. Illustrative amines to be reacted with carboxylic acids include, for example, polyalkylene-polyamines, such as diethylenetriamine, triethylenetetramine, tetraethylenepentamine, pentaethylenehexamine, hexaethyleneheptamine, heptaethyleneoctamine, dipropylenetriamine, tetrapropylenepentamine, hexabutyleneheptamine, or combinations thereof; and alkanolamines, such as monoethanolamine and diethanolamine. Of these, preferred are a combination of isostearic acid, tetraethylenepentamine, or combinations thereof; and a combination of oleic acid and diethanolamine. Reaction products of carboxylic acids and amines may be added to the base oil in an amount of from zero to about 5% by weight (e.g. from about 0.03 to about 3% by weight) relative to the total weight of the composition of the present disclosure.

Other illustrative antiwear additives include phosphites, thiophosphites, phosphates, and thiophosphates, including mixed materials having, for instance, one or two sulfur atoms, i.e., monothio- or dithio compounds. As used herein, the term "hydrocarbyl substituent" or "hydrocarbyl group" is used in its ordinary sense, which is well-known to those skilled in the art. Specifically, it refers to a group primarily composed of carbon and hydrogen atoms and is attached to the remainder of the molecule through a carbon atom and does not exclude the presence of other atoms or groups in a proportion insufficient to detract from the molecule having a predominantly hydrocarbon character. In general, no more than two, preferably no more than one, non-hydrocarbon substituent will be present for every ten carbon atoms in the hydrocarbyl group; typically, there will be no non-hydrocarbon substituents in the hydrocarbyl group. A more detailed definition of the terms "hydrocarbyl substituent" or "hydrocarbyl group," is described in U.S. Pat. No. 6,583,092.

Specific examples of some phosphites and thiophosphites within the scope of the disclosure include phosphorous acid, mono-, di- or tri-thiophosphorous acid, mono-, di- or tri-propyl phosphite or mono-, di- or tri-thiophosphite; mono-, di- or tri-butyl phosphite or mono-, di- or tri-thiophosphite; mono-, di- or tri-amyl phosphite or mono-, di- or tri-thiophosphite; mono-, di- or tri-hexyl phosphite; or mono-, di- or tri-thiophosphite; mono-, di- or tri-phenyl phosphite; or mono-, di- or tri-thiophosphite; mono-, di- or tri-tolyl phosphite; or mono-, di- or tri-thiophosphite; mono-, di- or tri-cresyl phosphite; or mono-, di- or tri-thiophosphite; dibutyl phenyl phosphite; or mono-, di- or tri-phosphite; amyl dicresyl phosphite; or mono-, di- or tri-thiophosphite, and any of the above with substituted groups, such as chlorophenyl or chlorobutyl.

Specific examples of the phosphates and thiophosphates within the scope of the disclosure include phosphoric acid, mono-, di-, or tri-thiophosphoric acid, mono-, di-, or tri-propyl phosphate or mono-, di-, or tri-thiophosphate; mono-, di-, or tri-butyl phosphate or mono-, di-, or tri-thiophosphate; mono-, di-, or tri-amyl phosphate or mono-, di-, or tri-thiophosphate; mono-, di-, or tri-hexyl phosphate or mono-, di-, or tri-thiophosphate; mono-, di-, or tri-phenyl phosphate or mono-, di-, or tri-thiophosphate; mono-, di-, or tritolyl phosphate or mono-, di-, or trithiophosphate; mono-, di-, or tri-cresyl phosphate or mono-, di-, or tri-thiophosphate; dibutyl phenyl phosphate or mono-, di-, or tri-phosphate, amyl dicresyl phosphate or mono-, di-, or tri-thiophosphate, and any of the above with substituted groups, such as chlorophenyl or chlorobutyl.

These phosphorus compounds may be prepared by well-known reactions. For example, the reaction of an alcohol or a phenol with phosphorus trichloride or by a transesterification reaction. Alcohols and phenols can be reacted with phosphorus pentoxide to provide a mixture of an alkyl or aryl phosphoric acid and a dialkyl or diaryl phosphoric acid. Alkyl phosphates can also be prepared by the oxidation of the corresponding phosphites. Thiophosphates can be prepared by the reaction of phosphites with elemental sulfur. In any case, the reaction can be conducted with moderate heating. Moreover, various phosphorus esters can be prepared by reaction using other phosphorus esters as starting materials. Thus, medium chain ($C_9$ to $C_{22}$) phosphorus esters have been prepared by reaction of dimethylphosphite with a mixture of medium-chain alcohols by means of a thermal transesterification or an acid- or base-catalyzed transesterification. See, for example, U.S. Pat. No. 4,652,416. Most such materials are also commercially available; for instance, triphenyl phosphite is available from Albright and Wilson as Duraphos TPP™; di-n-butyl hydrogen phosphite from Albright and Wilson as Duraphos DBHP™; and triphenylthiophosphate from Ciba Specialty Chemicals as Irgalube TPPT™.

Examples of esters of the dialkylphosphorodithioic acids include esters obtained by reaction of the dialkyl phosphorodithioic acid with an alpha, beta-unsaturated carboxylic acid (e.g., methyl acrylate) and, optionally an alkylene oxide such as propylene oxide.

One or more of the above-identified metal dithiophosphates may be used from about zero to about 2% by weight (e.g., from about 0.1 to about 1% by weight) based on the weight of the total composition.

The hydrocarbyl in the dithiophosphate may be alkyl, cycloalkyl, aralkyl or alkaryl groups, or a substantially hydrocarbon group of similar structure. Illustrative alkyl groups include isopropyl, isobutyl, n-butyl, sec-butyl, the various amyl groups, n-hexyl, methylisobutyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this disclosure are prepared are well known. Examples of dihydrocarbylphosphorodithioic acids and metal salts, and processes for preparing such acids and salts are found in, for example U.S. Pat. Nos. 4,263,150; 4,289,635; 4,308,154; and 4,417,990. These patents are hereby incorporated by reference.

The phosphorodithioic acids may be prepared by the reaction of a phosphorus sulfide with an alcohol or phenol or mixtures of alcohols. An exemplary reaction involves four moles of the alcohol or phenol and one mole of phosphorus pentasulfide, and may be carried out within the temperature range from about 50° C. to about 200° C. Thus, the preparation of 0,0-di-n-hexyl phosphorodithioic acid involves the reaction of a mole of phosphorus pentasulfide with four moles of n-hexyl alcohol at about 100° C. for about two hours. Hydrogen sulfide is liberated and the residue is the desired acid. The preparation of the metal salts of these acids may be effected by reaction with metal compounds as well known in the art.

The metal salts of dihydrocarbyldithiophosphates, which are useful in the present disclosure, include those salts containing Group I metals, Group II metals, aluminum, lead, tin, molybdenum, manganese, cobalt, and nickel. The Group II metals, aluminum, tin, iron, cobalt, lead, molybdenum, manganese, nickel and copper are among the preferred metals. Zinc and copper are especially useful metals. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, and the like.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate with potentially improved performance properties.

Especially useful metal phosphorodithloates can be prepared from phosphorodithloic acids, which in turn are prepared by the reaction of phosphorus pentasulfide with mixtures of alcohols. In addition, the use of such mixtures enables the utilization of less expensive alcohols, which individually may not yield oil-soluble phosphorodithioic acids. Thus, a mixture of isopropyl and hexylalcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols, or mixtures of primary and secondary alcohols. Examples of useful mixtures include: n-butanol and n-octanol; n-pentanol and 2-ethyl-1-hexanol; isobutanol and n-hexanol; isobutanol and isoamyl alcohol; isopropanol and 2-methyl-4-pentanol; isopropanol and sec-butyl alcohol; isopropanol and isooctyl alcohol; and the like.

Organic triesters of phosphorus acids are also employed in lubricants. Exemplary esters include triarylphosphates, trialkyl phosphates, neutral alkylaryl phosphates, alkoxyalkyl phosphates, triaryl phosphite, trialkylphosphite, neutral alkyl aryl phosphites, neutral phosphonate esters and neutral phosphine oxide esters. In one embodiment, the long chain dialkyl phosphonate esters are used. For example, the dimethyl-, diethyl-, and/or dipropyl-oleyl phohphonates can be used. Neutral acids of phosphorus acids are the triesters rather than an acid (HO-P) or a salt of an acid.

Any C4 to C8 alkyl or higher phosphate ester may be employed in the disclosure. For example, tributyl phosphate (TBP) and tri isooctal phosphate (TOF) can be used. The specific triphosphate ester or combination of esters can easily be selected by one skilled in the art to adjust the density, viscosity, etc., of the formulated fluid. Mixed esters, such as dibutyl octyl phosphate or the like may be employed rather than a mixture of two or more trialkyl phosphates.

A trialkyl phosphate is often useful to adjust the specific gravity of the formulation, but it is desirable that the specific trialkyl phosphate be a liquid at low temperatures. Consequently, a mixed ester containing at least one partially alkylated with a C3 to C4 alkyl group is very desirable, for example, 4-isopropylphenyl diphenyl phosphate or 3-butylphenyl diphenyl phosphate. Even more desirable is a triaryl phosphate produced by partially alkylating phenol with butylene or propylene to form a mixed phenol which is then reacted with phosphorus oxychloride as taught in U.S. Pat. No. 3,576,923.

Any mixed triaryl phosphate (TAP) esters may be used as cresyl diphenyl phosphate, tricresyl phosphate, mixed xylyl cresyl phosphates, lower alkylphenyl/phenyl phosphates, such as mixed isopropylphenyl/phenyl phosphates, t-butylphenyl phenyl phosphates. These esters are used extensively as plasticizers, functional fluids, gasoline additives, flame-retardant additives and the like.

A metal alkylthiophosphate and more particularly a metal dialkyl dithio phosphate in which the metal constituent is zinc, or zinc dialkyl dithio phosphate (ZDDP) can be a useful component of the lubricating oils of this disclosure. ZDDP can be derived from primary alcohols, secondary alcohols or mixtures thereof. ZDDP compounds are of the formula:

$$Zn[SP(S)(OR1)(OR2)]_2,$$

wherein R1 and R2 are $C_1$-$C_1$8 alkyl groups (e.g. $C_2$-$C_{12}$ alkyl groups).

These alkyl groups may be straight chain or branched. Alcohols used in the ZDDP can be propanol, 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be utilized. Alkyl aryl groups may also be used.

Exemplary zinc dithiophosphates that are commercially available include secondary zinc dithiophosphates, such as those available from for example, The Lubrizol Corporation under the trade designations "LZ 677A", "LZ 1095" and "LZ 1371", from for example Chevron Oronite under the trade designation "OLOA 262", and from for example Afton Chemical under the trade designation "HITEC 7169".

ZDDP may be used in amounts of from about zero to about 3 weight percent (e.g. from about 0.05 weight percent to about 2 weight percent, from about 0.1 weight percent to about 1.5 weight percent, or from about 0.1 weight percent to about 1 weight percent) based on the total weight of the composition of the present disclosure, although more or less can often be used advantageously. A secondary ZDDP may be present in an amount of from zero to about 1 weight percent of the total weight of the composition of the present disclosure.

Extreme Pressure Agent(s). In any aspect or embodiment described herein, the composition of the present disclosure comprises at least one (e.g., 1, 2, 3, or 4, or more) extreme pressure agent. Any extreme pressure agent that is known or that becomes know may be utilized in the composition of the present disclosure.

The extreme pressure agents can be at least one sulfur-based extreme pressure agents, such as sulfides, sulfoxides, sulfones, thiophosphinates, thiocarbonates, sulfurized fats and oils, sulfurized olefins, the like, or combinations thereof; at least one phosphorus-based extreme pressure agents, such as phosphoric acid esters (e.g., tricresyl phosphate (TCP) and the like), phosphorous acid esters, phosphoric acid ester amine salts, phosphorous acid ester amine salts, the like, or combinations thereof; halogen-based extreme pressure agents, such as chlorinated hydrocarbons, the like, or combinations thereof; organometallic extreme pressure agents, such as thiophosphoric acid salts (e.g., zinc dithiophosphate (ZnDTP) and the like), thiocarbamic acid salts, or combinations thereof; and the like.

The phosphoric acid ester, thiophosphoric acid ester, and amine salts thereof functions to enhance the lubricating performances, and can be selected from known compounds conventionally employed as extreme pressure agents. For example, phosphoric acid esters, a thiophosphoric acid ester, or an amine salt thereof which has an alkyl group, an alkenyl group, an alkylaryl group, or an aralkyl group, any of which contains approximately 3 to 30 carbon atoms, may be employed.

Examples of the phosphoric acid esters include aliphatic phosphoric acid esters such as triisopropyl phosphate, tributyl phosphate, ethyl dibutyl phosphate, trihexyl phosphate, tri-2-ethylhexyl phosphate, trilauryl phosphate, tristearyl phosphate, and trioleyl phosphate; and aromatic phosphoric acid esters such as benzyl phenyl phosphate, allyl diphenyl phosphate, triphenyl phosphate, tricresyl phosphate, ethyl diphenyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, and tributylphenyl phosphate. In an embodiment, the phosphoric acid ester is a trialkylphenyl phosphate.

Examples of the thiophosphoric acid esters include aliphatic thiophosphoric acid esters such as triisopropyl thiophosphate, tributyl thiophosphate, ethyl dibutyl thiophosphate, trihexyl thiophosphate, tri-2-ethylhexyl thiophosphate, trilauryl thiophosphate, tristearyl thiophosphate, and trioleyl thiophosphate; and aromatic thiophosphoric acid esters such as benzyl phenyl thiophosphate, allyl diphenyl thiophosphate, triphenyl thiophosphate, tricresyl thiophosphate, ethyl diphenyl thiophosphate, cresyl diphenyl thiophosphate, dicresyl phenyl thiophosphate, ethylphenyl diphenyl thiophosphate, diethylphenyl phenyl thiophosphate, propylphenyl diphenyl thiophosphate, dipropylphenyl phenyl thiophosphate, triethylphenyl thiophosphate, tripropylphenyl thiophosphate, butylphenyl diphenyl thiophosphate, dibutylphenyl phenyl thiophosphate, and tributylphenyl thiophosphate. In an embodiment, the thiophosphoric acid ester is a trialkylphenyl thiophosphate.

Also employable are amine salts of the above-mentioned phosphates and thiophosphates. Amine salts of acidic alkyl or aryl esters of the phosphoric acid and thiophosphoric acid are also employable. In an embodiment, the amine salt is an amine salt of trialkylphenyl phosphate or an amine salt of alkyl phosphate.

One or any combination of the compounds selected from the group consisting of a phosphoric acid ester, a thiophosphoric acid ester, and an amine salt thereof may be used.

The phosphorus acid ester and/or its amine salt function to enhance the lubricating performance of the composition, and can be selected from known compounds conventionally employed as extreme pressure agents. For example, the extreme pressure agent can be a phosphorus acid ester or an amine salt thereof, which has an alkyl group, an alkenyl group, an alkylaryl group, or an aralkyl group, any of which contains approximately 3 to 30 carbon atoms.

Examples of phosphorus acid esters that may be used includes aliphatic phosphorus acid esters, such as triisopropyl phosphite, tributyl phosphite, ethyl dibutyl phosphite, trihexyl phosphite, tri-2-ethylhexylphosphite, trilauryl phosphite, tristearyl phosphite, and trioleyl phosphite; and aromatic phosphorus acid esters such as benzyl phenyl phosphite, allyl diphenylphosphite, triphenyl phosphite, tricresyl phosphite, ethyl diphenyl phosphite, tributyl phosphite, ethyl dibutyl phosphite, cresyl diphenyl phosphite, dicresyl phenyl phosphite, ethylphenyl diphenyl phosphite, diethylphenyl phenyl phosphite, propylphenyl diphenyl phosphite, dipropylphenyl phenyl phosphite, triethylphenyl phosphite, tripropylphenyl phosphite, butylphenyl diphenyl phosphite, dibutylphenyl phenyl phosphite, and tributylphenyl phosphite. Also favorably employed are dilauryl phosphite, dioleyl phosphite, dialkyl phosphites, and diphenyl phosphite. In certain embodiments, the phosphorus acid ester is a dialkyl phosphite or a trialkyl phosphite.

The phosphate salt may be derived from a polyamine, such as alkoxylated diamines, fatty polyamine diamines, alkylenepolyamines, hydroxy containing polyamines, condensed polyamines arylpolyamines, and heterocyclic polyamines. Examples of these amines include Ethoduomeen T/13 and T/20, which are ethylene oxide condensation products of N-tallowtrimethylenediamine containing 3 and 10 moles of ethylene oxide per mole of diamine, respectively.

In another embodiment, the polyamine is a fatty diamine. The fatty diamine may include mono- or dialkyl, symmetrical or asymmetrical ethylene diamines, propane diamines (1,2 or 1,3), and polyamine analogs of the above. Suitable commercial fatty polyamines are Duomeen C (N-coco-1,3-diaminopropane), Duomeen S (N-soya-1,3-diaminopropane), Duomeen T (N-tallow-1,3-diaminopropane), and Duomeen 0 (N-oleyl-1,3-diaminopropane). "Duomeens" are commercially available from Armak Chemical Co., Chicago, Ill.

Such alkylenepolyamines include methylenepolyamines, ethylenepolyamines, butylenepolyamines, propylenepolyamines, pentylenepolyamines, etc. The higher homologs and related heterocyclic amines, such as piperazines and N-amino alkyl-substituted piperazines, are also included. Specific examples of such polyamines are ethylenediamine, triethylenetetramine, tris-(2-aminoethyl)amine, propylenediamine, trimethylenediamine, tripropylenetetramine, tetraethylenepentamine, hexaethyleneheptamine, pentaethylenehexamine, etc. Higher homologs obtained by condensing two or more of the above-noted alkyleneamines are similarly useful as are mixtures of two or more of the aforedescribed polyamines.

In one embodiment the polyamine is an ethylenepolyamine. Such polyamines are described in detail under the heading Ethylene Amines in Kirk Othmer's "Encyclopedia of Chemical Technology", 2nd Edition, Vol. 7, pages 22-37, Interscience Publishers, New York (1965). Ethylenepolyamines can be a complex mixture of polyalkylenepolyamines, including cyclic condensation products.

Other useful types of polyamine mixtures are those resulting from stripping of the above-described polyamine mixtures to leave, as residue, what is often termed "polyamine bottoms". The alkylenepolyamine bottoms can be characterized as having less than 2%, usually less than 1% (by weight) material boiling below about 200° C. An exemplary sample of such ethylene polyamine bottoms obtained from the Dow Chemical Company of Freeport, Tex. designated "E-100". These alkylenepolyamine bottoms include cyclic condensation products, such as piperazine, and higher analogs of diethylenetriamine, triethylenetetramine and the like. These alkylenepolyamine bottoms can be reacted solely with the acylating agent or they can be used with other amines, polyamines, or mixtures thereof. Another useful polyamine is a condensation reaction between at least one hydroxy compound with at least one polyamine reactant containing at least one primary or secondary amino group. In an embodiment, the hydroxy compounds are alcohols and amines. The polyhydric alcohols are described below. In one embodiment, the hydroxy compounds are polyhydric amines. Polyhydric amines include any of the above-described monoamines reacted with an alkylene oxide (e.g., ethylene oxide, propylene oxide, butylene oxide, etc.) having from two to about 20 carbon atoms, or from two to about four. Examples of polyhydric amines include tri-(hydroxypropyl)amine, tris-(hydroxymethyl)amino methane, 2-amino-2-methyl-1, 3-propanediol, N,N,N',N'-tetrakis(2-hydroxypropyl)ethylenediamine, and N,N,N',N'-tetrakis(2-hydroxyethyl)ethylenediamine. In an embodiment, the polyhydric amin is tris(hydroxymethyl)aminomethane (THAM).

Polyamines which react with the polyhydric alcohol or amine to form the condensation products or condensed amines, are described above. In an embodiment, the polyamine include at least one of triethylenetetramine (TETA), tetraethylenepentamine (TEPA), pentaethylenehexamine (PEHA), and mixtures of polyamines, such as the above-described "amine bottoms".

In some embodiments, the extreme pressure additive or additives includes sulphur-based extreme pressure additives, such as dialkyl sulphides, dibenzyl sulphide, dialkyl polysulphides, dibenzyl disulphide, alkyl mercaptans, dibenzothiophene, 2,2'-dithiobis(benzothiazole), or combinations thereof; phosphorus-based extreme pressure additives, such as trialkyl phosphates, triaryl phosphates, trialkyl phosphonates, trialkyl phosphites, triaryl phosphites, dialkylhydrozine phosphites, or combinations thereof; and/or phosphorus- and sulphur-based extreme pressure additives, such as zinc dialkyldithiophosphates, dialkylthiophosphoric acid, trialkyl thiophosphate esters, acidic thiophosphate esters, trialkyl trithiophosphates, or combinations thereof. Extreme pressure additives can be used individually or in the form of mixtures, conveniently in an amount within the range from zero to about 2% by weight of the composition of the present disclosure.

Dispersant(s). In any aspect or embodiment described herein, the composition of the present disclosure comprises at least one (e.g., 1, 2, 3, or 4, or more) dispersant. During machine operation, oil-insoluble oxidation byproducts are produced. The dispersant may be added to help keep these byproducts in solution, thus diminishing their deposition on metal surfaces. Dispersants may also be used to improve the emulsion characteristics of the mixture of oil, water and dissolved or suspended species, before and during the reaction stage to form the grease thickener. This can favorably affect the size and distribution of the particles of soaps, complexing agents and non-soap thickeners. The use of dispersants can also serve to control, reduce, or eliminate foaming of the mixture during the initial mixing stage, during the reaction stages (to form the thickener and complexing molecules), and during the dehydration stage (for those thickeners that form water or alcohols as a reaction product, or require water as a carrier fluid, solvent or reaction medium).

Any dispersant that is known or that becomes known may be utilized in the composition of the present disclosure. The dispersant may be present in an amount of about 1.5 wt. %, about 1.25 wt. %, or about 1 wt. %. For example, the dispersant may be present in an amount of about 0.1 to about 1.5 wt. %, about 0.1 to about 1.25 wt. %, about 0.1 to about 1 wt. %, about 0.1 to about 0.5 wt. %, about 0.25 to about 1.5 wt. %, about 0.25 to about 1.25 wt. %, about 0.5 to about 1 wt. %, about 0.5 to about 1.5 wt. %, about 0.5 to about 1.25 wt. %, about 0.5 to about 1 wt. %, about 0.75 to about 1.5 wt. %, about 0.75 to about 1.25 wt. %, or about 1 to about 1.5 wt. %.

In some embodiments, the dispersants is ashless or ash-forming in nature. In an embodiment, the dispersant is an ashless. So called ashless are organic materials that form substantially no ash upon combustion. For example, non-metal-containing or borated metal-free dispersants are considered ashless. In contrast, metal-containing detergents form ash upon combustion.

Suitable dispersants may contain a polar group attached to a relatively high molecular weight hydrocarbon chain (e.g., about 50 to about 400 carbon atoms). In certain embodiments, the polar group contains at least one element of nitrogen, oxygen, or phosphorus.

A particularly useful class of dispersants are the (poly) alkenylsuccinic derivatives, which may be produced by the reaction of a long chain hydrocarbyl substituted succinic compound, e.g. a hydrocarbyl substituted succinic anhydride, with a polyhydroxy or polyamino compound. The long chain hydrocarbyl group constituting the oleophilic portion of the molecule, which confers solubility in the oil, is normally a polyisobutylene group. Many examples of this type of dispersant are well known commercially and in the literature. Exemplary U.S. patents describing such dispersants are U.S. Pat. Nos. 3,172,892; 3,215,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid compound (e.g., a hydrocarbon-substituted succinic acid compound having at least 50 carbon atoms in the hydrocarbon substituent) with at least one equivalent of an alkylene amine are particularly useful.

Succinimides are formed by the condensation reaction between hydrocarbyl substituted succinic anhydrides and amines. Molar ratios can vary depending on the polyamine. For example, the molar ratio of hydrocarbyl substituted succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters may be formed by the condensation reaction between hydrocarbyl substituted succinic anhydrides and alcohols or polyols. Molar ratios can vary depending on the alcohol or polyol used. For example, the condensation product of a hydrocarbyl substituted succinic anhydride and pentaerythritol is a useful dispersant.

Succinate ester amides may be formed by condensation reaction between hydrocarbyl substituted succinic anhydrides and alkanol amines. For example, suitable alkanol amines include ethoxylated polyalkylpolyamines, propoxylated polyalkylpolyamines and polyalkenylpolyamines, such as polyethylene polyamines. One example is propoxylated hexamethylenediamine. Representative examples are shown in U.S. Pat. No. 4,426,305.

The molecular weight of the hydrocarbyl substituted succinic anhydrides used in the preceding paragraphs can range between about 800 and about 2,500 or more. The above products can be post-reacted with various reagents such as sulfur, oxygen, formaldehyde, carboxylic acids, such as oleic acid. The above products can also be post reacted with boron compounds, such as boric acid, borate esters or highly borated dispersants, to form borated dispersants, which may have from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols may range from about 800 to about 2,500. Representative examples are shown in U.S. Pat. Nos. 3,697,574; 3,703,536; 3,704,308; 3,751,365; 3,756,953; 3,798,165; and 3,803,039.

High molecular weight aliphatic acid modified Mannich condensation products useful in this disclosure can be prepared from high molecular weight alkyl-substituted hydroxyaromatics or $HNR_2$ group-containing reactants, wherein each R is independently selected from hydrogen, C1-C18 alkyl, aryl, alkenyl, alkaryl group.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

In certain embodiments, the dispersants include borated and/or non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000, or from about 1000 to about 3000, or about 1000 to about 2000, or a mixture of such hydrocarbylene groups, often with high terminal vinylic groups. Other dispersants include succinic acid-esters and amides, alkylphenol-polyamine-coupled Mannich adducts, their capped derivatives, and other related components.

Polymethacrylate or polyacrylate derivatives are another class of dispersants. These dispersants may be prepared by reacting a nitrogen containing monomer and a methacrylic or acrylic acid esters containing about 5 to about 25 carbon atoms in the ester group. Representative examples are shown in U.S. Pat. Nos. 2,100,993, and 6,323,164.

Polymethacrylate and polyacrylate dispersants may be used as multifunctional viscosity modifiers. The lower molecular weight versions can be used as lubricant dispersants or fuel detergents.

Illustrative dispersants useful in this disclosure include those derived from polyalkenyl-substituted mono- or dicarboxylic acid, anhydride or ester, wherein the polyalkenyl moiety has an average molecular weight of at least about 900 and from greater than 1.3 to 1.7 (e.g. from greater than 1.3 to 1.6 or from greater than 1.3 to 1.5) functional groups (mono- or dicarboxylic acid producing moieties) per polyalkenyl moiety (a medium functionality dispersant). Functionality (F) can be determined according to the following formula:

$$F=(SAP\times Mn)/((112{,}200\times A.I.)-(SAP\times 98)),$$

wherein: SAP is the saponification number (i.e., the number of milligrams of KOH consumed in the complete neutralization of the acid groups in one gram of the succinic-containing reaction product, as determined according to ASTM D94); Mn is the number average molecular weight of the starting olefin polymer; and A.I. is the percent active ingredient of the succinic-containing reaction product (the remainder being unreacted olefin polymer, succinic anhydride and diluent).

The polyalkenyl moiety of the dispersant may have a number average molecular weight of at least about 900 or suitably at least about 1500, such as between about 1800 and about 3000 (e.g. between about 2000 and about 2800, from about 2100 to about 2500, or from about 2200 to about 2400). The molecular weight of a dispersant is generally expressed in terms of the molecular weight of the polyalkenyl moiety. This is because the precise molecular weight range of the dispersant depends on numerous parameters including the type of polymer used to derive the dispersant, the number of functional groups, and the type of nucleophilic group employed.

Polymer molecular weight, specifically Mn, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (e.g., ASTM D3592).

In an embodiment, the polyalkenyl moiety in a dispersant has a narrow molecular weight distribution (MWD), also referred to as polydispersity, as determined by the ratio of weight average molecular weight (Mw) to number average molecular weight (Mn). Polymers having a Mw/Mn of less than 2.2 (e.g. less than 2.0) are most desirable. Suitable polymers have a polydispersity of from about 1.5 to 2.1 (e.g. from about 1.6 to about 1.8).

Suitable polyalkenes employed in the formation of the dispersants include homopolymers, interpolymers or lower molecular weight hydrocarbons. One family of such polymers comprise polymers of ethylene and/or at least one C3 to C26 alpha-olefin having the formula:

$$H_2C{=}CHR^6,$$

wherein $R^6$ is a straight or branched chain alkyl radical comprising 1 to 26 carbon atoms and wherein the polymer contains carbon-to-carbon unsaturation, and a high degree of terminal ethenylidene unsaturation. In an embodiment, such polymers comprise interpolymers of ethylene and at least one alpha-olefin of the above formula, wherein $R^6$ is alkyl of from 1 to 18 carbon atoms (e.g. from 1 to 8 carbon atoms or from 1 to 2 carbon atoms).

Another useful class of polymers is polymers prepared by cationic polymerization of monomers such as isobutene and styrene. For example, the polymer(s) can be polyisobutenes obtained by polymerization of a $C_4$ refinery stream having a butene content of 35 to 75% by wt., and an isobutene content of 30 to 60% by wt. Petroleum feestreams, such as Raffinate II, can be a source of monomer for making poly-n-butenes. These feedstocks are disclosed in the art such as in U.S. Pat. No. 4,952,739. Certain embodiments utilize polyisobutylene prepared from a pure isobutylene stream or a Raffinate I stream to prepare reactive isobutylene polymers with terminal vinylidene olefins. Polyisobutene polymers that may be employed may be based on a polymer chain of from about 1500 to about 3000.

In yet further embodiments, the dispersant(s) are non-polymeric (e.g., mono- or bis-succinimides). Such dispersants can be prepared by conventional processes, such as those disclosed in U.S. Patent Application Publication No. 2008/0020950, the disclosure of which is incorporated herein by reference.

The dispersant(s) can be borated by conventional means, as generally disclosed in U.S. Pat. Nos. 3,087,936, 3,254,025 and 5,430,105.

Dispersants may be used in an amount of zero to about 10 weight percent or about 0.01 to about 8 weight percent (e.g. about 0.1 to about 5 weight percent or about 0.5 to about 3 weight percent). Or such dispersants may be used in an amount of zero to about 8 weight percent (e.g. about 0.01 to about 5 weight percent or about 0.1 to about 3 weight percent). On an active ingredient basis, such additives may be used in an amount of zero to about 10 weight percent (e.g., about 0.3 to about 3 weight percent). The hydrocarbon portion of the dispersant atoms can range from about $C_{60}$ to about $C_{1000}$, or from about $C_{70}$ to about $C_{300}$, or from about $C_{70}$ to about $C_{200}$. These dispersants may contain both neutral and basic nitrogen, and mixtures thereof. Dispersants can be end-capped by borates and/or cyclic carbonates. Nitrogen content in the finished oil can vary from about zero to about 2000 ppm by weight (e.g. from about 100 ppm by weight to about 1200 ppm by weight). Basic nitrogen can vary from about zero to about 1000 ppm by weight (e.g. from about 100 ppm by weight to about 600 ppm by weight).

Dispersants as described herein are beneficially useful with the compositions of the present disclosure. Further, in one embodiment, preparation of the compositions of the present disclosure using one or more (e.g. 1, 2, 3, 4, or more) dispersants is achieved by combining ingredients of the present disclosure, plus optional base stocks and lubricant additives, in a mixture at a temperature above the melting point of such ingredients, particularly that of the one or more M-carboxylates (M=H, metal, two or more metals, mixtures thereof).

As used herein, the dispersant concentrations are given on an "as delivered" basis. The active dispersant may be delivered with a process oil. The "as delivered" dispersant may contain from about 20 weight percent to about 80 weight percent, or from about 40 weight percent to about 60 weight percent, of active dispersant in the "as delivered" dispersant product.

Friction Modifier(s). In any aspect or embodiment described herein, the composition of the present disclosure comprises at least one (e.g., 1, 2, 3, or 4, or more) friction modifier. A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure. Any friction modifier that is known or that becomes know may be utilized in the composition of the present disclosure.

Friction modifiers may include, for example, organometallic compounds or materials, or mixtures thereof. Illustrative organometallic friction modifiers useful in the lubricating turbine oil formulations of this disclosure include, for example, molybdenum amine, molybdenum diamine, an organotungstenate, a molybdenum dithiocarbamate, molybdenum dithiophosphates, molybdenum amine complexes, molybdenum carboxylates, and the like, and mixtures thereof. In an embodiment, tungsten-based compounds are utilized.

Other illustrative friction modifiers useful in the lubricating formulations of the present disclosure include, for example, alkoxylated fatty acid esters, alkanolamides, polyol fatty acid esters, borated glycerol fatty acid esters, fatty alcohol ethers, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monostearate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. In certain embodiments, the friction modifier is glycerol mono-oleates, glycerol dioleates, glycerol trioleates, glycerol monostearates, glycerol distearates, and glycerol tristearates and the corresponding glycerol monopalmitates, glycerol dipalmitates, glycerol tripalmitates, or the respective isostearates, linoleates, and the like, or combinations thereof. In an embodiment, the friction modifier is a glycerol esters or mixtures containing any of these. Ethoxylated, propoxylated, butoxylated fatty acid esters of polyols, especially using glycerol as underlying polyol can be utilized.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can be, e.g., stearyl, myristyl, $C_{11}$-$C_{13}$ hydrocarbon, oleyl, isosteryl, and the like.

Other friction modifiers could be optionally included in addition to the fatty phosphites and fatty imidazolines. A useful list of such other friction modifier additives is included in U.S. Pat. No. 4,792,410. U.S. Pat. No. 5,110,488 discloses metal salts of fatty acids and especially zinc salts, useful as friction modifiers. Fatty acids are also useful friction modifiers. A list of other suitable friction modifiers includes at least one of: (i) fatty phosphonates; (ii) fatty acid amides; (iii) fatty epoxides; (iv) borated fatty epoxides; (v) fatty amines; (vi) glycerol esters; (vii) borated glycerol esters; (viii) alkoxylated fatty amines; (ix) borated alkoxylated fatty amines; (x) metal salts of fatty acids; (xi) sulfurized olefins; (xii) condensation products of carboxylic acids or equivalents and polyalkylene-polyamines; (xiii) metal salts of alkyl salicylates; (xiv) amine salts of alkylphosphoric acids; (xv) fatty esters; (xvi) condensation products of carboxylic acids; or equivalents with polyols and mixtures thereof.

Representatives of each of these types of friction modifiers are known and are commercially available. For instance, (i) includes components of the formulas:

$(RO)_2PHO$, $(RO)(HO)PHO$, and $P(OR)(OR)(OR)$, wherein, in these structures, the each "R" is conventionally referred to as an alkyl group, but may also be hydrogen. It is, of course, possible that the alkyl group is actually alkenyl and thus the terms "alkyl" and "alkylated," as used herein, will embrace other than saturated alkyl groups within the component. The component should have sufficient hydrocarbyl groups to render it substantially oleophilic. In some embodiments, the hydrocarbyl groups are substantially unbranched. Many suitable such components are available commercially and may be synthesized as described in U.S. Pat. No. 4,752,416. In some embodiments, the component contains 8 to 24 carbon atoms in each of the R groups. In other embodiments, the component may be a fatty phosphite containing 12 to 22 carbon atoms in each of the fatty radicals, or 16 to 20 carbon atoms. In one embodiment the fatty phosphite can be formed from oleyl groups, thus having 18 carbon atoms in each fatty radical.

The (iv) borated fatty epoxides are known from Canadian Patent No. 1,188,704. These oil-soluble boron-containing compositions are prepared by reacting, at a temperature from 80° C. to 250° C., boric acid or boron trioxide with at least one fatty epoxide having the formula:

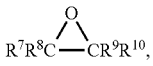

wherein each of $R^7$, $R^8$, $R^9$ and $R^{10}$ is independently hydrogen or an aliphatic radical, or any two thereof together with the epoxy carbon atom or atoms to which they are attached, form a cyclic radical. In an embodiment, the fatty epoxide contains at least 8 carbon atoms.

The borated fatty epoxides can be characterized by the method for their preparation which involves the reaction of two materials. Reagent A can be boron trioxide or any of the various forms of boric acid including metaboric acid ($HBO_2$), orthoboric acid ($H_3BO_3$) and tetraboric acid ($H_2B_{407}$). In an embodiment, Reagent A is boric acid, such as orthoboric acid. Reagent B can be at least one fatty epoxide having the above formula. In the formula, each of the R groups is most often hydrogen or an aliphatic radical with at least one being a hydrocarbyl or aliphatic radical containing at least 6 carbon atoms. The molar ratio of reagent A to reagent B may be about 1:0.25 to about 1:4 (e.g. about 1:1 to about 1:3 or about 1:2). The borated fatty epoxides can be prepared by merely blending the two reagents and heating them at temperature of about 80° C. to about 250° C., such as about 100° C. to about 200° C., for a period of time sufficient for reaction to take place. If desired, the reaction may be effected in the presence of a substantially inert, normally liquid organic diluent. During the reaction, water is evolved and may be removed by distillation.

The (iii) non-borated fatty epoxides, corresponding to Reagent B above, are also useful as friction modifiers.

Borated amines are generally known from U.S. Pat. No. 4,622,158. Borated amine friction modifiers (including (ix) borated alkoxylated fatty amines) can be prepared by the reaction of a boron compounds, as described above, with the corresponding amines. The amine can be a simple fatty amine or hydroxy containing tertiary amines. The borated amines can be prepared by adding the boron reactant, as described above, to an amine reactant and heating the resulting mixture at about 50° C. to about 300° C. (e.g. about 100° C. to about 250° C. or about 130° C. to about 180° C.) with stirring. The reaction is continued until by-product water ceases to evolve from the reaction mixture indicating completion of the reaction.

Among the amines useful in preparing the borated amines are commercial alkoxylated fatty amines known by the trademark "ETHOMEEN" and available from Akzo Nobel. Representative examples of these ETHOMEEN™ materials is ETHOMEEN™ C/12 (bis[2-hydroxyethyl]coco-amine); ETHOMEEN™ C/20 (polyoxyethylene [10]cocoamine); ETHOMEEN™ S/12 (bis[2-hydroxyethyl] soyamine); ETHOMEEN™ T/12 (bis[2-hydroxyethyl]-tallow-amine); ETHOMEEN™ T/15 (polyoxyethylene-[5]tallowamine); ETHOMEEN™ 0/12 (bis[2-hydroxyethyl]oleyl-amine); ETHOMEEN™ 18/12 (bis[2-hydroxyethyl] octadecylamine); and ETHOMEEN™ 18/25 (polyoxyethylene[15] octadecylamine). Fatty amines and ethoxylated fatty amines are also described in U.S. Pat. No. 4,741,848. Dihydroxyethyl tallowamine (commercially sold as ENT-12™) is included in these types of amines.

The (viii) alkoxylated fatty amines, and (v) fatty amines themselves (such as oleylamine and dihydroxyethyl tallowamine) may be useful as friction modifiers in this disclosure. Such amines are commercially available.

Both borated and unborated fatty acid esters of glycerol can be used as friction modifiers. The (vii) borated fatty acid esters of glycerol are prepared by borating a fatty acid ester of glycerol with boric acid with removal of the water of reaction. In an embodiment, there is sufficient boron present such that each boron will react with from 1.5 to 2.5 hydroxyl groups present in the reaction mixture. The reaction may be carried out at a temperature in the range of about 60° C. to about 135° C., in the absence or presence of any suitable organic solvent, such as methanol, benzene, xylenes, toluene, or oil.

The (vi) fatty acid esters of glycerol themselves can be prepared by a variety of methods well known in the art. Many of these esters, such as glycerol monooleate and glycerol tallowate, are manufactured on a commercial scale. In a particular embodiment, the esters are oil-soluble and prepared from C8 to C22 fatty acids or mixtures thereof, such as are found in natural products and as are described in greater detail below. In an embodiment, fatty acid monoesters of glycerol used, although, mixtures of mono- and diesters may be used. For example, commercial glycerol monooleate may contain a mixture of 45% to 55% by weight monoester and 55% to 45% diester.

Fatty acids can be used in preparing the above glycerol esters; they can also be used in preparing their (x) metal salts, (ii) amides, and (xii) imidazolines, any of which can also be used as friction modifiers. In an embodiment, the fatty acids are those containing 10 to 24 carbon atoms, such as those containing 12 to 18 carbon atoms. The acids can be branched or straight-chain, saturated or unsaturated. In some embodiments, the acids are straight-chain acids. In other embodiments, the acids are branched. Suitable acids include decanoic, oleic, stearic, isostearic, palmitic, myristic, palmitoleic, linoleic, lauric, and linolenic acids, and the acids from the natural products tallow, palm oil, olive oil, peanut oil, corn oil, coconut oil and Neat's foot oil. In certain embodiments, the acid is oleic acid. In other embodiments, the metal salts include zinc and calcium salts. Examples are overbased calcium salts and basic oleic acid-zinc salt complexes, such as zinc oleate, which can be represented by the formula $ZnOleate_6O_1$. In an embodiment, the amides are those prepared by condensation with ammonia or with primary or secondary amines such as ethylamine and diethanolamine. Fatty imidazolines are the cyclic condensation product of an acid with a diamine or polyamine, such as a polyethylenepolyamine. The imidazolines may be represented by the structure:

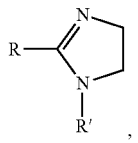

wherein: R is an alkyl group; and R' is hydrogen or a hydrocarbyl group or a substituted hydrocarbyl group, including —$(CH_2CH_2NH)_n$— groups, wherein n is an integer from 1 to 4. In an embodiment, the friction modifier is the condensation product of a C10 to C24 fatty acid with a polyalkylene polyamine, and in particular, the product of isostearic acid with tetraethylenepentamine.

The condensation products of carboxylic acids and polyalkyleneamines (xiii) may be imidazolines or amides. They may be derived from any of the carboxylic acids described above and any of the polyamines described herein.

Sulfurized olefins (xi) are well known commercial materials used as friction modifiers. A particularly sulfurized olefin utilized herein is one which is prepared in accordance with the detailed teachings of U.S. Pat. Nos. 4,957,651 and 4,959,168. Described therein is a co-sulfurized mixture of 2 or more reactants selected from the group consisting of (1) at least one fatty acid ester of a polyhydric alcohol, (2) at least one fatty acid, (3) at least one olefin, and (4) at least one fatty acid ester of a monohydric alcohol. Reactant (3), the olefin component, comprises at least one olefin. This olefin is may be an aliphatic olefin, which usually will contain 4 to 40 carbon atoms, e.g. from 8 to 36 carbon atoms. For example, terminal olefins, or alpha-olefins, including those having from 12 to 20 carbon atoms, may be utilized. Mixtures of these olefins are commercially available, and such mixtures are contemplated for use in this disclosure. The co-sulfurized mixture of two or more of the reactants, is prepared by reacting the mixture of appropriate reactants with a source of sulfur. The mixture to be sulfurized can contain about 10 to about 90 parts of Reactant (1), or about 0.1 to about 15 parts by weight of Reactant (2); or about 10 to about 90 parts (e.g. about 15 to about 60 parts or about 25 to about 35 parts) by weight of Reactant (3), or about 10 to about 90 parts by weight of reactant (4). The mixture, in the present disclosure, includes Reactant (3) and at least one other member of the group of reactants identified as Reactants (1), (2) and (4). The sulfurization reaction may be effected at an elevated temperature with agitation and optionally in an inert atmosphere and in the presence of an inert solvent. The sulfurizing agents useful in the process of the present disclosure include elemental sulfur, which maybe hydrogen sulfide, sulfur halide plus sodium sulfide, and a mixture of hydrogen sulfide and sulfur or sulfur dioxide. For example, about 0.5 to about 3 moles of sulfur are employed per mole of olefinic bonds. Sulfurized olefins may also include sulfurized oils, such as vegetable oil, lard oil, oleic acid and olefin mixtures.

Metal salts of alkyl salicylates (xiii) include calcium and other salts of long chain (e.g. C12 to C16) alkyl-substituted salicylic acids.

Amine salts of alkylphosphoric acids (xiv) include salts of oleyl and other long chain esters of phosphoric acid, with amines as described below. Useful amines in this regard are tertiary-aliphatic primary amines, sold under the tradename Primene™.

In some embodiments, the friction modifier is a fatty acid or fatty oil, a metal salt of a fatty acid, a fatty amide, a sulfurized fatty oil or fatty acid, an alkyl phosphate, an alkyl phosphate amine salt; a condensation product of a carboxylic acid and a polyamine, a borated fatty epoxide, a fatty imidazoline, or combinations thereof.

In other embodiments, the friction modifier may be the condensation product of isostearic acid and tetraethylene pentamine, the condensation product of isostearic acid and 1-[tris(hydroxymethyl)]methylamine, borated polytetradecyloxirane, zinc oleate, hydroxylethyl-2-heptadecenyl imidazoline, dioleyl hydrogen phosphate, C14-C18 alkyl phosphate or the amine salt thereof, sulfurized vegetable oil, sulfurized lard oil, sulfurized oleic acid, sulfurized olefins, oleyl amide, glycerol monooleate, soybean oil, or mixtures thereof.

In still other embodiments, the friction modifier may be glycerol monooleate, oleylamide, the reaction product of isostearic acid and 2-amino-2-hydroxymethyl-1,3-propanediol, sorbitan monooleate, 9-octadecenoic acid, isostearyl amide, isostearyl monooleate or combinations thereof.

Although their presence is not required to obtain the benefit of the present disclosure, friction modifiers may be present in an amount from zero to about 2 wt. % (e.g., about 0.01 wt. % to about 1.5 wt. %) of the composition of the present disclosure. These ranges may apply to the amounts of individual friction modifier present in the composition or to the total friction modifier component in the compositions, which may include a mixture of two or more friction modifiers.

Many friction modifiers tend to also act as emulsifiers. This is often due to the fact that friction modifiers often have non-polar fatty tails and polar head groups.

The composition of the present disclosure exhibit desired properties, e.g., wear control, in the presence or absence of a friction modifier.

Although their presence is not required to obtain the benefit of this disclosure, the friction modifier or friction modifiers may be present in an amount of about 0.01 weight percent to about 5 weight percent (e.g. about 0.1 weight percent to about 2.5 weight percent, or about 0.1 weight percent to about 1.5 weight percent, or about 0.1 weight percent to about 1 weight percent). Concentrations of molybdenum-containing materials are often described in terms of Mo metal concentration. Advantageous concentrations of Mo may range from about 25 ppm to about 700 ppm or more (e.g. about 50 to about 200 ppm). Friction modifiers of all types may be used alone or in mixtures with the materials of this disclosure. Often mixtures of two or more friction modifiers, or mixtures of friction modifier(s) with alternate surface active material(s), are also desirable.

Molybdenum-Containing Compounds (Friction Reducers). Illustrative molybdenum-containing friction reducers useful in the disclosure include, for example, an oil-soluble decomposable organo molybdenum compound, such as Molyvan™ 855 which is an oil soluble secondary diarylamine defined as substantially free of active phosphorus and active sulfur. The Molyvan™ 855 is described in Vanderbilt's Material Data and Safety Sheet as a organo molybdenum compound having a density of 1.04 and viscosity at 100° C. of 47.12 cSt. The organo molybdenum compounds may be useful because of their superior solubility and effectiveness.

Another illustrative molybdenum-containing compound is Molyvan™ L, which is sulfonated oxymolybdenum dialkyldithiophosphate described in U.S. Pat. No. 5,055,174 hereby incorporated by reference.

Molyvan™ A made by R. T. Vanderbilt Company, Inc., New York, N.Y., USA, is also an illustrative molybdenum-containing compound, which contains about 28.8 wt. % Mo, 31.6 wt. % C, 5.4 wt. % H., and 25.9 wt. % S. Also useful are Molyvan™ 855, Molyvan™ 822, Molyvan™ 856, and Molyvan™ 807.

Also useful is Sakura Lube™ 500, which is more soluble Mo dithiocarbamate containing lubricant additive obtained from Asahi Denki Corporation and comprised of about 20.2 wt. % Mo, 43.8 wt. % C, 7.4 wt. % H, and 22.4 wt. % S. Sakura Lube™ 525 is another useful soluble Mo dithiocarbamate, comprised of 10 wt % Mo and about 11 wt % S. Sakura Lube™ 300, a low sulfur molybdenum dithiophosphate having a molybdenum to sulfur ratio of 1:1.07, is a molybdenum-containing compound useful in this disclosure.

Also useful is Molyvan™ 807, a mixture of about 50 wt. % molybdenum ditridecyldithyocarbonate, and about 50 wt. % of an aromatic oil having a specific gravity of about 38.4 SUS and containing about 4.6 wt. % molybdenum, also manufactured by R. T. Vanderbilt and marketed as an antioxidant and antiwear additive.

Other sources are molybdenum Mo(Co)6, and molybdenum octoate, $MoO(C_7H_{15}CO_2)_2$ containing about 8 wt-% Mo marketed by Aldrich Chemical Company, Milwaukee, Wis. and molybdenum naphthenethioctoate marketed by Shephard Chemical Company, Cincinnati, Ohio.

Inorganic molybdenum compounds, such as molybdenum sulfide and molybdenum oxide, are substantially less preferred than the organic compounds as described in Molyvan™ 855, Molyvan™ 822, Molyvan™ 856, and Molyvan™ 807.

Illustrative molybdenum-containing compounds useful in this disclosure are disclosed, for example, in U.S. Patent Application Publication No. 2003/0119682, which is incorporated herein by reference.

Organo molybdenum-nitrogen complexes may also be included in the formulations of the present disclosure. The term "organo molybdenum nitrogen complexes" embraces the organo molybdenum nitrogen complexes described in U.S. Pat. No. 4,889,647. The complexes are reaction products of a fatty oil, dithanolamine and a molybdenum source. Specific chemical structures have not been assigned to the complexes. U.S. Pat. No. 4,889,647 reports an infrared spectrum for an exemplary reaction product of that disclosure; the spectrum identifies an ester carbonyl band at 1740 cm 1 and an amide carbonyl band at 1620 cm 1. The fatty oils are glyceryl esters of higher fatty acids containing at least 12 carbon atoms up to 22 carbon atoms or more. The molybdenum source is an oxygen-containing compound such as ammonium molybdates, molybdenum oxides and mixtures.

Other organo molybdenum complexes which can be used in the present disclosure are tri nuclear molybdenum sulfur compounds described in EP 1 040 115 and WO 99/31113, and the molybdenum complexes described in U.S. Pat. No. 4,978,464.

Although their presence is not required to obtain the benefit of the present disclosure, molybdenum-containing additives may be used in an amount of from zero to about 5.0 (e.g., .≤about 5, ≤about 4, ≤about 3, ≤about 2, or ≤about 1) percent by mass of the composition of the present disclosure. For example, the dosage may be up to about 3,000 ppm by mass, such as from about 100 ppm to about 2,500 ppm by mass, from about 300 to about 2,000 ppm by mass, or from about 300 to about 1,500 ppm by mass of molybdenum.

Borated Ester Compounds. In any aspect or embodiment described herein, the composition of the present disclosure comprises at least one (e.g., 1, 2, 3, or 4, or more) borated-ester compound. Illustrative boron-containing compounds useful in the disclosure include, for example, a borate ester, a boric acid, other boron compounds, such as a boron oxide. The boron compound is hydrolytically stable and is utilized for improved antiwear, and performs as a rust and corrosion inhibitor for copper bearings and other metal engine components. The borated ester compound acts as an inhibitor for corrosion of metal to prevent corrosion of either ferrous or non-ferrous metals (e.g. copper, bronze, brass, titanium, aluminum and the like) or both, present in concentrations in which they are effective in inhibiting corrosion.

Patents describing techniques for making basic salts of sulfonic, carboxylic acids and mixtures thereof include U.S. Pat. Nos. 5,354,485; 2,501,731; 2,616,911; 2,777,874; 3,384,585; 3,320,162; 3,488,284; and 3,629,109. The disclosures of these patents are incorporated herein by reference. Methods of preparing borated overbased compositions are found in U.S. Pat. Nos. 4,744,920; 4,792,410; and PCT publication WO 88/03144. The disclosures of these references are incorporated herein by reference. The oil-soluble neutral or basic salts of alkali or alkaline earth metals salts may also be reacted with a boron compound.

An illustrative borate ester utilized in this disclosure is manufactured by Exxon-Mobil USA under the product designation of ("MCP 1286") and MOBIL ADC700. Test data show the viscosity at 100° C. using the D-445 method is 2.9 cSt; the viscosity at 40° C. using the D-445 method is 11.9; the flash point using the D-93 method is 146; the pour point using the D-97 method is −69; and the percent boron as determined by the ICP method is 5.3%. The borated ester (Vanlube™ 289), which is marketed as an antiwear/antiscuff additive and friction reducer, is an exemplary borate ester useful in the disclosure.

An illustrative borate ester useful in this disclosure is the reaction product obtained by reacting about 1 mole fatty oil, about 1.0 to 2.5 moles diethanolamine followed by subsequent reaction with boric acid to yield about 0.1 to 3 percent boron by mass. It is believed that the reaction products may include one or both of the following two primary components, with the further listed components being possible components when the reaction is pushed toward full hydration:

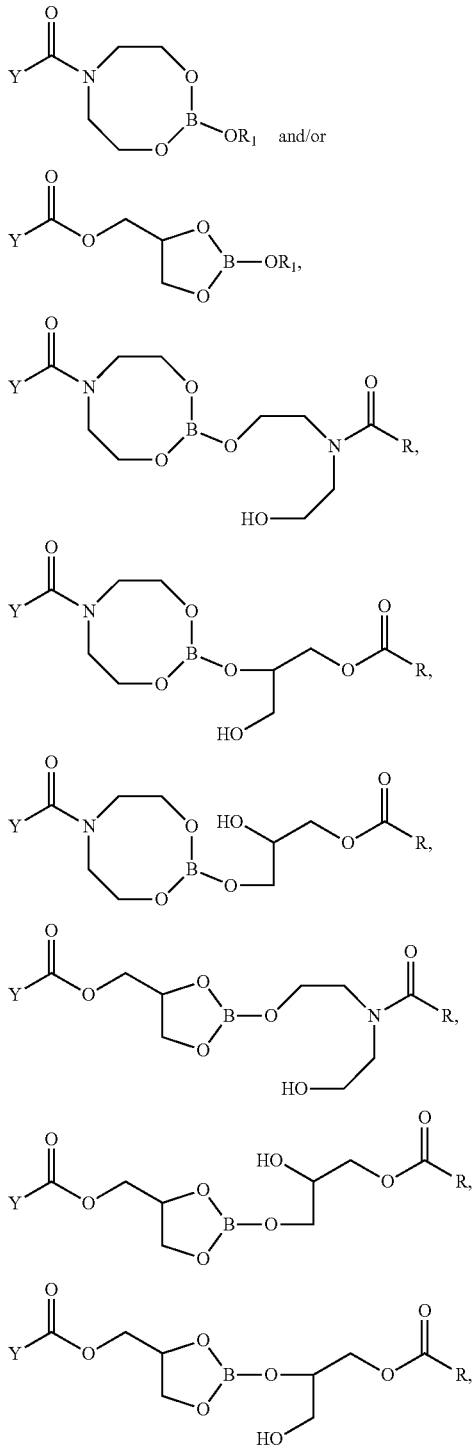

wherein: $R_1$ is H or $C_xH_y$, x is an integer from 1 to 60, and y is an integer from 3 to 121, Y represents a fatty oil residue. In an embodiment, the fatty oils are glyceryl esters of higher fatty acids containing at least 12 carbon atoms (e.g. 22 carbon atoms or more). Such esters are commonly known as vegetable and animal oils. Vegetable oils that may be used include oils derived from coconut, corn, cottonseed, linseed, peanut, soybean and sunflower seed. Similarly, animal fatty oils such as tallow may be used.

The source of boron is boric acid or materials that afford boron and are capable of reacting with the intermediate reaction product of fatty oil and diethanolamine to form a borate ester composition.

While the above organoborate ester composition is specifically discussed above, it should be understood that other organoborate ester compositions should also function with similar effect in the present disclosure, such as those set forth in U.S. Patent Application Publication No. 2003/0119682, which is incorporated herein by reference. In addition, dispersions of borate salts, such as potassium borate, may also be useful.

Other illustrative organoborate compositions useful in this disclosure are disclosed, for example, in U.S. Patent Application Publication No. 2008/0261838, which is incorporated herein by reference.

In addition, other illustrative oranoborate compositions useful in this disclosure are disclosed, for example, U.S. Pat. Nos. 4,478,732, 4,406,802, 4,568,472 on borated mixed hydroxyl esters, alkoxylated amides, and amines; U.S. Pat. No. 4,298,486 on borated hydroxyethyl imidazolines; U.S. Pat. No. 4,328,113 on borated alkyl amines and alkyl diamines; U.S. Pat. No. 4,370,248 on borated hydroxyl-containing esters, including GMO; U.S. Pat. No. 4,374,032 on borated hydroxyl-containing hydrocarbyl oxazolines; U.S. Pat. No. 4,376,712 on borated sorbitan esters; U.S. Pat. No. 4,382,006 on borated ethoxylated amines; U.S. Pat. No. 4,389,322 on ethoxylated amides and their borates; U.S. Pat. No. 4,472,289 on hydrocarbyl vicinal diols and alcohols and ester mixtures and their borates; U.S. Pat. No. 4,522,734 on borates of hydrolyzed hydrocarbyl epoxides; U.S. Pat. No. 4,537,692 on etherdiamine borates; U.S. Pat. No. 4,541,941 on mixtures containing vicinal diols and hydroxyl substituted esters and their borates; U.S. Pat. No. 4,594,171 on borated mixtures of various hydroxyl and/or nitrogen containing borates; and U.S. Pat. No. 4,692,257 on various borated alcohols/diols, all of which are incorporated herein by reference.

Although their presence is not required to obtain the benefit of this disclosure, boron-containing compounds may be present in an amount of from zero to about 10.0% percent (e.g. from about 0.01% to about 5% or from about 0.1% to about 3.0%) by weight of the composition of the present disclosure. An effective elemental boron range of up to about 1000 ppm or less than about 1% elemental boron. Thus, in an embodiment, a concentration of elemental boron is from about 100 to about 1000 ppm (e.g. from about 100 to about 300 ppm).

When the grease composition of the present disclosure includes one or more of the additives discussed herein, the additive(s) are blended into the composition in an amount sufficient for it to perform its intended function.

The weight percent (wt. %) indicated throughout the present Application is based on the total weight of the composition of the present disclosure. It is noted that many of the additives are shipped from the additive manufacturer as a concentrate, containing one or more additives together, with a certain amount of base oil diluents. Accordingly, the weight amounts mentioned herein are directed to the amount of active ingredient (that is the non-diluent portion of the ingredient).

Methods of Lubricating

An aspect of the present disclosure provides a method of lubricating. The method comprises applying the lubricating composition of the present disclosure to a surface in the need thereof.

For example, in any aspect or embodiment described herein, the surface in need of lubrication includes a gear, a chain, a track (such as a railroad track), a cable, a wire, a roller bearing, a metal plate, a journal bearing, an open bear box, a pump, a piston, or a combination thereof.

The invention of the present disclosure is further illustrated by the following examples which should not be construed as limiting. The data below demonstrates that the maximum operating temperature of the grease of the present disclosure is surprisingly increased relative to convention lithium complex greases. Those skilled in the art will recognize that the invention may be practiced with variations on the disclosed structures, materials, compositions and methods, and such variations are regarded as within the ambit of the invention.

EXAMPLES

The embodiments described above in addition to other embodiments can be further understood regarding the following examples.

Cone Penetration Determination. Determined according to ASTM D217-19b, which is described briefly below. The procedure for unworked, worked, and prolonged worked penetration is applicable to greases having penetrations between 85 and 475—i.e., greases with consistency numbers between NLGI 6 and NLGI 000.

Unworked Penetrations. The sample was brought to 25° C.±0.5° C. (77° F.±1° F.) using a temperature bath. The sample was then transferred with as little manipulation as possible into a worker cup (or other suitable container), if not placed there before the temperature stabilization step. The cone assembly of the penetrometer was released and allowed to drop freely into the grease for 5 seconds ±0.1 second. Three determinations were made and averaged to give the reported result.

Worked Penetration. The sample was brought to 25° C.±0.5° C. (77° F.±1° F.) and placed in the worker cup. The sample was subjected to 60 double strokes in the grease worker. The penetration was determined immediately by releasing the cone assembly from the penetrometer and allowing the cone to drop freely into the grease for 5 seconds ±0.1 seconds. Three determinations were made and averaged to give the reported result.

Prolonged Worked Penetration. The sample was placed in the worker cup and subjected to a predetermined number of double strokes in the grease worker. Following completion of the prolonged working, the grease and worker assembly were brought to 25° C.±0.5° C. (77° F.±1° F.) and the grease was worked at least an additional 10,000 double strokes (e.g., 10,000 double strokes, 25,000 double strokes, and/or 100,000 double strokes) in the grease worker. The penetration was determined immediately by releasing the cone assembly from the penetrometer and allowing the cone to drop freely into the grease for 5 seconds ±0.1 seconds. Three determinations were made and averaged to give the reported result.

Block Penetration. A cube of the grease was prepared by slicing off a thin layer using the grease cutter. The cube of grease was brought to 25° C.±0.5° C. (77° F.±1° F.) and placed on the penetrometer table with the prepared face upward. The penetration is determined by releasing the cone assembly from the penetrometer and allowing the cone to drop freely into the grease for 5 s:t 0.1 s. Three determinations are made and averaged to give the reported result.

Preparation of Exemplary Base Oil Thickener Soap. The following procedure was used to produce exemplary formulations of Tables 1-16.

1. TOFA, TOR, or modified TOFA (e.g. maleated TOFA, fumarated TOFA, and acrylated TOFA) was combined with Initial Base Oil (e.g., Group V base oil RAFFENE® 1200L, Group V base oil HYNAP® N100HTS, Group I based oil VP-100, Group II base oil EHC 45™, or Group III base oil VHVI-8) volume.
2. The mixture was heated to 71° C. to dissolve the acid components in the base oil.
3. A slurry of 5% excess metal base (i.e. lithium hydroxide) in water was added to the oil solution.
4. The mixture was heated to 85° C. and maintained at this temperature for 30 to promote thorough mixing of the acid and base.
5. The mixture was then heated to 121° C. and maintained at this temperature for 1 hour to complete the neutralization reaction, thus forming soap in lubricating oil.
6. The soap solution was dehydrated by heating to 210° C. for 30 minutes. Steps in A below were used to prepare soap greases formed with TOFA or TOR, and Steps in B below were utilized to prepare soap greases or complex soap greases formed with modified TOFA.

A. Preparing Simple Soap Greases Formulations.

1. The soap solution was slowly cooled to a safe temperature (below the base oil flash point) and slowly diluted with Let Down Base Oil.
2. The mixture was cooled to <82° C. and milled using a 3-roll mill.
3. Cone penetration of each sample (ASTM D217) was measured to determine the NLGI grade.
4. If the grade was too high, finishing base oil was mixed into the sample and the cone penetration was re-measured until the desired NLGI grade was obtained.

B. Preparing Soap Greases or Complex Soap Greases Formulations:

1. The soap solution was slowly cooled to 110° C., then heated back to 190° C. for 30 minutes.
2. The solution was then slowly cooled to a safe temperature (below the base oil flash point) and slowly diluted with Let Down base oil.
3. The mixture was cooled to <82° C. and milled using a 3-roll mill.
4. Cone penetration of each sample (ASTM D217-19b) was measured to determine the NLGI grade.
5. If the grade was too high, finishing base oil was mixed into the sample and penetration re-measured until desired NLGI grade was obtained.

Grease samples were milled by 3 passes on an Exakt 80 3-roll mill with rear gap set to 3 and front gap set to 1.5. Samples were diluted and remixed using an anchor style impeller attached to a mechanical stirrer and re-milled if not homogenous after mixing. Cone Penetration was measured using a Humboldt Digital Penetrometer (H-1240) using a standard grease cone (H-2520).

TABLE 6

12-Hydroxystearic acid as a standard simple soap grease (Standard 1)

| Component | Identity | CAS # | Mass (g) |
|---|---|---|---|
| Initial Base Oil | HYNAP ® N100HTS (San Joaquin Refining) | 64742-52-5 | 228.18 |
| Fatty Acid | 12-hydroxystearic acid | 106-14-9 | 81.16 |

TABLE 6-continued

| 12-Hydroxystearic acid as a standard simple soap grease (Standard 1) | | | |
|---|---|---|---|
| Component | Identity | CAS # | Mass (g) |
| Metal Base | Lithium hydroxide monohydrate | 1310-66-3 | 12.61 |
| Water | Deionized | — | 26.00 |
| Let Down Base Oil | HYNAP ® N100HTS (San Joaquin Refining) | 64742-52-5 | 228.23 |

TABLE 7

| 12-Hydroxystearic acid as a standard simple soap grease (Standard 2) | | | |
|---|---|---|---|
| Component | Identity | CAS # | Mass (g) |
| Initial Base Oil | HYNAP ® N100HTS (San Joaquin Refining) | 64742-52-5 | 304.68 |
| Fatty Acid | 12-hydroxystearic acid | 106-14-9 | 81.08 |
| Metal Base | Lithium hydroxide monohydrate | 1310-66-3 | 11.93 |
| Water | Deionized | — | 23.80 |
| Let Down Base Oil | HYNAP ® N100HTS (San Joaquin Refining) | 64742-52-5 | 152.75 |
| Finishing Base Oil | HYNAP ® N100HTS (San Joaquin Refining) | 64742-52-5 | 233.68 |

TABLE 8

| 12-Hydroxystearic acid and azelaic acid as a standard complex grease (Standard 3) | | | |
|---|---|---|---|
| Component | Identity | CAS # | Mass (g) |
| Initial Base Oil | HYNAP ® N100HTS (San Joaquin Refining) | 64742-52-5 | 226.94 |
| Fatty Acid | 12-hydroxystearic acid | 106-14-9 | 56.70 |
| Dibasic Acid | Azelaic acid | 123-99-9 | 24.30 |
| Metal Base | Lithium hydroxide monohydrate | 1310-66-3 | 14.70 |
| Water | Deionized | — | 29.40 |
| Let Down Base Oil | HYNAP ® N100HTS (San Joaquin Refining) | 64742-52-5 | 226.94 |
| Finishing Base Oil | HYNAP ® N100HTS (San Joaquin Refining) | 64742-52-5 | 111.17 |

TABLE 9

| 12-Hydroxystearic acid and azelaic acid as a standard complex grease (Standard 4) | | | |
|---|---|---|---|
| Component | Identity | CAS # | Mass (g) |
| Initial Base Oil | HYNAP ® N100HTS (San Joaquin Refining) | 64742-52-5 | 304.48 |
| Fatty Acid | 12-hydroxystearic acid | 106-14-9 | 66.45 |
| Dibasic Acid | Azelaic acid | 123-99-9 | 11.74 |
| Metal Base | Lithium hydroxide monohydrate | 1310-66-3 | 15.30 |
| Water | Deionized | — | 30.87 |
| Let Down Base Oil | HYNAP ® N100HTS (San Joaquin Refining) | 64742-52-5 | 152.05 |
| Finishing Base Oil | HYNAP ® N100HTS (San Joaquin Refining) | 64742-52-5 | 184.67 |

TABLE 10

| DIACID ® 1525 as a complex fatty acid grease (Example 1) | | | |
|---|---|---|---|
| Component | Identity | CAS # | Mass (g) |
| Initial Base Oil | HYNAP ® N100HTS (San Joaquin Refining) | 64742-52-5 | 295.02 |
| Complex Fatty Acid | DIACID ® 1525 (Ingevity Corporation) | 53980-88-4 | 91.50 |
| Metal Base | Lithium hydroxide monohydrate | 1310-66-3 | 16.80 |
| Water | Deionized | — | 33.60 |
| Let Down Base Oil | HYNAP ® N100HTS (San Joaquin Refining) | 64742-52-5 | 147.51 |
| Finishing Base Oil | HYNAP ® N100HTS (San Joaquin Refining) | 64742-52-5 | 99.78 |

TABLE 11

| DIACID ® 1525 as a complex fatty acid grease (Example 2) | | | |
|---|---|---|---|
| Component | Identity | CAS # | Mass (g) |
| Initial Base Oil | HYNAP ® N100HTS (San Joaquin Refining) | 64742-52-5 | 311.25 |
| Complex Fatty Acid | DIACID ® 1525 (Ingevity Corporation) | 53980-88-4 | 69.09 |
| Metal Base | Lithium hydroxide monohydrate | 1310-66-3 | 12.67 |
| Water | Deionized | — | 25.20 |
| Let Down Base Oil | HYNAP ® N100HTS (San Joaquin Refining) | 64742-52-5 | 155.94 |
| Finishing Base Oil | HYNAP ® N100HTS (San Joaquin Refining) | 64742-52-5 | 52.32 |

TABLE 12

| DIACID ® 1550 and Altapyne ® L-5 as a complex fatty acid grease (Example 3) | | | |
|---|---|---|---|
| Component | Identity | CAS # | Mass (g) |
| Initial Base Oil | HYNAP ® N100HTS (San Joaquin Refining) | 64742-52-5 | 218.61 |
| Complex Fatty Acid/Fatty Acid Mixture | DIACID ® 1550 (Ingevity Corporation) | 53980-88-4 | 64.32 |
| Fatty Acid | Altapyne ® L-5 (Ingevity Corporation) | 61790-12-3 | 31.76 |
| Metal Base | Lithium hydroxide monohydrate | 1310-66-3 | 19.54 |
| Water | Deionized | — | 38.59 |
| Let Down Base Oil | HYNAP ® N100HTS (San Joaquin Refining) | 64742-52-5 | 218.20 |

TABLE 13

| DIACID ® 1550 and Altapyne ® L-5 as a complex fatty acid grease (Example 4) | | | |
|---|---|---|---|
| Component | Identity | CAS # | Mass (g) |
| Initial Base Oil | HYNAP ® N100HTS (San Joaquin Refining) | 64742-52-5 | 306.48 |
| Complex Fatty Acid/Fatty Acid Mixture | DIACID ® 1550 (Ingevity Corporation) | 53980-88-4 | 50.86 |
| Fatty Acid | Altapyne ® L-5 (Ingevity Corporation) | 61790-12-3 | 24.86 |
| Metal Base | Lithium hydroxide monohydrate | 1310-66-3 | 14.47 |
| Water | Deionized | — | 29.11 |
| Let Down Base Oil | HYNAP ® N100HTS (San Joaquin Refining) | 64742-52-5 | 153.34 |
| Finishing Base Oil | HYNAP ® N100HTS (San Joaquin Refining) | 64742-52-5 | 26.86 |

TABLE 14

DIACID ® 1550 and Altapyne ® 128 as a complex fatty acid grease (Example 5)

| Component | Identity | CAS # | Mass (g) |
|---|---|---|---|
| Initial Base Oil | HYNAP ® N100HTS (San Joaquin Refining) | 64742-52-5 | 291.57 |
| Complex Fatty Acid/Fatty Acid Mixture | DIACID ® 1550 (Ingevity Corporation) | 53980-88-4 | 64.54 |
| Fatty Acid | Altapyne ® 128 (Ingevity Corporation) | 68955-98-6 | 31.71 |
| Metal Base | Lithium hydroxide monohydrate | 1310-66-3 | 18.31 |
| Water | Deionized | — | 36.81 |
| Let Down Base Oil | HYNAP ® N100HTS (San Joaquin Refining) | 64742-52-5 | 145.96 |
| Finishing Base Oil | HYNAP ® N100HTS (San Joaquin Refining) | 64742-52-5 | 209.41 |

TABLE 15

DIACID ® 1550 and Altapyne ® 128 as a complex fatty acid grease (Example 6)

| Component | Identity | CAS # | Mass (g) |
|---|---|---|---|
| Initial Base Oil | HYNAP ® N100HTS (San Joaquin Refining) | 64742-52-5 | 306.61 |
| Complex Fatty Acid/Fatty Acid Mixture | DIACID ® 1550 (Ingevity Corporation) | 53980-88-4 | 50.35 |
| Fatty Acid | Altapyne ® 128 (Ingevity Corporation) | 68955-98-6 | 24.90 |
| Metal Base | Lithium hydroxide monohydrate | 1310-66-3 | 14.32 |
| Water | Deionized | — | 28.61 |
| Let Down Base Oil | HYNAP ® N100HTS (San Joaquin Refining) | 64742-52-5 | 153.27 |
| Finishing Base Oil | HYNAP ® N100HTS (San Joaquin Refining) | 64742-52-5 | 25.29 |

TABLE 16

TENAX ® 2010 Feed and Altapyne ® 1483 as a complex fatty acid grease (Example 7)

| Component | Identity | CAS # | Mass (g) |
|---|---|---|---|
| Initial Base Oil | HYNAP ® N100HTS (San Joaquin Refining) | 64742-52-5 | 218.31 |
| Complex Fatty Acid/Fatty Acid Mixture | TENAX ® 2010 (Ingevity Corporation) | 53980-88-4 | 57.67 |
| Fatty Acid | Altapyne ® 1483 (Ingevity Corporation) | 61790-12-3 | 38.41 |
| Metal Base | Lithium hydroxide monohydrate | 1310-66-3 | 19.63 |
| Water | Deionized | — | 39.84 |
| Let Down Base Oil | HYNAP ® N100HTS (San Joaquin Refining) | 64742-52-5 | 218.15 |
| Finishing Base Oil | HYNAP ® N100HTS (San Joaquin Refining) | 64742-52-5 | 97.36 |

TABLE 17

TENAX ® 2010 Feed and Altapyne ® 128 as a complex fatty acid grease (Example 8)

| Component | Identity | CAS # | Mass (g) |
|---|---|---|---|
| Initial Base Oil | HYNAP ® N100HTS (San Joaquin Refining) | 64742-52-5 | 310.78 |
| Complex Fatty Acid/Fatty Acid Mixture | TENAX ® 2010 (Ingevity Corporation) | 53980-88-4 | 41.46 |

TABLE 17-continued

TENAX ® 2010 Feed and Altapyne ® 128 as a complex fatty acid grease (Example 8)

| Component | Identity | CAS # | Mass (g) |
|---|---|---|---|
| Fatty Acid | Altapyne ® 128 (Ingevity Corporation) | 68955-98-6 | 27.65 |
| Metal Base | Lithium hydroxide monohydrate | 1310-66-3 | 13.23 |
| Water | Deionized | — | 26.47 |
| Let Down Base Oil | HYNAP ® N100HTS (San Joaquin Refining) | 64742-52-5 | 155.43 |

TABLE 18

PolyEm C21 DIACID ® and Altapyne ® L-5 as a complex fatty acid grease (Example 9)

| Component | Identity | CAS # | Mass (g) |
|---|---|---|---|
| Initial Base Oil | HYNAP ® N100HTS (San Joaquin Refining) | 64742-52-5 | 306.27 |
| Complex Fatty Acid/Fatty Acid Mixture | C21 diacid (PolyEm) | 53980-88-4 | 50.37 |
| Fatty Acid | Altapyne ® L-5 (Ingevity Corporation) | 61790-12-3 | 24.93 |
| Metal Base | Lithium hydroxide monohydrate | 1310-66-3 | 14.69 |
| Water | Deionized | — | 29.37 |
| Let Down Base Oil | HYNAP ® N100HTS (San Joaquin Refining) | 64742-52-5 | 153.49 |
| Finishing Base Oil | HYNAP ® N100HTS (San Joaquin Refining) | 64742-52-5 | 78.20 |

TABLE 19

AltaVeg DIACID ® 1525 (Soy Based) as a complex fatty acid grease (Example 10)

| Component | Identity | CAS # | Mass (g) |
|---|---|---|---|
| Initial Base Oil | HYNAP ® N100HTS (San Joaquin Refining) | 64742-52-5 | 298.65 |
| Complex Fatty Acid/Fatty Acid Mixture | AltaVeg DIACID ® 1525 (Ingevity Corporation) | 53980-88-4 | 85.52 |
| Metal Base | Lithium hydroxide monohydrate | 1310-66-3 | 17.06 |
| Water | Deionized | — | 34.34 |
| Let Down Base Oil | HYNAP ® N100HTS (San Joaquin Refining) | 64742-52-5 | 149.70 |
| Finishing Base Oil | HYNAP ® N100HTS (San Joaquin Refining) | 64742-52-5 | 117.20 |

TABLE 20

AltaVeg DIACID ® 1525 (Soy Based) as a complex fatty acid grease (Example 11)

| Component | Identity | CAS # | Mass (g) |
|---|---|---|---|
| Initial Base Oil | HYNAP ® N100HTS (San Joaquin Refining) | 64742-52-5 | 279.53 |
| Complex Fatty Acid/Fatty Acid Mixture | AltaVeg DIACID ® 1525 (Ingevity Corporation) | 53980-88-4 | 114.02 |
| Metal Base | Calcium hydroxide | 1305-62-0 | 20.02 |
| Water | Deionized | — | 40 |

TABLE 21

12-Hydroxystearate acid as a standard simple soap grease (Standard 5)

| Component | Identity | CAS # | Mass (g) |
|---|---|---|---|
| Initial Base Oil | RAFFENE ® 1200L (San Joaquin Refining) | 64741-96-4 64742-52-5 | 327.45 |
| Fatty Acid | 12-hydroxystearic acid | 106-14-9 | 49.54 |
| Metal Base | Lithium hydroxide monohydrate | 1310-66-3 | 7.26 |
| Water | Deionized | — | 14.70 |
| Let Down Base Oil | RAFFENE ® 1200L (San Joaquin Refining) | 64741-96-4 64742-52-5 | 163.44 |
| Finishing Base Oil | RAFFENE ® 1200L (San Joaquin Refining) | 64741-96-4 64742-52-5 | 230.21 |

TABLE 22

12-Hydroxystearate and azelate as standard complex grease (Standard 6)

| Component | Identity | CAS # | Mass (g) |
|---|---|---|---|
| Initial Base Oil | RAFFENE ® 1200L (San Joaquin Refining) | 64741-96-4 64742-52-5 | 270.52 |
| Fatty Acid | 12-hydroxystearic acid | 106-14-9 | 35.08 |
| Dibasic Acid | Azelaic acid | 123.-99-9 | 6.23 |
| Metal Base | Lithium hydroxide monohydrate | 1310-66-3 | 8.02 |
| Water | Deionized | — | 16.36 |
| Let Down Base Oil | RAFFENE ® 1200L (San Joaquin Refining) | 64741-96-4 64742-52-5 | 135.43 |
| Finishing Base Oil | RAFFENE ® 1200L (San Joaquin Refining) | 64741-96-4 64742-52-5 | 157.42 |

TABLE 23

DIACID ® 1525 as complex fatty acid grease (Example 12)

| Component | Identity | CAS # | Mass (g) |
|---|---|---|---|
| Initial Base Oil | RAFFENE ® 1200L (San Joaquin Refining) | 64741-96-4 64742-52-5 | 307.16 |
| Complex Fatty Acid/Fatty Acid Mixture | DIACID ® 1525 (Ingevity Corporation) | 53980-88-4 | 75.08 |
| Metal Base | Lithium hydroxide monohydrate | 1310-66-3 | 13.47 |
| Water | Deionized | — | 27.18 |
| Let Down Base Oil | RAFFENE ® 1200L (San Joaquin Refining) | 64741-96-4 64742-52-5 | 153.52 |
| Finishing Base Oil | RAFFENE ® 1200L (San Joaquin Refining) | 64741-96-4 64742-52-5 | 493.96 |

TABLE 24

DIACID ® 1550 and Altapyne ® 128 as a complex fatty acid grease (Example 13)

| Component | Identity | CAS # | Mass (g) |
|---|---|---|---|
| Initial Base Oil | RAFFENE ® 1200L (San Joaquin Refining) | 64741-96-4 64742-52-5 | 327.92 |
| Complex Fatty Acid/Fatty Acid Mixture | DIACID ® 1550 (Ingevity Corporation) | 53980-88-4 | 30.43 |
| Fatty Acid | Altapyne ® 128 (Ingevity Corporation) | 68955-98-6 | 14.93 |
| Metal Base | Lithium hydroxide monohydrate | 1310-66-3 | 8.65 |
| Water | Deionized | — | 17.60 |
| Finishing Base Oil | RAFFENE ® 1200L (San Joaquin Refining) | 64741-96-4 64742-52-5 | 59.48 |

TABLE 25

DIACID ® 1550 and Altapyne ® L-5 as a complex fatty acid grease (Example 14)

| Component | Identity | CAS # | Mass (g) |
|---|---|---|---|
| Initial Base Oil | RAFFENE ® 1200L (San Joaquin Refining) | 64741-96-4 64742-52-5 | 319.51 |
| Complex Fatty Acid/Fatty Acid Mixture | DIACID ® 1550 (Ingevity Corporation) | 53980-88-4 | 38.28 |
| Fatty Acid | Altapyne ® L-5 (Ingevity Corporation) | 61790-12-3 | 18.87 |
| Metal Base | Lithium hydroxide monohydrate | 1310-66-3 | 11.01 |
| Water | Deionized | — | 21.95 |
| Finishing Base Oil | RAFFENE ® 1200L (San Joaquin Refining) | 64741-96-4 64742-52-5 | 159.76 |

TABLE 26

12-Hydroxystearate acid as a standard simple soap grease (Standard 7)

| Component | Identity | CAS # | Mass (g) |
|---|---|---|---|
| Initial Base Oil | VP-100 (Paulsboro Refining Company) | 64742-70-7 | 306.38 |
| Fatty Acid | 12-hydroxystearic acid | 106-14-9 | 78.00 |
| Metal Base | Lithium hydroxide monohydrate | 1310-66-3 | 11.40 |
| Water | Deionized | — | 23.25 |
| Let Down Base Oil | VP-100 (Paulsboro Refining Company) | 64742-70-7 | 156.19 |
| Finishing Base Oil | VP-100 (Paulsboro Refining Company) | 64742-70-7 | 112.58 |

TABLE 27

12-Hydroxystearate and azelate as standard complex grease (Standard 8)

| Component | Identity | CAS # | Mass (g) |
|---|---|---|---|
| Initial Base Oil | VP-100 (Paulsboro Refining Company) | 64742-70-7 | 309.49 |
| Fatty Acid | 12-hydroxystearic acid | 106-14-9 | 59.95 |
| Dibasic Acid | Azelaic acid | 123.-99-9 | 10.59 |
| Metal Base | Lithium hydroxide monohydrate | 1310-66-3 | 13.85 |
| Water | Deionized | — | 27.68 |
| Let Down Base Oil | VP-100 (Paulsboro Refining Company) | 64742-70-7 | 156.96 |
| Finishing Base Oil | VP-100 (Paulsboro Refining Company) | 64742-70-7 | 51.79 |

TABLE 28

DIACID ® 1525 as complex fatty acid grease (Example 15)

| Component | Identity | CAS # | Mass (g) |
|---|---|---|---|
| Initial Base Oil | VP-100 (Paulsboro Refining Company) | 64742-70-7 | 308.19 |
| Complex Fatty Acid/Fatty Acid Mixture | DIACID ® 1525 (Ingevity Corporation) | 53980-88-4 | 75.10 |
| Metal Base | Lithium hydroxide monohydrate | 1310-66-3 | 13.53 |
| Water | Deionized | — | 27.48 |
| Let Down Base Oil | VP-100 (Paulsboro Refining Company) | 64742-70-7 | 154.60 |
| Finishing Base Oil | VP-100 (Paulsboro Refining Company) | 64742-70-7 | 52.42 |

TABLE 29

DIACID ® 1550 and Altapyne ® L-5 as a complex fatty acid grease (Example 16)

| Component | Identity | CAS # | Mass (g) |
|---|---|---|---|
| Initial Base Oil | VP-100 (Paulsboro Refining Company) | 64742-70-7 | 300.82 |
| Complex Fatty Acid/Fatty Acid Mixture | DIACID ® 1550 (Ingevity Corporation) | 53980-88-4 | 56.50 |
| Fatty Acid | Altapyne ® L-5 (Ingevity Corporation) | 61790-12-3 | 27.80 |
| Metal Base | Lithium hydroxide monohydrate | 1310-66-3 | 16.10 |
| Water | Deionized | — | 32.23 |
| Finishing Base Oil | VP-100 (Paulsboro Refining Company) | 64742-70-7 | 150.09 |

TABLE 30

12-Hydroxystearate acid as a standard simple soap grease (Standard 9)

| Component | Identity | CAS # | Mass (g) |
|---|---|---|---|
| Initial Base Oil | EHC 45 ™ (ExxonMobil) | | 301.33 |
| Fatty Acid | 12-hydroxystearic acid | 106-14-9 | 85.54 |
| Metal Base | Lithium hydroxide monohydrate | 1310-66-3 | 12.52 |
| Water | Deionized | — | 25.05 |
| Let Down Base Oil | EHC 45 ™ (ExxonMobil) | | 151.55 |
| Finishing Base Oil | EHC 45 ™ (ExxonMobil) | | 176.62 |

TABLE 31

DIACID ® 1525 as complex fatty acid grease (Example 17)

| Component | Identity | CAS # | Mass (g) |
|---|---|---|---|
| Initial Base Oil | EHC 45 ™ (ExxonMobil) | | 299.50 |
| Complex Fatty Acid/Fatty Acid Mixture | DIACID ® 1525 (Ingevity Corporation) | 53980-88-4 | 85.54 |
| Metal Base | Lithium hydroxide monohydrate | 1310-66-3 | 15.42 |
| Water | Deionized | — | 31.12 |
| Let Down Base Oil | EHC 45 ™ (ExxonMobil) | | 150.98 |
| Finishing Base Oil | EHC 45 ™ (ExxonMobil) | | 15.07 |

TABLE 32

DIACID ® 1525 as complex fatty acid grease (Example 18)

| Component | Identity | CAS # | Mass (g) |
|---|---|---|---|
| Initial Base Oil | VHVI-8 (Petro-Canada America Lubricants LLC) | 178603-66-2 | 259.45 |
| Complex Fatty Acid/Fatty Acid Mixture | DIACID ® 1525 (Ingevity Corporation) | 53980-88-4 | 144.02 |
| Metal Base | Lithium hydroxide monohydrate | 1310-66-3 | 25.90 |
| Water | Deionized | — | 52.00 |
| Let Down Base Oil | VHVI-8 (Petro-Canada America Lubricants LLC) | 178603-66-2 | 131.20 |

Cone Penetration and NLGI of Exemplary Base Oil Thickener Soap. Cone Penetration of each sample was determined, as described above, by ASTM D217-19b to determine consistency/NLGI grade and is presented in Table 33 (HYNAP® N100HTS based compositions), Table 34 (RAFFENE® 1200L based compositions), Table 35 (VP-100 based compositions), Table 36 (EHC 45™ based compositions), and Table 37 (VHVI-8 based compositions) below. The reference materials were also tested, and this data is included in the table. From the data in the table, we can see that the invention materials could be used in similar concentrations as the reference materials in order to produce grease samples with similar penetration and consistency/NLGI grades as the reference materials.

Based on the data, one would expect the exemplary base oil thickener soap of the present disclosure would have improved storage and oil bleed stability. The functional characteristics as a lubricating grease is further examined in Table 38 and Table 39 below.

TABLE 33

Cone Penetration and NLGI Grade of Exemplary Base Oil Thickener Soaps with HYNAP ® N100HTS

| Exemplary Thickener Soap | Base Oil | Thickener (%) | Cone Penetration | NLGI Grade |
|---|---|---|---|---|
| 12-Hydroxystearic Acid Lithium Soap (Standard 1) | HYNAP ® N100HTS | 15.4 | 224 | 3 |
| 12-Hydroxystearic Acid Lithium Soap (Standard 2) | HYNAP ® N100HTS | 10.7 | 253 | 3 |
| 12-Hydroxystearic Acid and Azelaic Acid Lithium Soap (Standard 3) | HYNAP ® N100HTS | 13.9 | 269 | 2 |
| 12-Hydroxystearic Acid and Azelaic Acid Lithium Soap (Standard 4) | HYNAP ® N100HTS | 11.2 | 251 | 3 |
| DIACID ® 1525 Lithium Soap (Example 1) | HYNAP ® N100HTS | 12.8 | 272 | 2 |
| DIACID ® 1525 Lithium Soap (Example 2) | HYNAP ® N100HTS | 12.1 | 257 | 3 |
| DIACID ® 1550 and Altapyne ® L-5 Lithium Soap (Example 3) | HYNAP ® N100HTS | 18.5 | 219 | 3 |
| DIACID ® 1550 and Altapyne ® L-5 Lithium Soap (Example 4) | HYNAP ® N100HTS | 13.8 | 246 | 3 |
| DIACID ® 1550 and Altapyne ® 128 Lithium Soap (Example 5) | HYNAP ® N100HTS | 13.3 | 258 | 3 |
| DIACID ® 1550 and Altapyne ® 128 Lithium Soap (Example 6) | HYNAP ® N100HTS | 13.8 | 253 | 3 |
| TENAX ® 2010 Feed and Altapyne ® 1483 Lithium Soap (Example 7) | HYNAP ® N100HTS | 13.2 | 258 | 3 |
| TENAX ® 2010 Feed and Altapyne ® 128 Lithium Soap (Example 8) | HYNAP ® N100HTS | 13.2 | 269 | 2 |
| PolyEm C21 Diacid and Altapyne ® L-5 Lithium Soap (Example 9) | HYNAP ® N100HTS | 12.6 | 261 | 2 |
| AltaVeg DIACID ® 1525 (Soy Based) Lithium Soap (Example 10) | HYNAP ® N100HTS | 13.5 | 269 | 2 |

TABLE 33-continued

Cone Penetration and NLGI Grade of Exemplary Base Oil Thickener Soaps with HYNAP ® N100HTS

| Exemplary Thickener Soap | Base Oil | Thickener (%) | Cone Penetration | NLGI Grade |
|---|---|---|---|---|
| AltaVeg DIACID ® 1525 (Soy Based) Calcium Soap (Example 11) | HYNAP ® N100HTS | 20.1 | 259 | 3 |

TABLE 34

Cone Penetration and NLGI Grade of Exemplary Base Oil Thickener Soaps with RAFFENE ® 1200L

| Exemplary Thickener Soap | Base Oil | Thickener (%) | Cone Penetration | NLGI Grade |
|---|---|---|---|---|
| 12-Hydroxystearic Acid Lithium Soap (Standard 5) | RAFFENE ® 1200L | 6.6 | 239 | 3 |
| 12-Hydroxystearic Acid and Azelaic Acid Lithium Soap (Standard 6) | RAFFENE ® 1200L | 7.0 | 241 | 3 |
| DIACID ® 1525 Lithium Soap (Example 12) | RAFFENE ® 1200L | 7.5 | 249 | 3 |
| DIACID ® 1550 and Altapyne ® 128 Lithium Soap (Example 13) | RAFFENE ® 1200L | 10.8 | 271 | 2 |
| DIACID ® 1550 and Altapyne ® L-5 Lithium Soap (Example 14) | RAFFENE ® 1200L | 11 | 284 | 2 |

TABLE 35

Cone Penetration and NLGI Grade of Exemplary Base Oil Thickener Soaps with VP-100

| Exemplary Thickener Soap | Base Oil | Thickener (%) | Cone Penetration | NLGI Grade |
|---|---|---|---|---|
| 12-Hydroxystearic Acid Lithium Soap (Standard 7) | VP-100 | 12.2 | 258 | 3 |
| 12-Hydroxystearic Acid and Azelaic Acid Lithium Soap (Standard 8) | VP-100 | 12.3 | 259 | 3 |
| DIACID ® 1525 Lithium Soap (Example 15) | VP-100 | 13.1 | 252 | 3 |
| DIACID ® 1550 and Altapyne ® L-5 Lithium Soap (Example 16) | VP-100 | 16.2 | 364 | 0 |

TABLE 36

Cone Penetration and NLGI Grade of Exemplary Base Oil Thickener Soaps with EHC 45 ™

| Exemplary Thickener Soap | Base Oil | Thickener (%) | Cone Penetration | NLGI Grade |
|---|---|---|---|---|
| 12-Hydroxystearic Acid Lithium Soap (Standard 9) | 100EHC 45 ™ | 12.2 | 273 | 2 |

TABLE 36-continued

Cone Penetration and NLGI Grade of Exemplary Base Oil Thickener Soaps with EHC 45 ™

| Exemplary Thickener Soap | Base Oil | Thickener (%) | Cone Penetration | NLGI Grade |
|---|---|---|---|---|
| DIACID ® 1525 Lithium Soap (Example 17) | 100EHC 45 ™ | 15.9 | 296 | 2 |

TABLE 37

Cone Penetration and NLGI Grade of Exemplary Base Oil Thickener Soaps with VHVI-8

| Exemplary Thickener Soap) | Base Oil | Thickener (%) | Cone Penetration | NLGI Grade |
|---|---|---|---|---|
| DIACID ® 1525 Lithium Soap (Example 18) | 100EHC 45 ™ | 26.7 | 308 | 1 |

Exemplary base oil thickener soaps were worked 60 double strokes in a mechanical grease worker according to ASTM D217-16b and cone penetration was measured using a digital penetrometer, as described above. Then the exemplary base oil thickener soaps were worked 10,000 double strokes, 25,000 double strokes, and/or 100,000 double strokes in the mechanical grease worker and cone penetration was measured for a second time. A similarly prepared lithium complex soap grease of 12-hydroxystearic acid and azelaic acid thickener was measured for comparison. The 60 stroke and 25,000 stroke cone penetration measurements were compared to determine the change in penetration after prolonged working. Ideally, grease consistency (i.e. penetration) will remain unchanged with prolonged working (i.e. repeated shearing over long intervals) as this would indicate the potential for long services life of the grease. As such, a small change in cone penetration measurements after prolonged working is desired to avoid lubricant starvation of bearings or other parts due to leakage of grease from excessive softening or reduced flow of grease from excessive hardening. Penetration differences for TOFA exemplary thickener soaps were compared to in-house generated standards for comparison. A positive number indicates stiffening of the exemplary thickener soap and a negative number indicates softening of the exemplary thickener soap.

Table 38 and Table 39 below show the cone penetration data for the reference materials and several of exemplary soaps or complex soaps of the present disclosure. The reference materials show changes in penetration of about 50 units (0.1 mm) or less, corresponding to a consistency/NLGI grade change of 1 or less. Negative values in the A column of Table 38 and Table 39 correspond to softening of the test material under prolonged working. The exemplary soaps or complex soaps of the present disclosure showed similar penetration changes as compared to the reference materials. As such, the exemplary soaps or complex soaps of the present disclosure are work stable, by mechanical grease working, as conventional materials currently used in the art.

TABLE 19

Worked Penetration Measurements for Exemplary Base Oil Thickener Soaps with HYNAP ® N100HTS

| Exemplary Thickener Soap | Base Oil | Strokes Worked | Cone Penetration | NLGI Grade | Δ |
|---|---|---|---|---|---|
| 12-Hydroxystearic Acid Lithium Soap (Standard 1) | HYNAP ® N100HTS | Worked 60x | 222 | 3 | −22 |
| | | Worked 25Kx | 244 | 3 | |
| 12-Hydroxystearic Acid and Azelaic Acid Lithium Soap (Standard 3) | HYNAP ® N100HTS | Worked 60x | 265 | 2 | −54 |
| | | Worked 25Kx | 319 | 1 | |
| DIACID ® 1525 LithiumSoap (Example 1) | HYNAP ® N100HTS | Worked 60x | 265 | 2 | −41 |
| | | Worked 25Kx | 306 | 1 | |
| DIACID ® 1550 and Altapyne ® L-5 Lithium Soap (Example 3) | HYNAP ® N100HTS | Worked 60x | 230 | 3 | 1 |
| | | Worked 25Kx | 229 | 3 | |
| DIACID ® 1550 and Altapyne ® 128 Lithium Soap (Example 5) | HYNAP ® N100HTS | Worked 60x | 256 | 3 | −33 |
| | | Worked 25Kx | 289 | 2 | |

TABLE 20

Worked Penetration Measurements for Exemplary Base Oil Thickener Soaps with RAFFENE ® 1200L

| Exemplary Thickener Soap | Base Oil | Strokes Worked | Cone Penetration | NLGI Grade | Δ |
|---|---|---|---|---|---|
| 12-Hydroxystearic Acid Lithium Soap (Standard 5) | RAFFENE ® 1200L | Worked 60x | 240 | 3 | — |
| | | Worked 10Kx | 273 | 2 | −33 |
| | | Worked 100Kx | 304 | 1 | −63 |
| 12-Hydroxystearic Acid and Azelaic Acid Lithium Soap (Standard 6) | RAFFENE ® 1200L | Worked 60x | 243 | 3 | — |
| | | Worked 10Kx | 260 | 2 | −17 |
| | | Worked 100Kx | 291 | 2 | −49 |
| DIACID ® 1525 Lithium Soap (Example 12) | RAFFENE ® 1200L | Worked 60x | 247 | 3 | — |
| | | Worked 10Kx | 288 | 2 | −40 |
| | | Worked 100Kx | 318 | 1 | −71 |
| DIACID ® 1550 and Altapyne ® 128 Lithium Soap (Example 13) | RAFFENE ® 1200L | Worked 60x | 269 | 2 | — |
| | | Worked 10Kx | 331 | 1 | −62 |
| | | Worked 100Kx | 352 | 1 | −84 |

While preferred embodiments of the present disclosure have been shown and described herein, it will be understood that such embodiments are provided by way of example only. Numerous variations, changes and substitutions will occur to those skilled in the art without departing from the spirit of the present disclosure. Accordingly, it is intended that the appended claims cover all such variations as fall within the spirit and scope of the invention of the present disclosure. Furthermore, the system may comprise at least one device for charging and/or discharging the system or a plurality of devices for charging and/or discharging the system.

The contents of all references, patents, pending patent applications and published patents, cited throughout this application are hereby expressly incorporated by reference.

Those skilled in the art will recognize, or be able to ascertain using no more than routine experimentation, many equivalents to the specific embodiments of the present disclosure described herein. Such equivalents are intended to be encompassed by the following claims. It is understood that the detailed examples and embodiments described herein are given by way of example for illustrative purposes only, and are in no way considered to be limiting to the invention. Various modifications or changes in light thereof will be suggested to persons skilled in the art and are included within the spirit and purview of this application and are considered within the scope of the appended claims. For example, the relative quantities of the ingredients may be varied to optimize the desired effects, additional ingredients may be added, and/or similar ingredients may be substituted for one or more of the ingredients described. Additional advantageous features and functionalities associated with the systems, methods, and processes of the present disclosure will be apparent from the appended claims. Moreover, those skilled in the art will recognize, or be able to ascertain using no more than routine experimentation, many equivalents to the specific embodiments of the present disclosure. Such equivalents are intended to be encompassed by the following claims.

What is claimed is:

1. A lubricating composition comprising:

a base oil thickened to a grease consistency with a soap thickener comprising:

a metal soap of a carboxylic acid composition in a base oil, wherein the carboxylic acid composition comprises a blend of (1) a modified fatty acid composition prepared by performing a pericyclic reaction between an unsaturated small molecule and a fatty acid mixture, and (2) additional fatty acids, wherein the unsaturated small molecule is acrylic acid, fumaric acid, maleic anhydride, or a combination thereof.

2. A lubricating composition comprising:

a base oil thickened to a grease consistency with a soap thickener produced by a method comprising:

preparing a soap of a carboxylic acid composition in a base oil to produce the soap thickener, wherein the carboxylic acid composition comprises a blend of (1) a modified fatty acid composition prepared by performing a pericyclic reaction between an unsaturated small molecule and a fatty acid mixture, and (2) additional fatty acids, wherein the unsaturated small molecule is acrylic acid, fumaric acid, maleic anhydride, or a combination thereof.

3. The lubricating composition of claim 1, wherein the fatty acid mixture is a vegetable oil, tall oil fatty acids (TOFA), or a mixture of $C_{12-20}$ fatty acids.

4. The lubricating composition of claim 1, wherein the fatty acid mixture is a vegetable oil that is selected from safflower oil, grapeseed oil, sunflower oil, walnut oil, soybean oil, cottonseed oil, coconut oil, corn oil, olive oil, palm oil, palm olein/kernel oil, peanut oil, rapeseed oil, canola oil, sesame oil, hazelnut oil, almond oil, beech nut oil, cashew oil, macadamia oil, mongongo nut oil, pecan oil, pine nut oil, pistachio oil, grapefruit seed oil, lemon oil, orange oil, watermelon seed oil, bitter gourd oil, buffalo gourd oil, butternut squash seed oil, egusi seed oil, pumpkin seed oil, borage seed oil, blackcurrant seed oil, evening primrose oil, acai oil, black seed oil, flaxseed oil, carob pod oil, amaranth oil, apricot oil, apple seed oil, argan oil, avocado oil, babassu oil, ben oil, borneo tallow nut oil, cape chestnut, algaroba oil, cocoa butter, cocklebur oil, poppyseed oil, cohune oil, coriander seed oil, date seed oil, dika oil, false flax oil, hemp oil, kapok seed oil, kenaf seed oil, lallemantia oil, mafura oil, manila oil, meadowfoam seed oil, mustard oil, okra seed oil, papaya seed oil, perilla seed oil, persimmon seed oil, pequi oil, pili nut oil, pomegranate seed oil, prune kernel oil, quinoa oil, ramtil oil, rice bran oil, royle oil, shea nut oil, sacha inchi oil, sapote oil, seje oil, taramira oil, tea seed oil, thistle oil, tigernut oil, tobacco seed oil, tomato seed oil, wheat germ oil, castor oil, colza oil, flax oil, radish oil, salicornia oil, tung oil, honge oil, jatropha oil, jojoba oil, nahor oil, paradise oil, petroleum nut oil, dammar oil, linseed oil, stillingia oil, vernonia oil, amur cork tree fruit oil, artichoke oil, balanos oil, bladderpod oil, brucea javanica oil, burdock oil, candlenut oil, carrot seed oil, chaulmoogra oil, crambe oil, croton oil, cuphea oil, honesty oil, mango oil, neem oil, oojon oil, rose hip seed oil, rubber seed oil, sea buckthorn oil, sea rocket seed oil, snowball seed oil, tall oil, tamanu oil, tonka bean oil, ucuhuba seed oil, and any mixture thereof.

5. The lubricating composition of claim 2, wherein preparing the soap includes:

combining the base oil and the carboxylic acid composition to produce a base oil, carboxylic acid mixture composition in the base oil;

dissolving the acid components of the carboxylic acid composition in the base oil;

adding a slurry of excess metal base in water to the base oil, carboxylic acid mixture to produce a slurry mixture;

neutralizing the slurry mixture to form the soap thickener or a soap solution;

dehydrating the soap solution to form the soap thickener; or a combination thereof.

6. The lubricating composition of claim 5, wherein:

dissolving the acid components in the base oil includes heating the base oil, carboxylic acid mixture;

the excess metal base is a slurry of about 1.0% to about 10.0% excess metal base;

prior to neutralizing the slurry mixture, the method further comprises heating the slurry mixture;

neutralizing the slurry mixture includes heating the slurry mixture to about 110.0° C. to about 130.0° C.;

dehydrating the soap solution to form the soap thickener includes heating the soap solution; or a combination thereof.

7. The lubricating composition of claim 5, wherein the metal base is: lithium hydroxide, calcium hydroxide, aluminum hydroxide, sodium hydroxide, potassium hydroxide, or a combination thereof.

8. A lubricating composition comprising:

a base oil thickened to obtain a lubricating composition with a National Lubricating Grease Institute (NLGI) grade of NLGI 000 to NLGI 6, wherein the base oil is thickened with a soap thickener produced by a method including:

combining a base oil and a carboxylic acid composition to produce a base oil, carboxylic acid mixture composition in the base oil, wherein the carboxylic acid composition comprises a blend of (1) a modified fatty acid composition prepared by performing a pericyclic reaction between an unsaturated small molecule and a fatty acid mixture, and (2) additional fatty acids mixture;

adding a slurry of excess metal base in water to the base oil, carboxylic acid mixture to produce a slurry mixture, wherein the metal base is lithium hydroxide, calcium hydroxide, aluminum hydroxide, sodium hydroxide, potassium hydroxide, or a combination thereof; and neutralizing the slurry mixture to form the soap thickener, wherein:

(i) the unsaturated small molecule is acrylic acid, fumaric acid, maleic anhydride, or a combination thereof, and (ii) the fatty acid mixture includes tall oil fatty acids (TOFA), 5-carboxy-4-hexylcyclohex-2-ene-1-octanoic acid, 6-carboxy-4-hexylcyclohex-2-ene-1-octanoic acid, C21 diacid, or a combination thereof.

9. The lubricating composition of claim 1, wherein:

the additional fatty acids are one or more saturated fatty acid, one or more hydroxy fatty acid, one or more branched fatty acids, or a combination thereof;

the ratio of the fatty acid mixture to the blending fatty acids is from about 95:5 to about 20:80; or a combination thereof.

10. The lubricating composition of claim 1, wherein the modified fatty acid composition is a modified TOFA composition.

11. The lubricating composition of claim 1, wherein the pericyclic reaction is a Diels-Alder reaction.

12. The lubricating composition of claim 1, wherein:

the soap thickener comprises about 25.0% to about 75.0% polybasic acids;

water is present in an amount of less than or equal to about 10.0 wt. % of the soap thickener; or a combination thereof.

13. The lubricating composition of claim 12, wherein the balance of the soap thickener comprises unreacted fatty acids and reaction byproducts other than polybasic acids.

14. The lubricating composition of claim 1, wherein: the fatty acid mixture includes maleated TOFA, fumarated TOFA, acylated TOFA, 5-carboxy-4-hexylcyclohex-2-ene-1-octanoic acid, 6-carboxy-4-hexylcyclohex-2-ene-1-octanoic acid, C21 diacid, or a combination thereof.

15. The lubricating composition of claim 1, wherein the soap thickener is present in an amount of about 5.0 wt. % to about 20.0 wt. % of the lubricating composition.

16. The lubricating composition of claim 1, further comprising a friction modifier, an emulsifier, a surfactant, a co-thickener, a rheology modifier, a corrosion inhibitor, an antioxidant, a wear inhibitor, an extreme pressure agent, a tackiness agent, a viscosity modifier, a colorant, an odor control agent, a filler, or a combination thereof.

17. The lubricating composition of claim 1, wherein the lubricating composition is a grease, a gear oil, a chain oil, a track oil grease, a centralized greasing system grease, or a cable or wire drawing lubricant.

18. A method of preparing a lubricating composition, the method comprising:

providing a soap thickener comprising a metal soap of a carboxylic acid composition in a base oil, wherein the carboxylic acid composition comprises a blend of (1) a modified fatty acid composition prepared by performing a pericyclic reaction between an unsaturated small molecule and a fatty acid mixture, and (2) additional fatty acids, wherein the unsaturated small molecule is acrylic acid, fumaric acid, maleic anhydride, or a combination thereof;

heating the soap thickener;

cooling the soap thickener;

diluting the cooled soap thickener with a sufficient amount of base oil to obtain a lubricating composition with a National Lubricating Grease Institute (NLGI) grade of NLGI 000 to NLGI 6; and milling the soap thickener.

19. The method of claim 18, further comprises:

measuring cone penetration of the lubricating composition to determine the NLGI grade;

mixing in base oil to the lubricating composition to increase the cone penetration of the complex thickener soap; or a combination thereof.

20. The method of claim 18, wherein cooling the soap thickener to a temperature below the base oil flash point includes:

(i) cooling the soap thickener includes cooling the soap thickener to about 100.0° C. to about 120.0° C. over a period of about 20 minutes to about 60 minutes;

(ii) heating the soap thickener to about 160.0° C. to about 200.0° C.;

(iii) cooling the soap thickener to a temperature below the flash point of the base oil; or (iv) a combination thereof.

21. The method of claim 18, further comprising mixing in a friction modifier, an emulsifier, a surfactant, a co-thickener, a rheology modifier, a corrosion inhibitor, an antioxidant, a wear inhibitor, an extreme pressure agent, a tackiness agent, a viscosity modifier, a colorant, an odor control agent, a filler, or a combination thereof.

22. A lubricating composition produced by the method of claim 18.

23. A method of lubricating, the method comprising applying the lubricating composition of claim 1 to a surface in the need thereof.

24. The method of claim 23, wherein the surface includes a gear, a chain, a track, a cable, a wire, a roller bearing, a metal plate, a journal bearing, an open bear box, a pump, a piston, or a combination thereof.

* * * * *